US007130557B2

(12) United States Patent
Abe et al.

(10) Patent No.: US 7,130,557 B2
(45) Date of Patent: Oct. 31, 2006

(54) PROCESS CARTRIDGE AND ELECTROGRAPHIC IMAGE FORMING APPARATUS

(75) Inventors: Daisuke Abe, Shizuoka-ken (JP); Toru Oguma, Mishima (JP); Shigeo Murayama, Susono (JP); Hideyuki Matsubara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 11/007,214

(22) Filed: Dec. 9, 2004

(65) Prior Publication Data

US 2005/0214019 A1 Sep. 29, 2005

(30) Foreign Application Priority Data

Dec. 9, 2003 (JP) ..... 2003-411034
Dec. 6, 2004 (JP) ..... 2004-352533

(51) Int. Cl.
*G03G 15/00* (2006.01)
*G03G 21/16* (2006.01)

(52) U.S. Cl. ..... 399/90; 399/88; 399/89; 399/111

(58) Field of Classification Search ..... 399/88, 399/89, 90, 111
See application file for complete search history.

(56) References Cited

U.S. PATENT DOCUMENTS 6,097,906 A 8/2000 Matsuzaki et al. ..... 399/90
6,993,264 B1 * 1/2006 Oguma et al. ..... 399/90

FOREIGN PATENT DOCUMENTS

JP 62-215278 9/1987
JP 7-77921 3/1995
JP 09-68833 3/1997
JP 10-74030 3/1998
JP 10-228223 8/1998

OTHER PUBLICATIONS

Patent Abstracts of Japan, vol. 1998, No. 08, Jun. 30, 1998.
Translation of Nov. 14, 2005 final Taiwanese Office Action in Appln. No. 93138142.

* cited by examiner

*Primary Examiner*—David M. Gray
*Assistant Examiner*—Joseph S. Wong
(74) *Attorney, Agent, or Firm*—Fitzpatrick, Cella, Harper & Scinto

(57) ABSTRACT

A process cartridge is detachably mountable to a main assembly of an electrophotographic image forming apparatus. The main assembly includes an output contact movable between electrical connecting and retracted positions, a displaceable member for moving the output contact, and an elastic function member for elastically urging the displaceable member to urge the output contact toward the retracted position. The cartridge includes an electrophotographic photosensitive drum, a process device actable on the drum, and a movable operation member engageable with a main-assembly fixed engageable member and with the displaceable member to move the output contact from the retracted to the electrical connecting position against the bias of the elastic function member, in interrelation with the movement of the displaceable member, after the engagement with the fixed engageable member when the cartridge is inserted into the main assembly. The cartridge also includes an input electrical contact.

20 Claims, 44 Drawing Sheets

(a)

(b)

(a)

(b)

(a)

(b)

(a)

(b)

(a)

(b)

PROCESS CARTRIDGE AND ELECTROGRAPHIC IMAGE FORMING APPARATUS

FIELD OF THE INVENTION AND RELATED ART

The present invention relates to a cartridge and an electrophotographic image forming apparatus usable with the process cartridge.

Here, the electrophotographic image forming apparatus is an apparatus for forming the image on a recording material (recording sheet, OHP sheet or the like) through an electrophotographic image forming process. It includes an electrophotographic copying machine, an electrophotographic printer or the like.

The process cartridge is a cartridge containing as a unit an electrophotographic photosensitive member and process means including at least one of charging member and developing member, which cartridge is detachably mountable to a main assembly of the electrophotographic image forming apparatus.

With the electrophotographic image forming apparatus of the process cartridge type, the process cartridge can be mounted to or demounted from the main assembly of the image forming apparatus by the user without an expert serviceman. Therefore, the operationality of the image forming apparatus is remarkably-improved.

In such an electrophotographic image forming apparatus, it is necessary to supply electric voltages to a charging member for electrically charging the electrophotographic photosensitive member (photosensitive drum), a developing member for developing an electrostatic latent image formed on the photosensitive drum, and the like, which are contained in the process cartridge.

Heretofore, the cartridge is provided with an input electrical contact for electrical connection between the cartridge and the main assembly of the apparatus when the cartridge is mounted in place in the main assembly of the image forming apparatus. On the other hand, the main assembly of the apparatus is provided with an output contact. With this structure, when the cartridge is mounted to the main assembly of the apparatus, the input electrical contact is connected with the output contact. By doing so, the voltage can be supplied from the main assembly of the apparatus to the cartridge.

More particularly, the following structure is known.

A movable protection plate covering the contact member (the output contact) is provided in the main assembly of the apparatus. When the printer (image forming apparatus) is subjected to a maintenance operation, the operator and/or a tool is prevented from touching the contact member. By inserting motion of the cartridge into the main assembly of the apparatus, the protection plate is retracted to a retracted position. By doing so, the electrical connection is permitted between the contact member in the main assembly of the apparatus and the contact member on the cartridge (input electrical contact) (paragraphs ([0012]–[0015], FIG. 1-FIG. 3 of Japanese Laid-open Patent Application Hei 7-77921).

When the unit is dismounted from the main assembly of the apparatus, a connector pin (output contact) is hidden inside a partition wall. By doing so, the serviceman or user is prevented from touching the connector pin. By the insertion of the unit into the main assembly of the apparatus, the connector pin enters the unit insertion space. Thus, the connector pin and connector portion of the unit (input electrical contact) are electrically connected (Japanese Laid-open Patent Application Sho 62-215278).

In addition, the drum shutter is provided with a regulating portion. The regulating portion is effective to cover the electrical contact (input electrical contact). By doing so, the contact defect which may be caused by deposition of foreign matter on the electrical contact, can be prevented. By the entering of the cartridge into the main assembly of the apparatus, the electrical contact of the cartridge and the electrical contact of the main assembly of the apparatus (output contact) are electrically connected. (Japanese Laid-open Patent Application Hei 10-74030).

A contact member (output contact) is provided and is movable between a retracted position and a regular position. By doing so, the contact portion of the cartridge (input electrical contact) and the contact member of the main assembly of the apparatus are contacted with each other in order. Before the cartridge is inserted into the main assembly of the apparatus, the contact member (output contact) is in the retracted position. When the cartridge is mounted to the main assembly of the apparatus, the contact member is moved to the regular position. By this, the contact portion and the contact portion are electrically connected with each other. (Japanese Laid-open Patent Application Hei 9-68833).

The present invention provides a further improvements in such structures.

SUMMARY OF THE INVENTION

Accordingly, it is a principal object of the present invention to provide a process cartridge, an electrical connection mechanism and an electrophotographic image forming apparatus wherein reliability in an electrical connection between an electrical input contact of the process cartridge and an electrical output contact of the main assembly of the electrophotographic image forming apparatus is improved, when the process cartridge is mounted to the electrophotographic image forming apparatus.

It is another object of the present invention to provide a process cartridge, an electrical connection mechanism and an electrophotographic image forming apparatus wherein damage of electric circuit provided in the main assembly of the electrophotographic image forming apparatus can be effectively prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A description will be provided as to a process cartridge, an electrical connection mechanism and an electrophotographic image forming apparatus according to an embodiment of the present invention.

Embodiment 1

Figure 1:
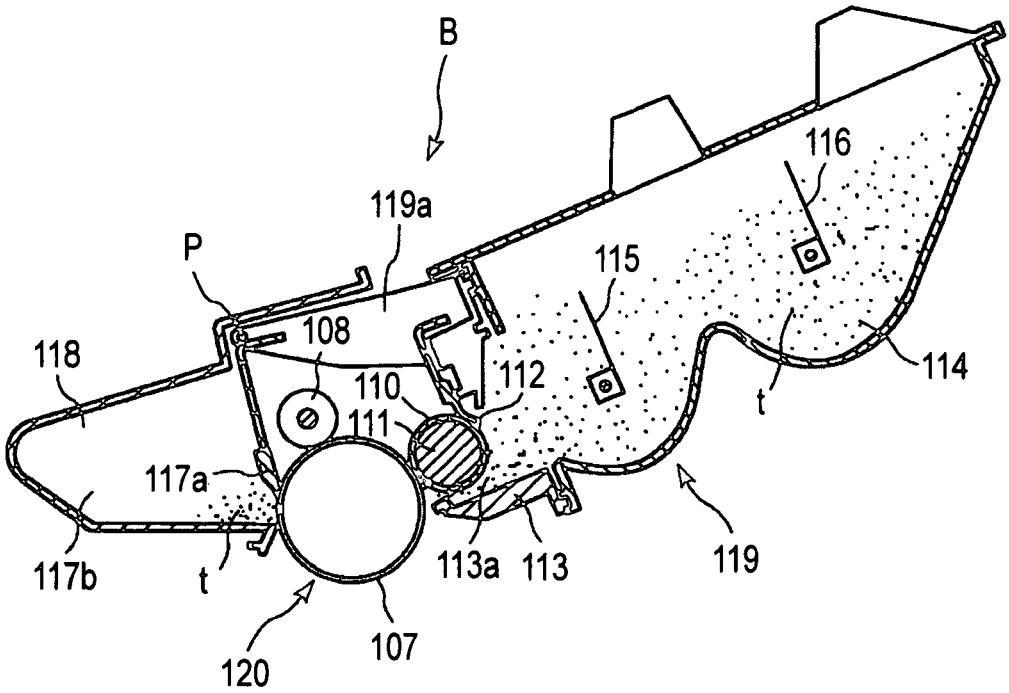
FIG. 1 is a sectional view of the process cartridge according to an embodiment of the present invention.

(1) General Structure of Process Cartridge:

Referring to FIG. 1, a process cartridge B (cartridge) according to a first embodiment of the present invention will be described. FIG. 1 is a sectional view of the cartridge B.

Figure 2:
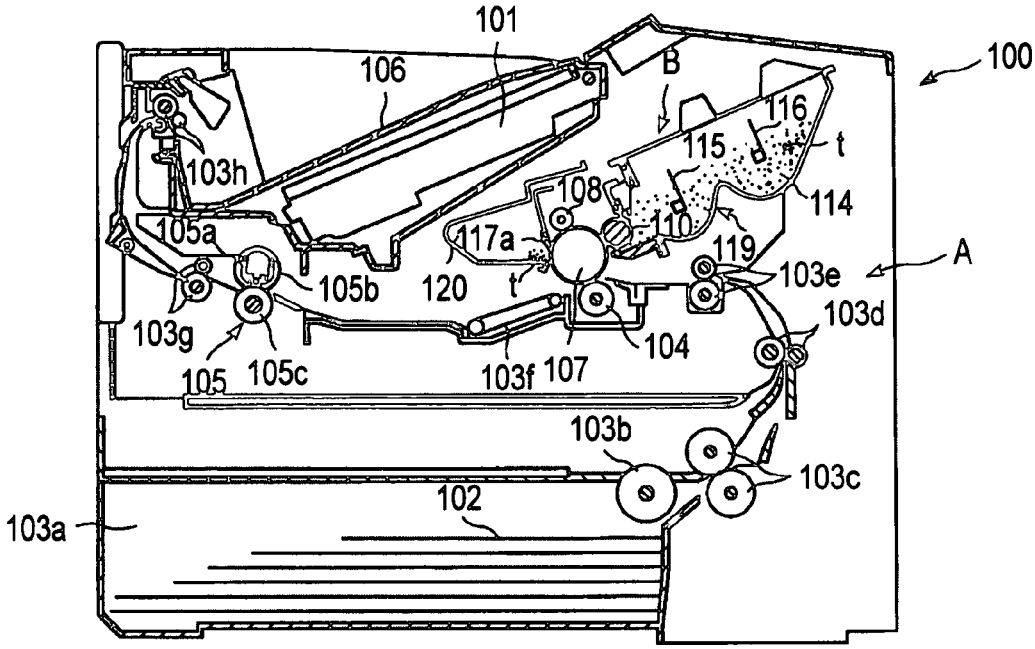
FIG. 2 is a schematic side view of the structure of an image forming apparatus according to an embodiment of the present invention.

In FIG. 1, the cartridge B comprises an electrophotographic photosensitive drum (photosensitive drum) 107. As shown in FIG. 2, when the cartridge B is mounted to the main assembly A of the electrophotographic image forming apparatus (main assembly of the apparatus), the photosensitive drum 107 is rotatable by receiving a driving force from the main assembly A.

Disposed opposed to an outer surface of the photosensitive drum 107 is a charging roller 108 functioning as a charging member. The charging roller 108 is supplied with a voltage from the main assembly A (also denoted by reference numeral 100) of the apparatus and electrically charges the photosensitive drum 107. The charging roller 108 is contacted to the photosensitive drum 107 and is rotated by the photosensitive drum 107.

When the cartridge B is mounted to the main assembly A of the apparatus, the charging roller 108 is supplied with a voltage from the main assembly 100 of the apparatus through a charging output contact 144*a* (FIG. 4) functioning as an output contact and a charging input electrical contact 141*a* (FIG. 10) functioning as an input electrical contact. The charging roller 108 functions by receiving the voltage to electrically charge the photosensitive drum 107.

The cartridge B includes a developing roller 110 functioning as a developing member. The developing roller 110 supplies the developer t into a developing zone adjacent a photosensitive drum 107. The developing roller 110 develops an electrostatic latent image formed on the photosensitive drum 107 with the developer t. The developing roller 110 contains a magnet roller (stationary magnet) 111.

When the cartridge B is mounted to the main assembly A of the apparatus, the developing roller 110 is supplied with a voltage from the main assembly 100 of the apparatus through a development output contact (unshown) functioning as an output contact and a development input electrical contact (unshown) functioning as an input electrical contact. The developing roller 110 functions by the thus applied voltage to develop the electrostatic latent image.

To the peripheral surface of the developing roller 110, a developing blade 112 is contacted. The developing blade 112 functions to regulate an amount of the developer t deposited on the peripheral surface of the developing roller 110. The developing blade 112 also functions to triboelectrically charge the developer t.

The developer t accommodated in the developer accommodating container 114 is supplied out into the developer chamber 113*a* by rotation of the stirring members 115, 116. The developing roller 110 supplied with the voltage through the electrical contact 160*a* is rotated. By doing so, a layer of the developer having the triboelectric charge applied by the developing blade 112 is formed on the surface of the developing roller 110. The developer t is transferred onto the photosensitive drum 107 in accordance with the pattern of the latent image. Thus, the latent image developed.

The developed image on the photosensitive drum 107 is transferred onto a recording material 102 by a transfer roller 104.

Disposed opposed to the outer surface of the photosensitive drum 107 is an elastic cleaning blade 117*a*. The cleaning blade 117*a* has an edge which is contacted to the photosensitive drum 107. The blade 117*a* functions to remove the developer t remaining on the photosensitive drum 107 after transfer of the developed image onto the recording material 102. The developer t removed from the surface of the photosensitive drum 107 by the blade 117*a* is accommodated in a removed developer container 117*b*.

The cartridge B is constituted by the developing unit 119 and the drum unit 120.

The developing unit 119 is constituted by the developing device frame 113 which is a part of the cartridge frame B 1. The developing unit 119 contains the developing roller 110, the developing blade 112, the developer chamber 113*a*, the developer accommodating container 114 and stirring members 115, 116. A development input electrical contact (unshown) is provided exposed from the developing device frame 113.

A drum unit 120 is constituted by a drum frame 118 which is a part of the cartridge frame B 1. The drum unit 120 contains the photosensitive drum 107, the cleaning blade 117*a*, the removed developer container 117*b* and the charging roller 108. The charging input electrical contact 141*a* is provided exposed from the drum frame 118.

One end of the photosensitive drum 107 is supported by the drum frame 118. An outer end of the drum shaft 139 functions as a cartridge guide 140L1 which will be described hereinafter referring to FIG. 7.

Figure 6:
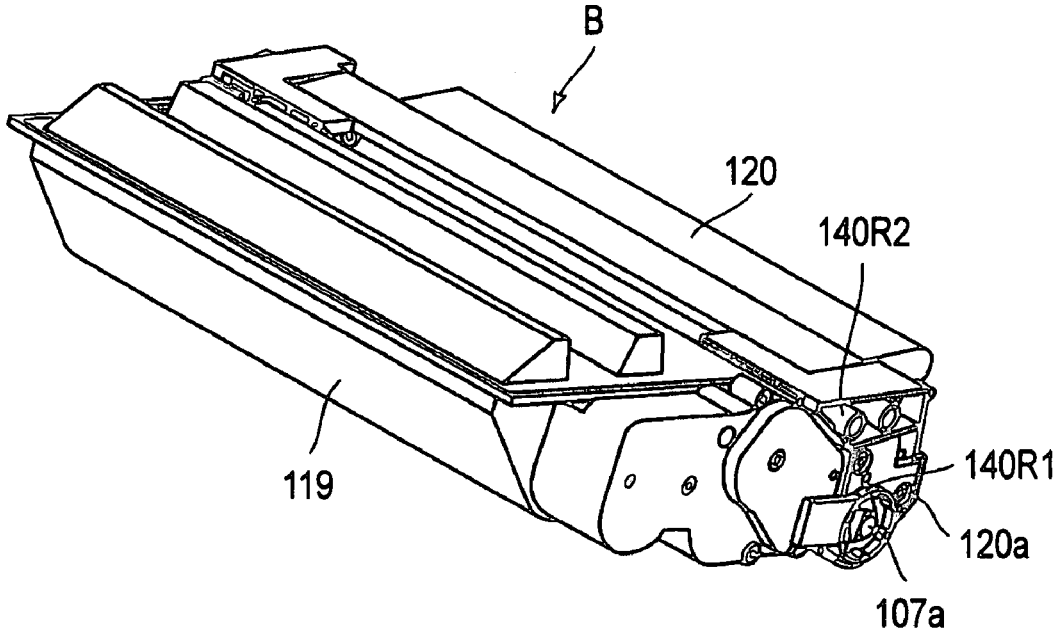
FIG. 6 is a perspective view of a process cartridge according to the embodiment of the present invention.
Figure 7:
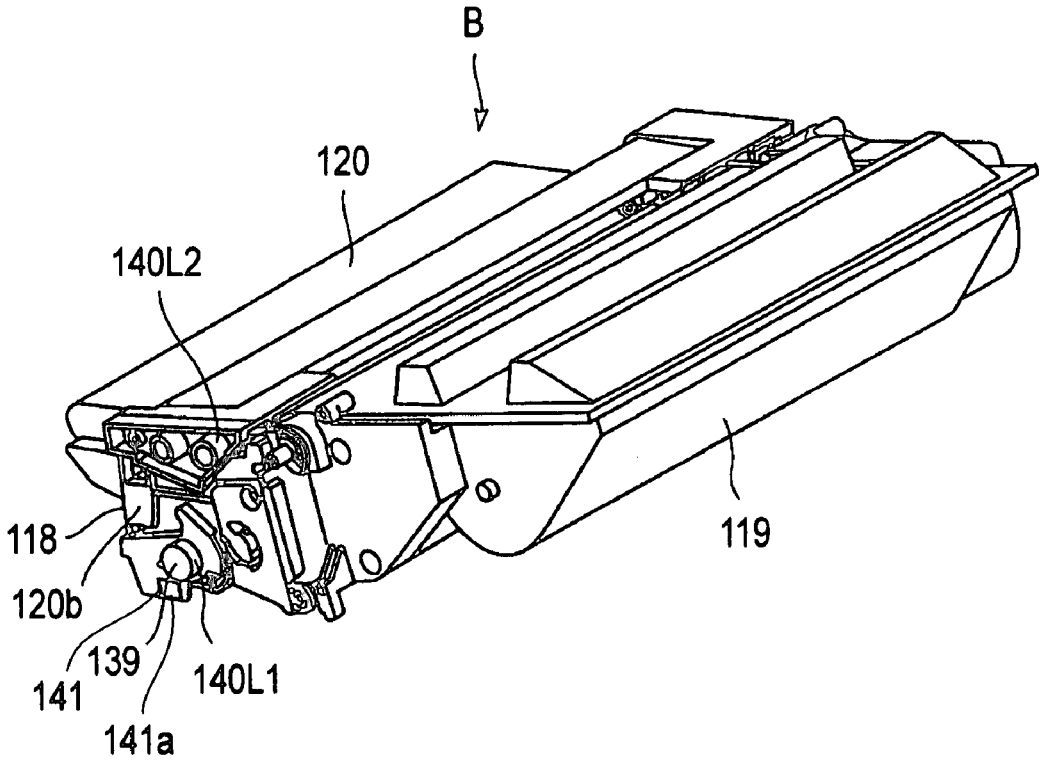
FIG. 7 a perspective view of a process cartridge according to the embodiment of the present invention.

As will be understood from FIG. 6, cartridge guides 140R1, 140R2 are provided at one longitudinal end 120*a* of the drum unit 120. As shown in FIG. 7, a cartridge guide 140L1 and another cartridge guide 140L2 are provided at the other longitudinal end 120*b*.

The developing unit 119 and the drum unit 120 are rotatably coupled with each other by pins P (FIG. 1). The developing roller 110 is urged to the photosensitive drum 107 by elastic members in the form of compression coil springs 121, 122 (FIG. 8) which are provided between the units 119, 120. Designated by 119*a* is an arm which is provided in the developing unit 119. The arm 119*a* is engaged with the drum unit 120, too. A pin P is penetrated through holes formed in the units 119, 120.

Figure 8:
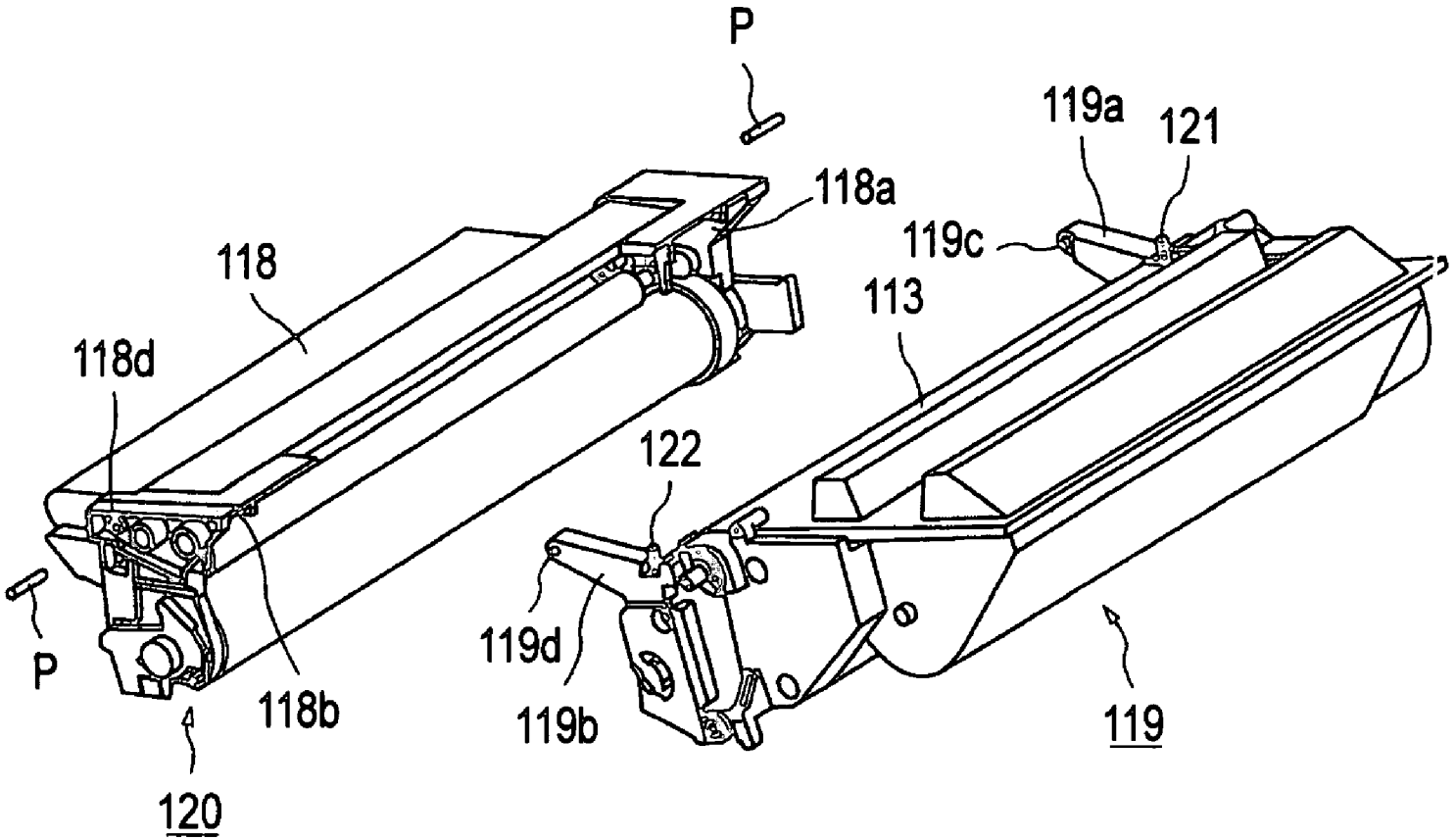
FIG. 8 is a perspective view wherein the developing unit and the drum unit are separated from each other to illustrate the structure of the process cartridge according to an embodiment of the present invention.
Figure 9:
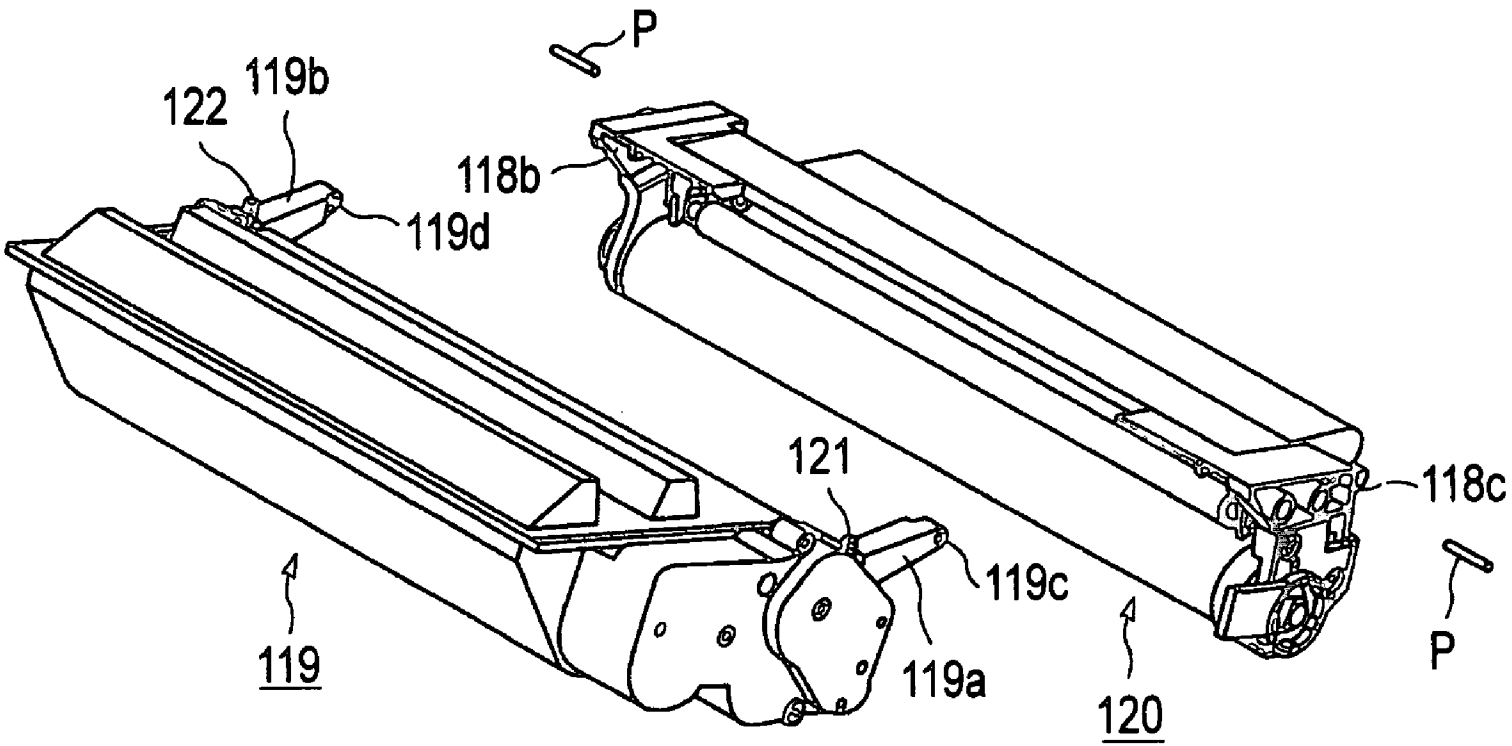
FIG. 9 is a perspective view wherein the developing unit and the drum unit are shown as being separated to illustrate the structures of the process cartridge of the embodiment of the present invention.

Referring to FIGS. 8 and 9, a more detailed description will be provided. Free ends of arm portions 119*a*, 119*b* are provided adjacent longitudinally opposite end portions of the developing device frame 113, and are provided with circular rotation holes 119*c*, 119*d* extending parallel with developing roller 110. At two positions of the longitudinal ends of the drum frame 118, recesses 118*a*, 118*b* are provided to receive the arm portion 119*a*, 119*b*. The arm portions 119*a*, 119*b* are inserted into recesses 118*a*, 118*b*. Then, coupling members, namely, pins P are inserted into mounting holes 118*c*, 118*d* of the drum frame 118. In addition, pins P are engaged into the rotation holes 119*c*, 119*d* of the arm portions 119*a*, 119*b*. Then, the pins P are press-fitted into holes (unshown) formed inside of the drum frame 118. In this manner, the pins P are mounted. By doing so, the drum unit 120 and the developing unit 119 are rotatably coupled by the pins (coupling members) and therefore, they are rotatable about the pins. In this case, compression coil springs 121, 122 mounted to the base portions of the arm portion 119*a* and 119*b* abut to upper walls of the recesses 118*a*, 118*b* of the drum frame 118. By this, the developing unit 119 is urged downwardly by the elastic force provided by the springs 121, 122. In such a manner, the developing roller 110 is assuredly urged to toward the photosensitive drum 107.

(2) Electrophotographic Image Forming Apparatus:

Referring to FIG. 2, a description will be provided as to the electrophotographic image forming apparatus 100 with which the cartridge B is usable. FIG. 2 shows a general arrangement of an electrophotographic image forming apparatus (image forming apparatus) 100.

A description will be provided as to a laser beam printer which is an exemplary image forming apparatus 100.

In the image forming operation, a surface of the photosensitive drum 107 is uniformly charged by the charging roller 108. A laser beam is emitted from a laser diode and is projected onto the photosensitive drum 107 in accordance with image information with optical means 101 including a polygonal mirror, lenses and deflection mirrors (unshown). By doing so, an electrostatic latent image is formed on the photosensitive drum 107 corresponding to the image information. The latent image is developed by the developing roller 110 which has been described hereinbefore.

On the other hand, in synchronism with the formation of the developed image, a recording material 102 in a cassette 103*a* is fed out by pick-up roller 103*b* and is fed to a transfer position by feeding rollers 103*c*, 103*d*, 103*e*. At the transfer position, a transfer roller 104 (transferring means) is provided. The transfer roller 104 is supplied with a voltage. By this, the developed image formed on the photosensitive drum 107 is transferred onto the recording material 102.

The recording material 102 now having the developed image transferred thereto is fed to fixing means 105 through a guide 103*f*. The fixing means 105 includes a driving roller 105*c* and a fixing roller 105*b* containing a heater 105*a* therein. The fixing means 105 applies heat and pressure to the recording material 102 passing therethrough to fix the developed image on the recording material 102. The recording material 102 is fed by a pair of rollers 103*g* and 103*h* onto a tray 106. The roller 103*b*, the pair of feeding rollers 103*c*, 103*d*, 103*e*, the guide 103*f*, the pair of rollers 103*g* and 103*h* and so on constitute feeding means 103 for the recording material 102.

The cartridge B is mounted into or demounted from the main assembly A of the apparatus in the following manner.

Figure 3:
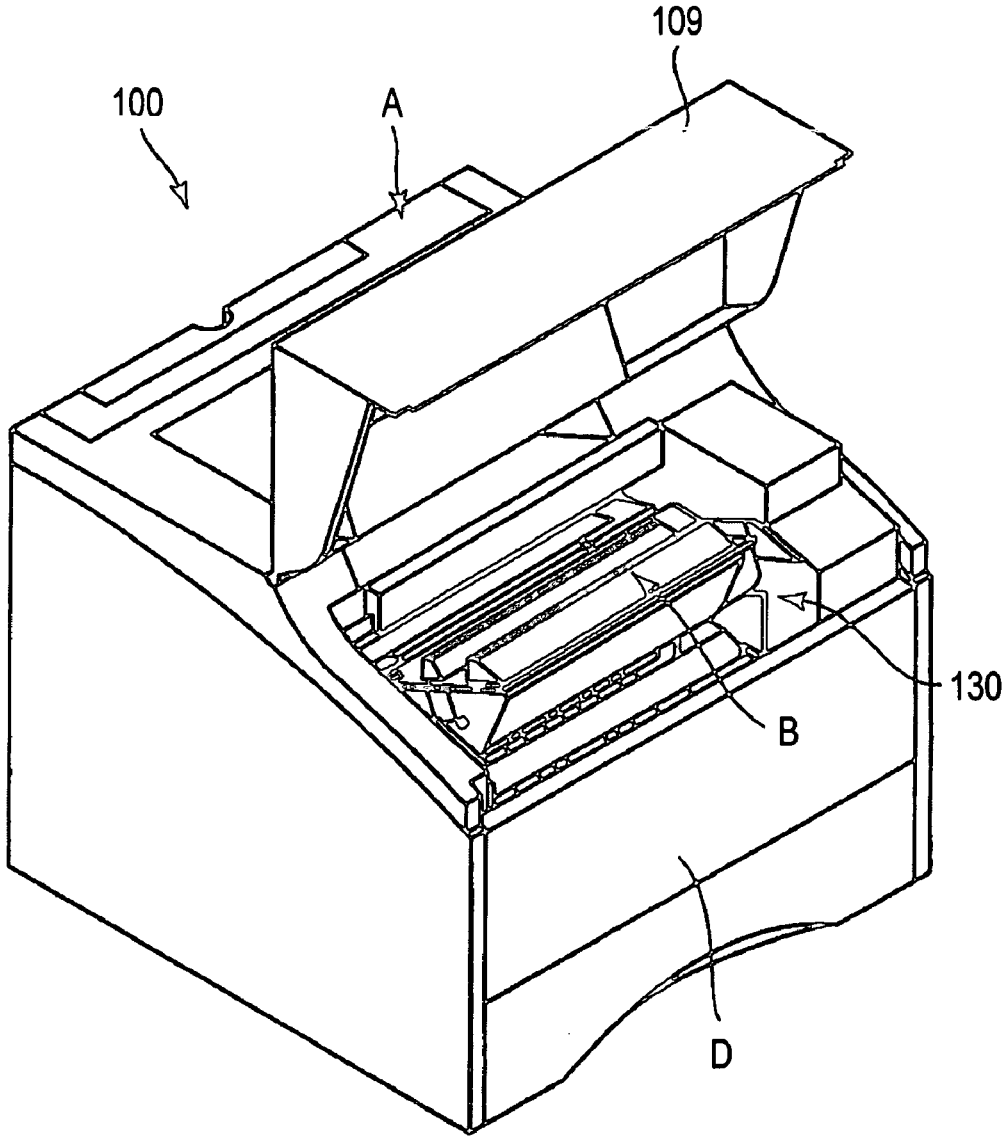
FIG. 3 is a perspective view of an image forming apparatus according to an embodiment of the present invention.

As shown in FIG. 3, the operator or user opens a door 109 provided in the main assembly A of the apparatus. The cartridge B is demountably mounted to cartridge mounting means 130 provided in the main assembly A of the apparatus.

Figure 4:
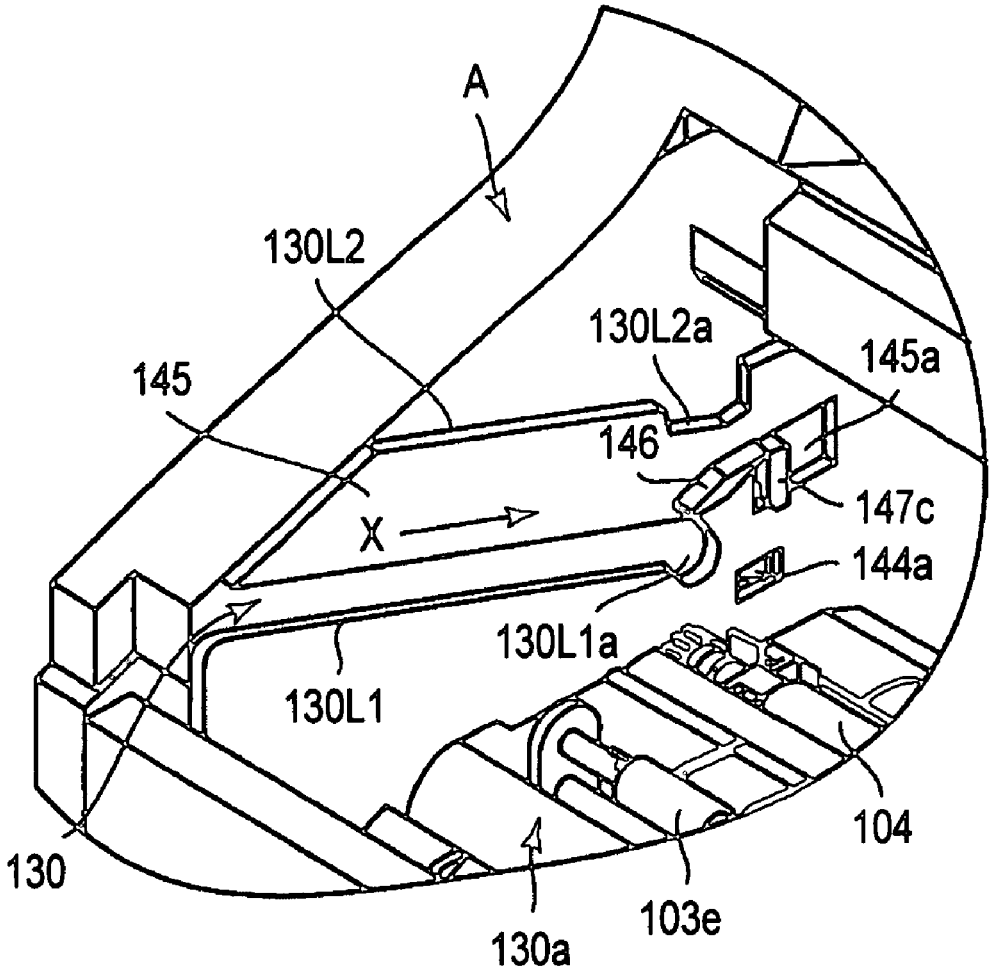
FIG. 4 is a perspective view of a mounting portion of the main assembly of the apparatus to accept the process cartridge according to the embodiment of the present invention.
Figure 5:
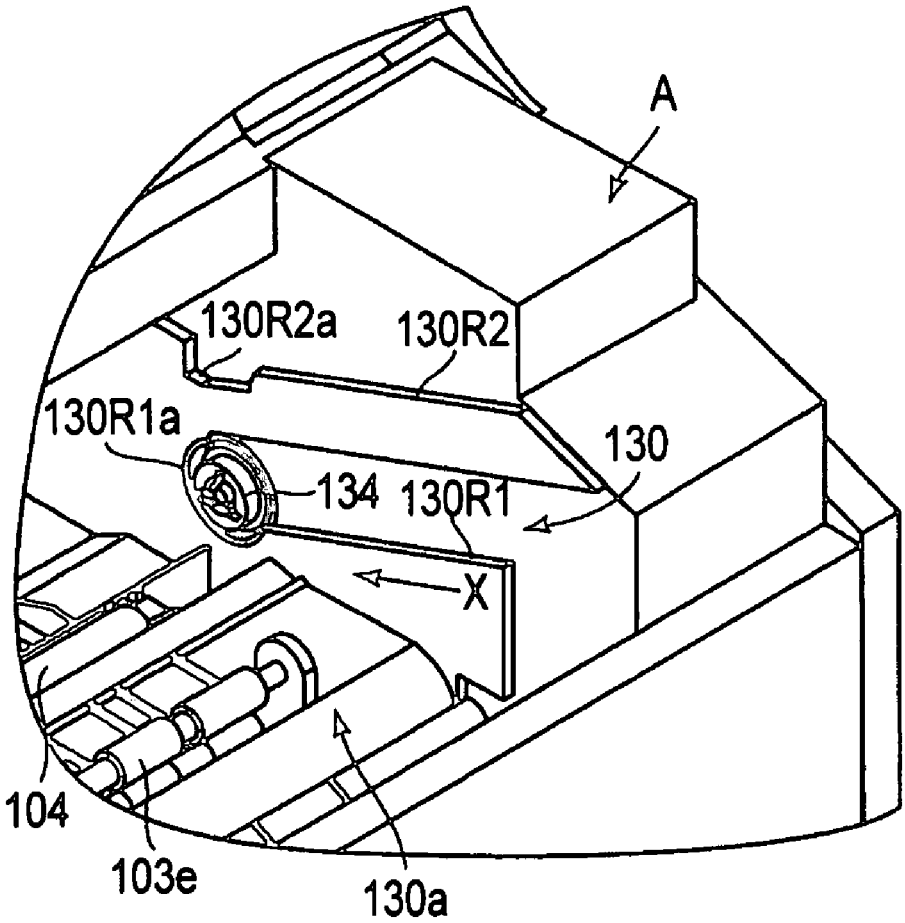
FIG. 5 is a perspective view of a mounting portion of the main assembly of the apparatus to accept the process cartridge according to the embodiment of the present invention.

As shown in FIGS. 4 and 5, the mounting means 130 of this embodiment includes main assembly guides 130R1, 130R2, 130L1, 130L2 in the main assembly A of the apparatus. When the cartridge B is mounted to the main assembly A of the apparatus, it is inserted toward the cartridge mounting portion 130*a* such that cartridge guides 140R1, 140R2 (FIG. 6) are guided by the main assembly guides 130R1, 130R2, and the cartridge guides 140L1, 140L2 (FIG. 7) are guided by the main assembly guides 130L1, 130L2.

The cartridge guide 140R1 is engaged with the positioning portion 130R1*a* of the main assembly guide 130R1, and the cartridge guide 140R2 is seated on the positioning portion 130R2*a* of the main assembly guide 130R2. The cartridge guide 140L1 is engaged with the positioning portion 130L1*a* of the main assembly guide 130L1, and the cartridge guide 140L2 is seated on the positioning portion 130L2*a* of the main assembly guide 130L2. At this time, the cartridge B is demountably mounted to the cartridge mounting portion 130*a* by the mounting means 130. By the cartridge B mounted in place in the cartridge mounting portion 130*a*, the image forming operation is enabled. Here, the cartridge mounting portion 130*a* is the space occupied by the cartridge B which is mounted in place to the main assembly A of the apparatus by the mounting means 130.

When the cartridge B is mounted, a coupling 134 (FIG. 5) functioning as a driving force transmitting portion is at a retracted position, so that it does not interfere with the cartridge B which is being inserted for mounting. When the cover 109 is closed, the coupling 134 provided in the main assembly A of the apparatus is brought into engagement with a coupling 107*a* (FIG. 6) of the cartridge B functioning as a driving force receiving portion.

Figure 10:
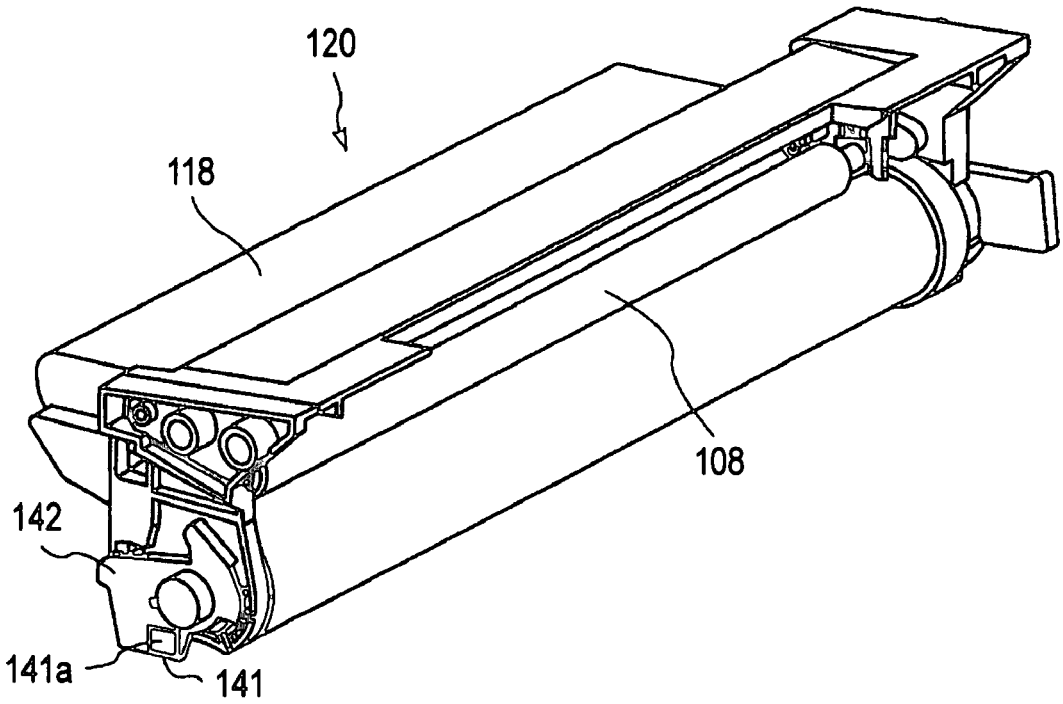
FIG. 10 is a perspective view of the structure of a drum unit of a process cartridge according to an embodiment of the present invention.

(3) Charging Contact Member:

As shown in FIG. 10, the drum unit 120 is provided with an input contact member, i.e., a cartridge movable charging contact member 141 for receiving a charging bias voltage to be applied to the charging roller 108 from main assembly of the apparatus A. The charging contact member 141 is mounted on a cartridge operation member 142 (movable operation member) provided on the cartridge B. The charging contact member 141 includes an electrical contact 141*a*, which is a part of the charging contact member 141, provided on a side surface of the operation member 142 to electrically connect to an output contact member, i.e., main assembly charging contact 144*a*, provided in the main assembly of the apparatus A. The structures of the operation member 142 and the main assembly charging electrical contact 144*a* will be described.

The other end portion 141*b* ((c) of FIG. 12) of the contact member 141 is contacted to an electrical contact 150*a* of the cartridge fixed charging contact member 150 provided on a drum frame 118 by operation of the operation member 142 ((b) of FIG. 13), which will be described hereinafter in detail. By doing so, the contact member 141 is electrically connected with the charging roller 108 in the drum unit 120.

Figure 11:
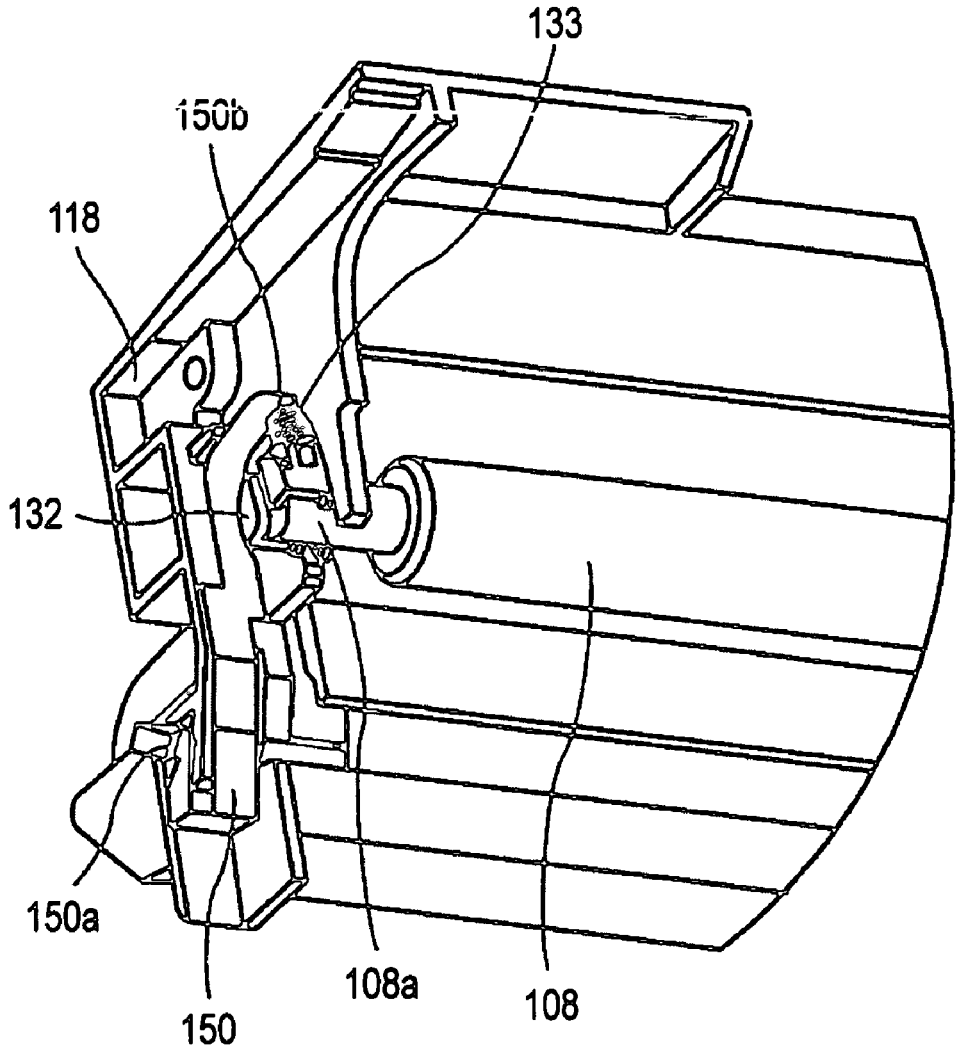
FIG. 11 is a perspective view of the structure of a drum unit of a process cartridge according to an embodiment of the present invention.

FIG. 11 is a perspective view wherein a side of the drum frame 118 has been removed so that inside of the drum frame 118 can be seen. As shown in this figure, the charging roller 108 has a metal shaft 108*a* which is rotatably supported by charging roller bearings 132 molded from electroconductive resin material. The charging roller 108 is mounted in the drum frame 118. Between the bearing 132 and the drum frame 118, there is provided a charging roller pressing spring (metal spring) 133. By the elastic force of the spring 133, the charging roller 108 is urged to the photosensitive drum 107 (unshown in FIG. 11) with a predetermined force. The cartridge fixed charging contact member 150 is provided in the drum frame 118. The contact member 150 includes an electrical contact 150*a* for electrical contact with the electrical contact 141*b* provided on the operation member 142, and an electrical contact 150*b* for electrical contact with the spring 133. The contact member 150 is made of an integral metal plate. The contact member 150 is fixed on the drum frame 118.

Figure 12:
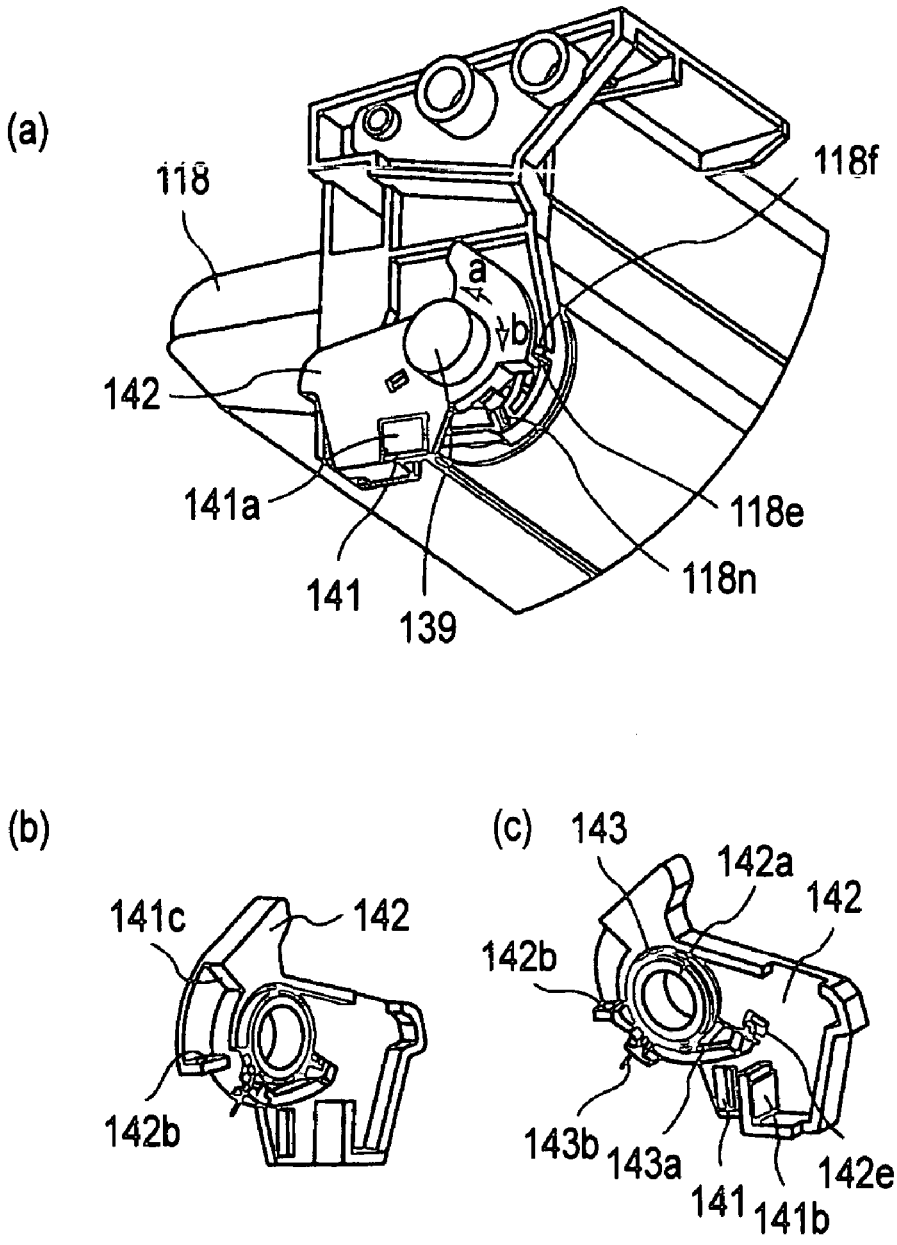
FIGS. 12(*a*)–12(*c*) are perspective views of the structure of a movable operation member of the process cartridge according to the embodiment of the present invention.

(4) Cartridge Operation Member:

Referring to FIGS. 12, (*a*), (*b*) and (*c*), a description will be provided as to the structure of a movable operation member, i.e. cartridge operation member 142, mounted on the cartridge B.

As shown in the figures, the operation member 142 is rotatably provided on a side opposite from a side where the coupling 107*a* (FIG. 6) (driving force receiving portion) is provided, with respect to the longitudinal direction of the cartridge B which is also the longitudinal direction of the photosensitive drum 107 in this embodiment. The coupling 107*a* functions to receive a driving force from main assembly of the apparatus A when the cartridge B is mounted to the main assembly of the apparatus A.

The operation member 142 rotatably supported on the side surface of the drum frame 118 coaxially with the axis of the photosensitive drum 107. The operation member 142 has a twisting coil spring 143 (elastic function member) in a cylindrical portion 142*a*. One arm portion 143*a* thereof is hooked on a locking portion 142*e*. The other arm portion 143*b* is mounted in a groove 118*n* formed in a side surface of the drum frame 118. By doing so, the operation member 142 is normally urged in a direction of an arrow a by the elastic force of the spring 143. The operation member 142 thus urged by the spring 143, abuts the abutting portion 118*e* at the abutting portion 142*b*. By this, the operation member 142 is positioned in the rotational direction. When the operation member 142 rotates in the direction indicated by an arrow b, it is rotatable to an extent that abutting portion 142*c* abuts to the abutting portion 118*f*. The operation member 142 is provided with the contact member 141. The contact member 141 has an electrical contact 141*a* and an electrical contact 141*b*. The contact member 141 is operable integrally with the operation member 142. The abutting portion 142*b* and the abutting portion 142*c* are provided on the operation member 142. The abutting portion 118*e* and the abutting portion 118*f* are provided on the drum frame 118. The electrical contact 141*a* is contacted to the electrical contact 144*a*, and the electrical contact 141*b* is contacted to the electrical contact 150*a*.

Figure 13:
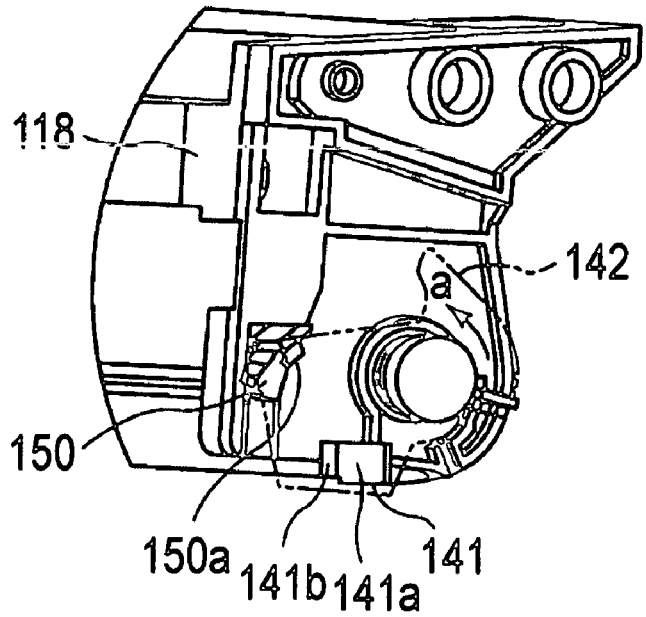
FIGS. 13(*a*) and 13(*b*) are perspective views of the structure of a movable operation member of the process cartridge according to the embodiment of the present invention.
Figure 13:
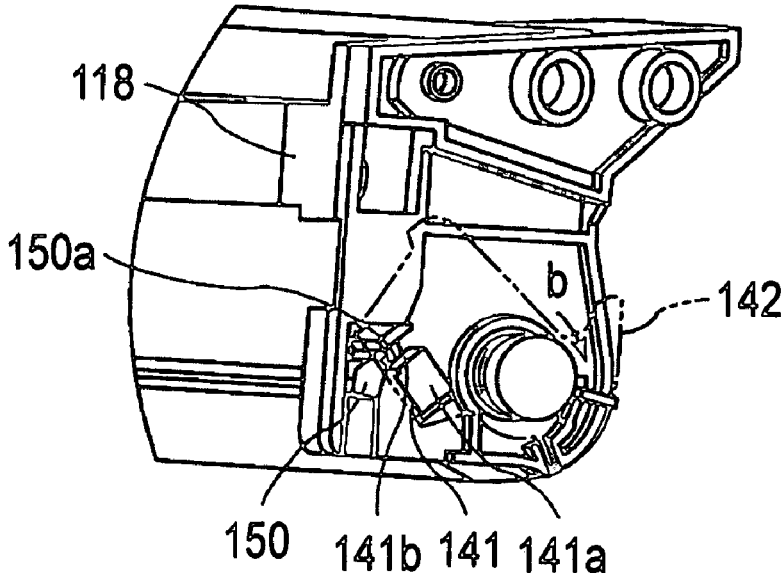

In FIGS. 13, (a) and (b), the operation member 142 is shown only in the outer shape thereof to show the positional relation between the contact member 141 and the contact member 150.

The operation member 142 is provided with the contact member 141. The contact member 141 is integrally fixed so that at least the electrical contact 141*a* is exposed. In other words, the contact member 141 is mounted on the operation member 142 in the manner that at least the electrical contact 141*a* is outwardly exposed to permit contact with the electrical contact 144*a*. The contact member 150 is fixed on the drum frame 118. The contact member 141 has an electrical contact 141*b*. The contact member 150 has an electrical contact 150*a*.

As shown in (a) of FIG. 13, when the operation member 142 rotates in the direction indicated by arrow a, the electrical contact 150*a* is spaced from the electrical contact 141*b*, and therefore, the contact member 141 and the contact member 150 are not electrically connected to each other. As shown in (b) of FIG. 13, when the operation member 142 rotates in the direction of an arrow b, the contact member 141 rotates with the operation member 142. By doing so, the electrical contact 150*a* and the electrical contact 141*b* are brought into contact with each other. Thus, an electrical connection is established between the contact member 141 and the contact member 150. The position in which the contact member 141 is electrically connectable which is the contact member 150 is also the position in which the electrical contact 141*a* is contactable with the electrical contact 144*a*. In other words, at the position with which the electrical contact 150*a* and the electrical contact 141*b* are contacted with each other, the electrical contact 141*a* and the electrical contact 144*a* are also contacted with each other.

The rotating operation of the operation member 142 will be described in detail hereinafter.

(5) Charging Contact Member of Main Assembly of Apparatus A:

A description will be provided as to the main assembly charging electrical contact member which is the output contact member provided in the main assembly of the apparatus A.

Figure 14:
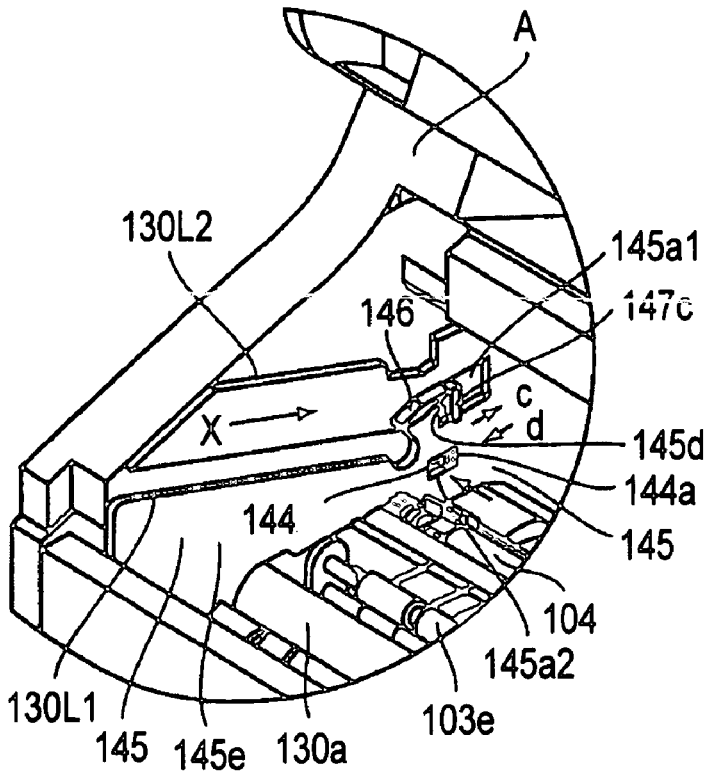
FIGS. 14(*a*) and 14(*b*) are perspective views of the structure of an electrical contact portion provided in the main assembly of the image forming apparatus according to the embodiment of the present invention.
Figure 14:
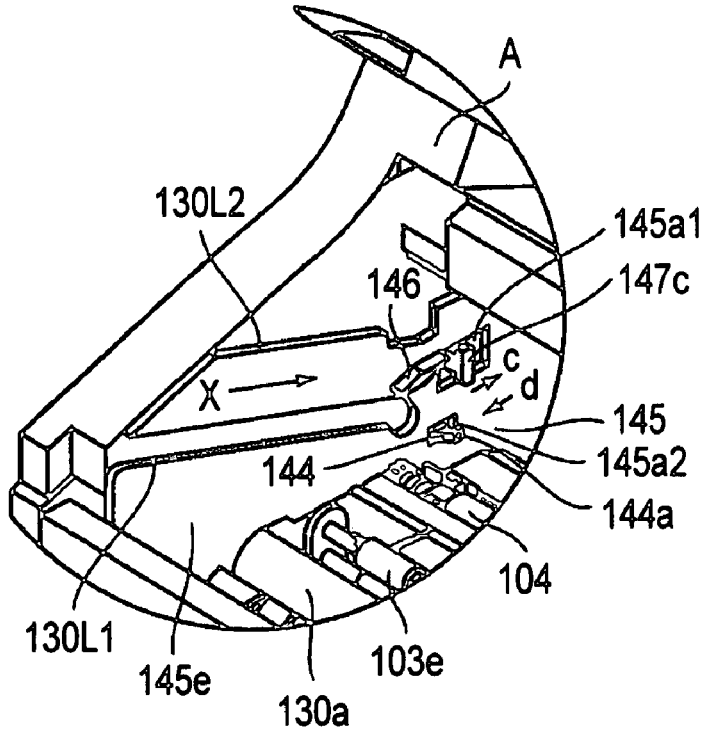

As shown in FIGS. 14, (a) and (b), the electrical contact 144*a* is provided on an inner side surface of the main assembly of the apparatus A. The electrical contact 144*a* is contactable with the electrical contact 141*a* to apply the charging bias voltage to the charging roller 108 from the main assembly of the apparatus A. The electrical contact 141*a* is a part of the cartridge movable charging electrical contact member 141 (input electrical contact member) provided in the cartridge B. The electrical contact 144*a* is a part of the main assembly charging electrical contact member 144. When the cartridge B is not mounted in the main assembly of the apparatus A, the contact 144*a* is retracted to a retracted position so as not to project beyond the inner side plate 145 of the main assembly of the apparatus A. The contact member 144 is connected with a high voltage electric circuit (voltage source circuit E) provided in the main assembly of the apparatus A through a lead wire or the like.

In the main assembly of the apparatus A, there is provided a fixed engageable member (fixed member) 146 functioning an abutting portion so as to project beyond the inner side plate 145. The engageable member 146 functions to rotate the operation member 142 in interrelation with insertion of the cartridge B into the main assembly of the apparatus A. The engageable member 146 is fixed on the inner side plate 145. Downstream of the engageable member 146 with respect to the inserting direction of the cartridge B, one end portion 147*c* of the displaceable member 147 (FIG. 16) is projected. The engaging portion 147*c* is movable in the directions of arrows c, d in interrelation with mounting and demounting of the cartridge B. As shown in (b) of FIG. 14, when the cartridge B is mounted to the main assembly of the apparatus A, the engaging portion 147*c* is pushed by the operation member 142 in the direction of an arrow (c). In interrelation with the operation of the displaceable member 147, the contact 144*a* projects through the opening 145*a*2 formed in the inner side plate 145. More particularly, the contact 144*a* projects to the mounting portion 130*a*. By doing so, the contact 144*a* is contacted to the contact 141*a*. Thus, the contact 144*a* disposed at the retracted position outside the inner side plate 145 rotationally comes to the electrical connection position inside the inner side plate 145.

By this, supply of the charging bias voltage to the charging roller 108 from the main assembly of the apparatus A is enabled. When the operation member 142 rotates, the contact 144*a* also rotates in a different direction. These contacts are brought into contact with each other while moving. The contacts make slight relative motion even after they are contacted. In this manner, the contact 141*a* rubs the surface of the contact 144*a*. Therefore, the surface of the contact 141*a* and the surface of the contact 144*a* rub each other. By doing so, the foreign matter, developer or the like deposited on the surfaces can be removed. Thus, the reliability of the electrical connection between the contact 141*a* and the contact 144*a* is improved.

Figure 15:
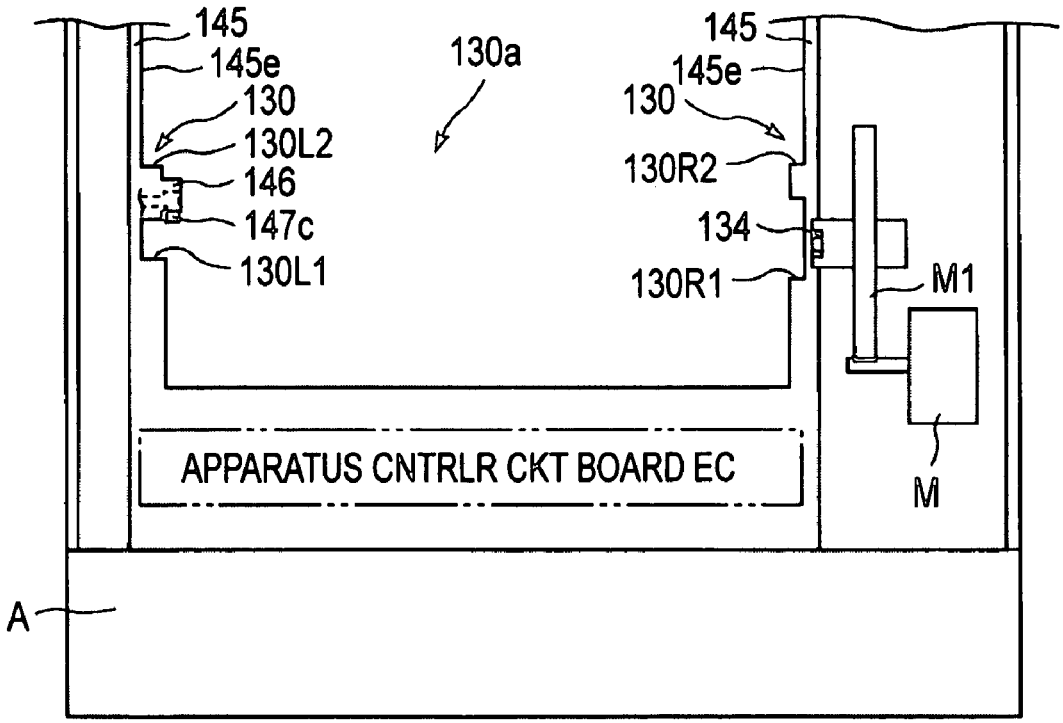
FIG. 15 illustrates a schematic front view of the structure of a mounting portion provided in the main assembly of the image forming apparatus according to the embodiment of the present invention.
Figure 16:
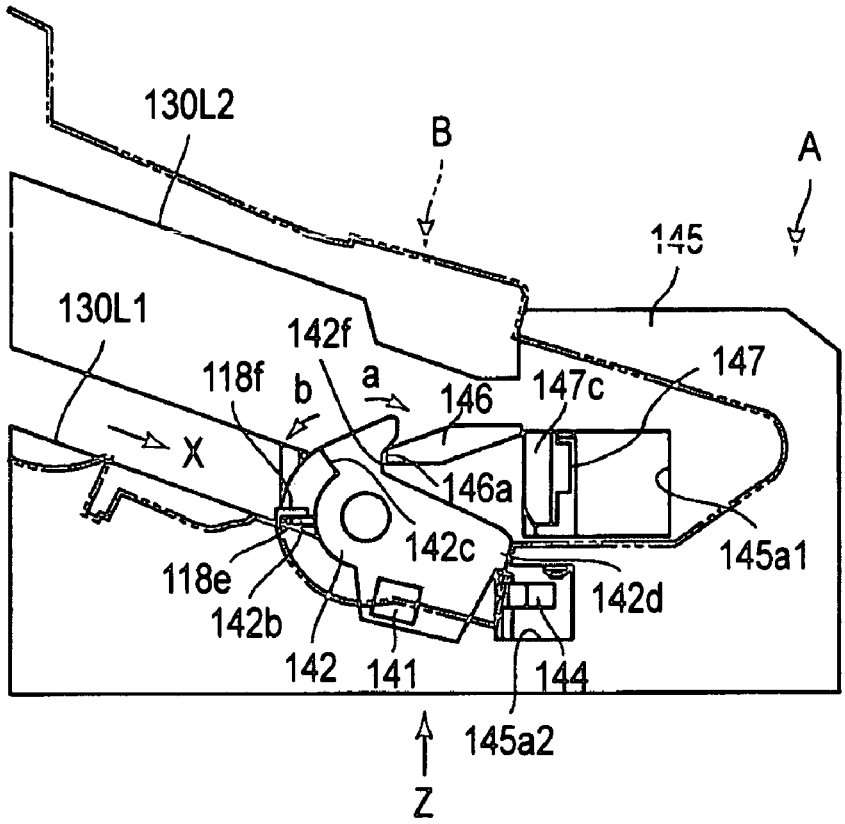
FIGS. 16(*a*) and 16(*b*) are schematic side and top views respectively, of the structures of the movable operation member and the electrical contact of the image forming apparatus according to the embodiment of the present invention.
Figure 16:
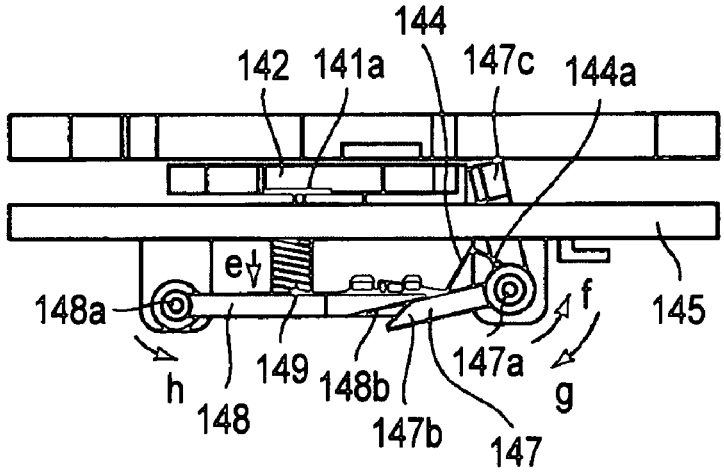

(6) Inner Structure of Main Assembly of Apparatus A:

Referring to FIG. 16, a description will be provided as to the internal structure of the main assembly A of the apparatus. FIG. 15 is a front view of the inside of the main assembly A of the apparatus as seen from the front side D, that is, in the direction of mounting the cartridge B (FIG. 3).

Figure 19:
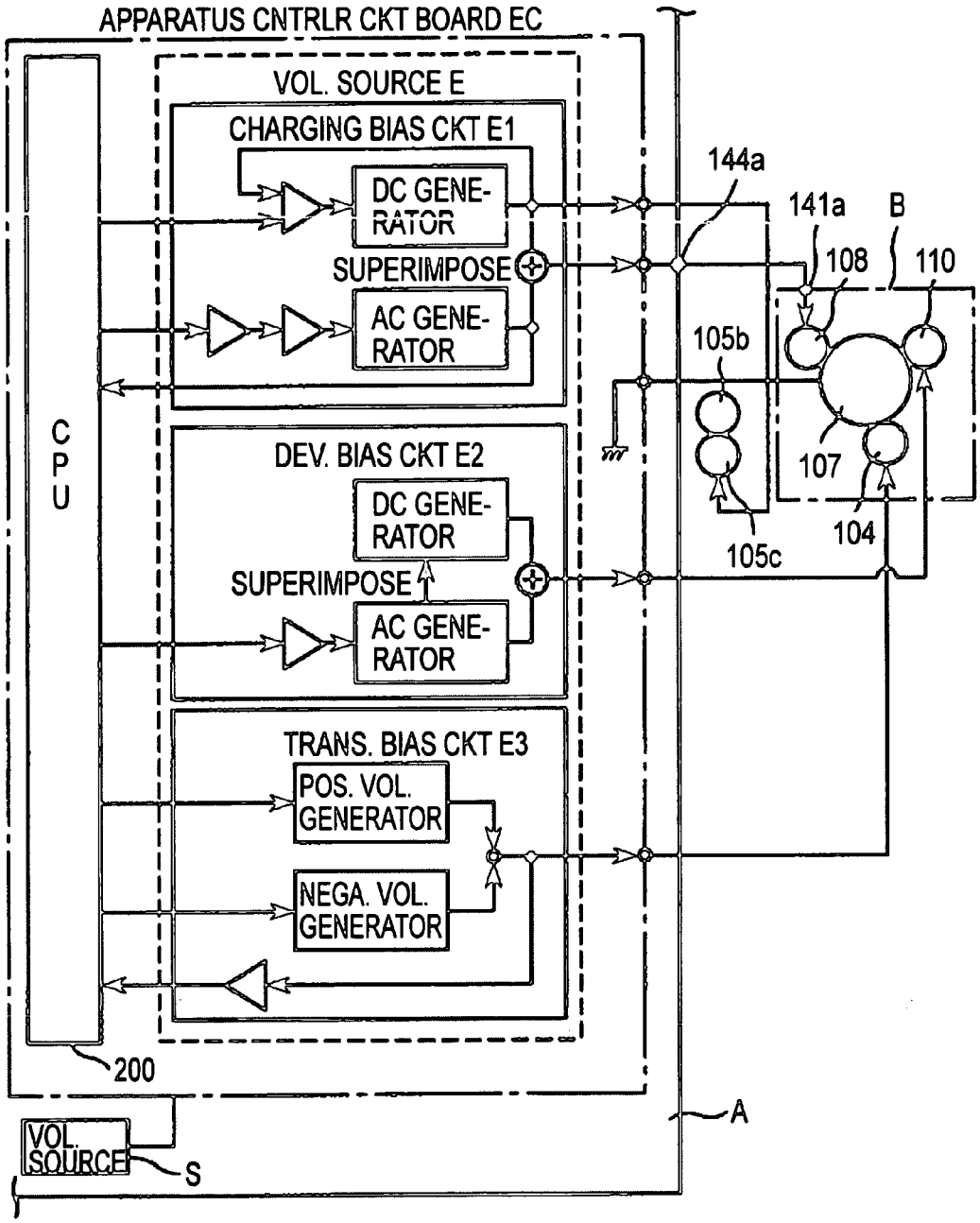
FIG. 19 illustrates a schematic block diagram of the structure of a circuit board in the image forming apparatus according to the embodiment of the present invention.

At the bottom surface of the main assembly of the apparatus A, that is, below the cartridge mounting portion 130*a* there is provided an apparatus controller circuit board EC (FIG. 19). At one lateral side of the mounting portion 130*a* with respect to the mounting direction, there is disposed a motor M and a driving gear train (driving force transmitting means) M1 for transmitting the driving force from the motor M to the coupling 134 or the like, outside the inside side surface 145*e* of the inner side plate 145.

At the opposite lateral side of the mounting portion 130*a*, the displaceable engaging portion 147*c* is disposed downstream of the engageable member (fixed member) 146 with respect to the inserting direction X of the cartridge B relative to the main assembly A of the apparatus. In addition, at least a part of the engaging portion 147*c* is overlapped with the fixed engageable member 146 as seen in the inserting direction X. In other words, a part of the engaging portion 147*c* is behind the fixed engageable member 146 as seen in the inserting direction X. More particularly, the displaceable member 147 is provided with the displaceable engaging portion 147*c*. An engageable member 146 (fixed member) is fixed in the main assembly of the apparatus A, and the engaging portion 147*c* is disposed downstream of the engageable member (fixed member) with respect to the inserting direction X of the cartridge B. In addition, at least a part of the engaging portion 147*c* is overlaid with respect to the inserting direction X.

For this reason, even if the operator inserts his or her hand from the front side D into the main assembly A of the apparatus for the purpose of maintenance (jam clearance operation or the like) after the cartridge B is dismounted, the hand is blocked by the engageable member 146. Therefore, the engaging portion 147*c* is effectively protected from inadvertently being accessed by the operator. The output contact 144*a* (not shown in FIG. 15) placed in the retracted position is prevented from moving unintentionally to the electrical connection position.

(7) Operations of Movable Member and Charging Contact Member:

A description will be provided as to the operations of the operation member (movable member operation member) 142 and the main assembly charging contact member 144.

FIGS. 16(*a*), 17(*a*), and 18(*a*) are views of the inner side plate 145 of the main assembly of the apparatus A as seen from an inside of the main assembly of the apparatus (in the direction of the arrow Y in FIG. 14). FIGS. 16(*b*), 17(*b*), and 18(*b*) are the views as seen in the direction of arrow Z in FIG. 16(*a*), FIG. 17(*a*) and FIG. 18(*a*).

As shown in these figures, a displaceable member 147 is mounted on an outside of an inner side plate 145 for rotation about a shaft portion 147*a*. The contact member 144 is mounted on the contact supporting member 148. The supporting member 148 is mounted on the inner side plate 145 for rotation about the shaft portion 148*a*. The supporting member 148 is urged in the direction of an arrow e by the elastic force of the compression spring 149 (elastic function member). The displaceable member 147 and the supporting member 148 are abutted to each other at the abutting portion 147*b* and the abutting portion 148*b*. Therefore, the displaceable member 147 and the supporting member 148 are interrelated with each other.

When the supporting member 148 is urged in the direction of an arrow e, the displaceable member 147 rotates in the direction of an arrow f. The abutting portion (unshown) of the displaceable member 147 abuts to an edge of an opening 145*a*1 of the inner side plate 145. By this, the displaceable member 147 is correctly positioned. At this time, the contact 144*a* is positioned at the retracted position which is retracted from the electrical connection position relative to the cartridge B and at which the contact 144*a* is not projected beyond the main assembly of the apparatus A of the inner side plate 145.

FIGS. 16(*a*) and (*b*) illustrate the states in the process of inserting the cartridge B into the main assembly A of the apparatus. The cartridge B is inserted in the direction of an arrow X along the main assembly guides 130L1, 130L2. FIGS. 16(*a*) and 16(*b*) show a state in which the cartridge B is inserted to the position immediately before the operation member 142 is contacted to the engageable member 146.

As described hereinbefore, at the position of FIGS. 16(*a*) and 16(*b*), the operation member 142 is urged in the direction of an arrow a by the elastic force of the spring 143. The operation member 142 is at rest at a position with which the abutting portion 142*b* and the abutting portion 118*e* are abutted to each other. The contact 144*a*, as described hereinbefore, is at the retracted position in which it does not project beyond the inner side plate 145.

Figure 17:
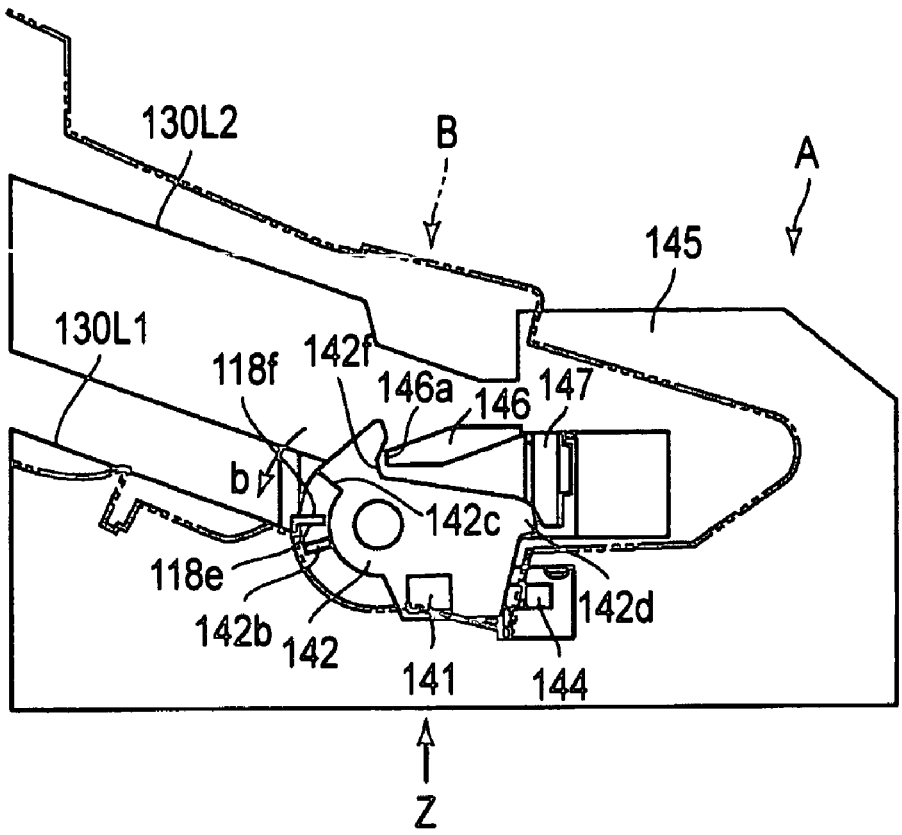
FIGS. 17(*a*) and 17(*b*) are schematic side and top views, respectively, of the structures of the movable operation member and the electrical contact of the image forming apparatus according to the embodiment of the present invention.
Figure 17:
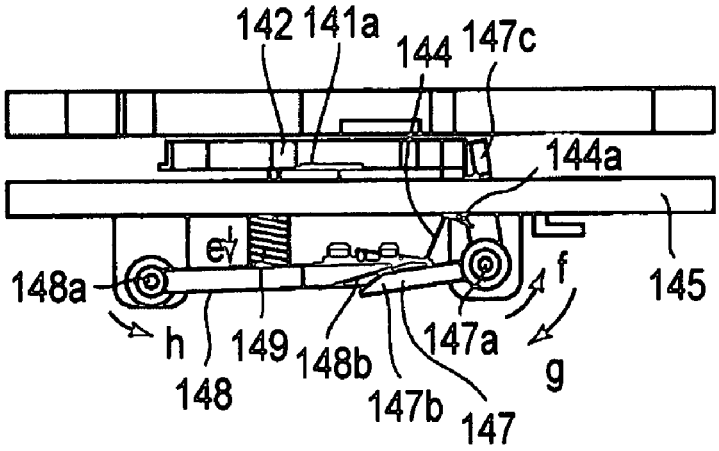

FIGS. 17(*a*) and 17(*b*) show a state in which the cartridge B is inserted further from the position of FIGS. 16(*a*) and 16(*b*). In the position shown in FIGS. 17(*a*) and 17(*b*), a first engaging portion 142*f* provided on the operation member 142 is abutted to the contact portion 146*a* provided in the engageable member 146. By this, the operation member 142 rotates in the direction of an arrow b. And, the abutting portion 142*b* and the abutting portion 118*e* are separated from each other. A second engaging portion 142*d* provided on the operation member 142 pushes the displaceable member 147. Therefore, the displaceable member 147 rotates in the direction of an arrow g. This rotates the supporting member 148 in the direction of an arrow u. The contact member 144 moves toward inside of the main assembly of the apparatus A out of the inner side plate 145.

Figure 18:
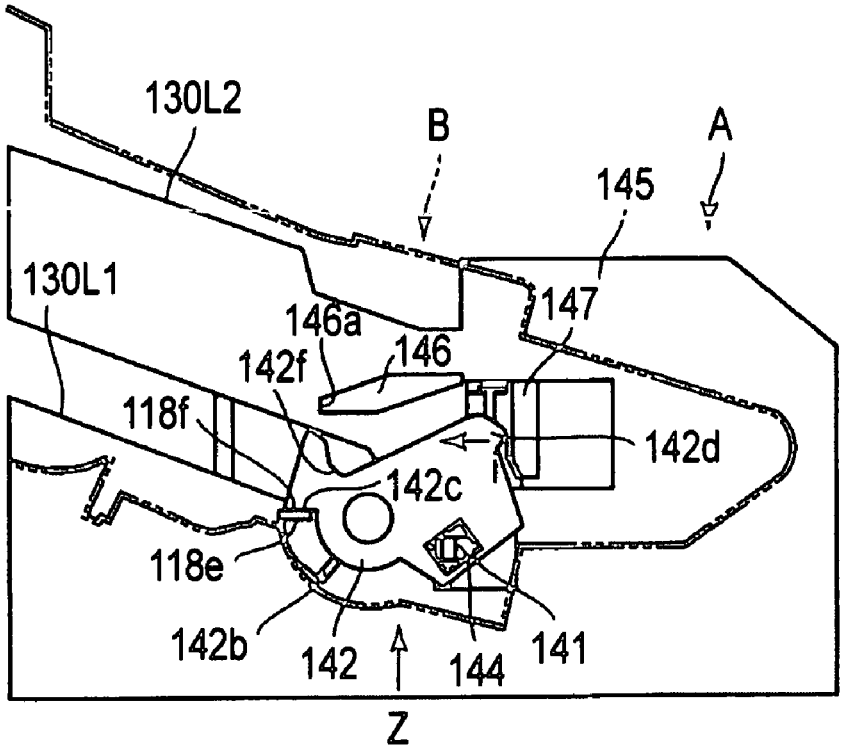
FIGS. 18(*a*) and 18(*b*) are schematic side and top views, respectively, of the structures of the movable operation member and the electrical contact of the image forming apparatus according to the embodiment of the present invention.
Figure 18:
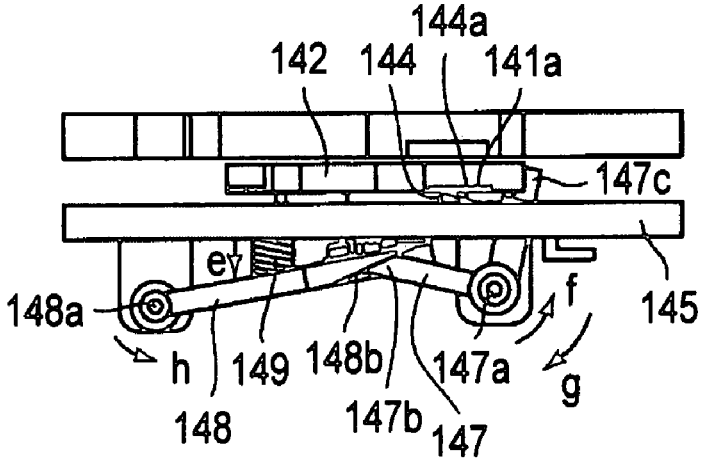

FIGS. 18(*a*) and 18(*b*) show a state in which the cartridge B is further inserted until the cartridge B is completely mounted to the main assembly of the apparatus A (mounting portion 130*a*). The second engaging portion 142*d* of the operation member 142 rotates the displaceable member 147 in the direction of an arrow g. In interrelation therewith, the contact 144*a* is projected beyond the inner side plate 145. The contact 144*a* is contacted to the contact 141*a*. At this time, the operation member 142 is away from the engageable member 146. The operation member 142 receives a reaction force from the displaceable member 147 in the direction of an arrow i. The operation member 142 is set at the position where the abutting portion 142*c* and the abutting portion 118*f* are abuted to each other. At this time, the positional relation between the contact member 141 and the electrode member 150 is such that the electrical contact 141*b* and the electrical contact 150*a* are contacted to each other.

As described hereinbefore, the operation member 142 is movable relative to the drum frame 118 (cartridge frame). When the cartridge B is inserted into the main assembly of the apparatus A, the operation member 142 is engaged with the fixed engageable member 146 fixed in the main assembly of the apparatus A to move relative to the drum frame 118. After the operation member 142 is engaged with the fixed engageable member 146, the operation member 142 is engaged with the displaceable engaging portion 147C of the displaceable member 147 to move the displaceable member 147. In interrelation with the movement of the displaceable member 147, the main assembly charging electrical contact 144*a* (output contact) is moved against the elastic force of the compression spring 149 (elastic function member). The main assembly of the apparatus A has the electrical contact (output contact) 144*a* which is movable between an electrical connection position and a retracted position retracted from the electrical connection position. The main assembly of the apparatus A further includes a displaceable member 147 for moving the electrical contact 144*a* and a compression spring 149 for elastically urging the displaceable member 147 to move the electrical 144*a* from the electrical connection position to the retracted position.

As described in the foregoing, in this embodiment, when the cartridge B is inserted into the main assembly of the apparatus A, the electrical contact 144*a* is projected into the inside of the main assembly of the apparatus A by the operations of the operation member 142, the displaceable member 147 and the supporting member 148. And, it is contacted to the electrical contact 141*a* provided on the operation member 142. A voltage is supplied from the voltage source S to the charging roller 108 through the electrical contact 144*a*, the electrical contact 141*a*, the electrical contact 141*b* and the electrical contact 150*a* by a control operation of the CPU 200 (FIG. 19).

Thus, the contact 141*a* is contacted to the contact 144*a* now placed at the electrical connection position to receive the voltage for operating the charging roller 108 (process means).

By this, the charging roller 108 can receive the charging bias from the main assembly of the apparatus A.

By this, supply of the charging bias voltage to the charging roller 108 from the main assembly of the apparatus A is enabled. When the operation member 142 rotates, the contact 144*a* also rotates in a different direction. These contacts are brought into contact with each other while moving. The contacts make relative motion even after they are contacted. In this manner, the contact 141*a* rubs the surface of the contact 144*a*. Therefore, the surface of the contact 141*a* and the surface of the contact 144*a* rub each other. By doing so, foreign matter, developer or the like deposited on the surfaces can be removed. Thus, the reliability of the electrical connection between the contact 141*a* and the contact 144*a* is improved.

In this embodiment, a contact member 141 is provided on a part of the operation member 142 to constitute the contact portion. However, most of or the entirety of the operation member 142 may be made of an electroconductive material.

(8) Apparatus Controller Circuit Board (Voltage Source Circuit).

Referring to FIG. 19, a description will be provided as to the engine controller circuit board EC provided in the main assembly of the apparatus A, usable with the present invention. The circuit board EC is disposed below the cartridge mounting portion 130*a*. The circuit board EC comprises the CPU 200 and the electric circuit E.

The circuit board EC comprises the CPU 200 and the electric circuit E (voltage source circuit). The electric circuit E is constituted by a charging bias circuit E1, a developing bias circuit E2 and a transfer/charging bias circuit E3.

The charging bias circuit E1 generates a negative DC voltage and an AC voltage. It applies a voltage in the form of a sum of these voltages to the charging roller 108. The charging roller 108 which receives the voltage and charges the photosensitive drum 107.

The charging bias circuit E1 applies the negative DC voltage also to the fixing roller 105*b* through a driving roller 105*c*. The developing bias circuit E2 generates a negative DC voltage and an AC voltage. The developing roller 110 is supplied with a voltage in the form of a sum of these voltages. The developing roller 110 receives the voltage to develop the electrostatic latent image with the developer. The transfer bias circuit E3 generates a positive or negative DC voltage. It applies the positive or negative DC voltage to the transfer roller 104.

Thus, the charging roller 108 is supplied with the voltage from the voltage source S through the charging bias circuit E1. The fixing roller 105*b* and the driving roller 105*c* are supplied with the voltage from the voltage source S through the charging bias circuit E1. The developing roller 110 is supplied with the voltage from the voltage source S through the developing bias circuit E2. The transfer roller 104 is supplied with the voltage from the voltage source S through the transfer/charging bias circuit E3.

These circuits E1, E2, E3 are on-off-controlled or subjected to the controls in response to instructions from the CPU 200 provided on the circuit board EC.

As described in the foregoing, this embodiment provides the following advantageous effects.

(1) Even when the operator inserts his hand into the main assembly of the apparatus A for the purpose of jam clearance or the like with the process cartridge being out of the main assembly of the image forming apparatus, the main assembly charging contact does not project beyond the side surface. Therefore, the operator is prevented from easily touching the contact 144*a*. At least a part of the displaceable member 147 for projecting the contact 144*a* is disposed behind the engageable member. Therefore, the operator is effectively prevented from touching the displaceable member. By this, the contact member 144 of the main assembly of the apparatus is protected from the application of electrostatic noise. Thus, the elements of the electric circuit in the main assembly of the apparatus are protected from damage. In addition, the contact is protected from sweat of the user or grease, so that a conduction defect can be prevented beforehand.

(2) The movement of the cartridge operation member is interrelated with the mounting and demounting operation of the cartridge. Therefore, there is no need for a special operation to contact the contacts with each other.

(3) The contact member is disposed opposite the driving side. Therefore, the space in the main assembly of the image forming apparatus can be efficiently used. Accordingly, the apparatus can be downsized.

(4) The electrical contact of the cartridge B is disposed below the cartridge B. This improves the assembling property. In such a case, the operation member 142 can be moved upwardly. With this structure, the operation member 142 does not project toward the main assembly side of the apparatus. By this, the main assembly of the apparatus can be downsized.

(5) The operation member 142 is urged by an elastic force of the elastic function member. Therefore, when the cartridge B is inserted into the main assembly of the apparatus A, the operation member is moved against the elastic force. This is effective to suppress any impact upon insertion of the cartridge B into the main assembly of the apparatus A. Thus, the generation of large vibration of the main assembly of the apparatus or of the cartridge can be avoided. In addition, the toner leakage can be prevented. Furthermore, the impact upon the abutment of the electrical contact of the cartridge to the electrical contact of the main assembly can be suppressed.

(6) The operation member is rotatable about an axis which is coaxial with the rotational axis of the photosensitive drum. By doing so, it is not necessary to use an additional rotation shaft, and therefore, the cartridge can be downsized. Since the operation member is provided on the side surface of the cartridge, the assembling property is improved.

(7) By this, the supply of the charging bias voltage to the charging roller 108 from the main assembly of the apparatus A is enabled. When the operation member 142 rotates, the contact 144*a* also rotates in a different direction. These contacts are brought into contact with each other while moving. The contacts make slight relative motion even after they are contacted. In this manner, the contact 141*a* rubs the surface of the contact 144*a*. Therefore, the surface of the contact 141*a* and the surface of the contact 144*a* rub each other. By doing so, foreign matter, developer or the like deposited on the surfaces can be removed. Thus, the reliability of the electrical connection between the contact 141*a* and the contact 144*a* is improved.

In the foregoing embodiments, when the cartridge B is mounted to the main assembly of the apparatus A, the charging member, more particularly, the charging roller 107 (process means) receives the voltage from the main assembly of the apparatus 100 through the charging output contact 144*a* as the output contact and the charging input electrical contact 141*a* as the input electrical contact.

However, the present invention is not limited to such a structure. In an alternative, using structures similar to those described in the foregoing, when the cartridge B is mounted to the main assembly of the apparatus A, the developing roller 110 receives the voltage from the main assembly of the apparatus 100. In such a case, the developing roller 110 receives the voltage from the main assembly of the apparatus 100 through a development output contact (unshown) as the development output contact and the development input electrical contact (unshown) as the input electrical contact. In a further alternative, voltages may be supplied to the charging roller 108 and to the developing roller 110. Thus, the process means is enabled. By such a voltage supply system, the process means is enabled.

Therefore, the following embodiments will be described with respect to the charging roller 108 and/or developing roller 110, but the present invention is not limited to such examples. The present invention is applicable to voltage supply from the main assembly of the apparatus 100 to another process means such as the developing roller 110.

Embodiment 2

Referring to FIG. 20–FIG. 27, the second embodiment will be described.

The cartridge B and the image forming apparatus 100 have substantially the same structures as Embodiment 1. The same reference numerals as in Embodiments 1 and 2 are assigned to the elements having the corresponding functions in this embodiment, and the detailed description thereof is omitted for simplicity.

(1) Movable Operation Member of Cartridge B.

Figure 20:
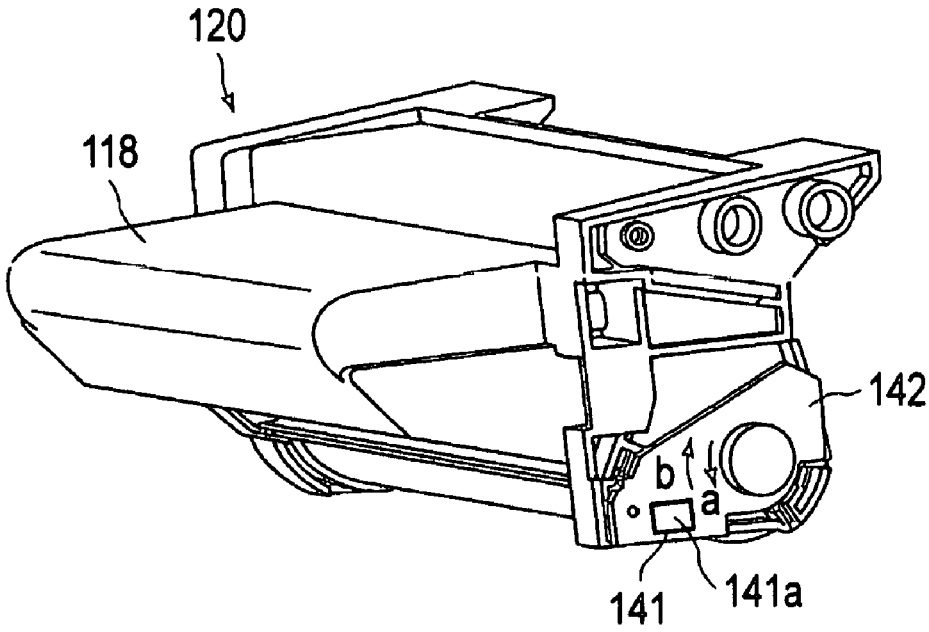
FIG. 20 is a perspective view of the structure of the drum unit in the embodiment of the present invention.
Figure 21:
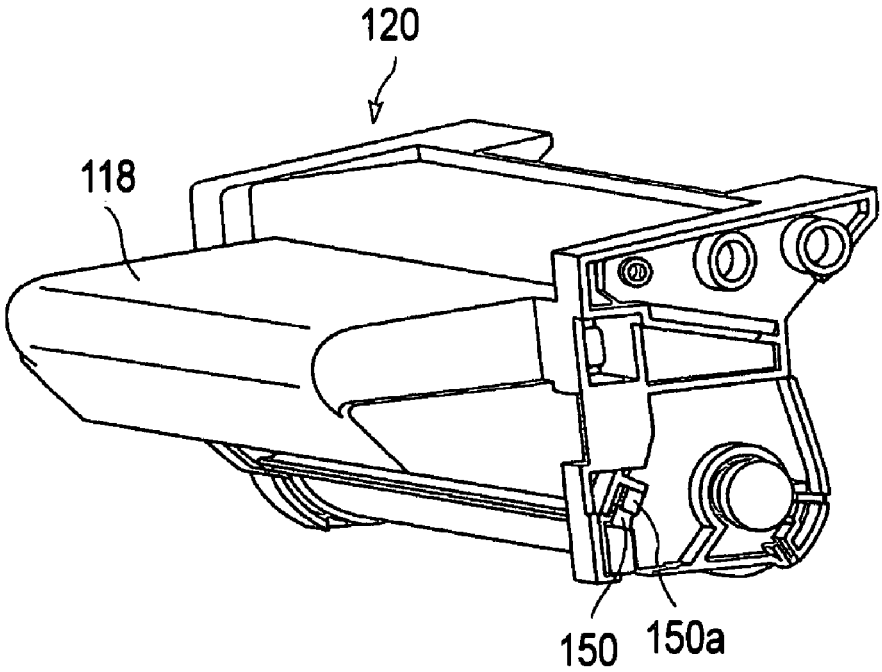
FIG. 21 is a perspective view of the structure of the drum unit in the embodiment of the present invention.

FIGS. 20 and 21 are perspective views of a front portion of the cartridge B according to this embodiment of the present invention, with respect to a mounting direction in which the cartridge B is mounted to the main assembly of the apparatus A. They also illustrate a drum unit 120 of the cartridge B.

In this embodiment, the cartridge B comprises a drum unit 120 and a developing unit 119, which are rotatably coupled with each other.

As shown in FIG. 20, a side surface of the operation member 142 is provided a contact member 141 which is fixed to the side surface and which is exposed. The contact member 141 is fixed on the operation member 142, and the contact 141*a* thereof is exposed.

As shown in FIG. 21, the drum frame (cartridge frame) 118 is provided with a cartridge fixed charging contact member 150. Similarly to Embodiment 1, when the operation member 142 rotates in the direction of arrow a, the contact 141*b* and the contact 150*a* of the contact member 150 are not electrically connected. On the other hand, when the operation member 142 rotates in the direction of an arrow b, the contact member 141 and the contact member 150 are electrically connected.

Figure 22:
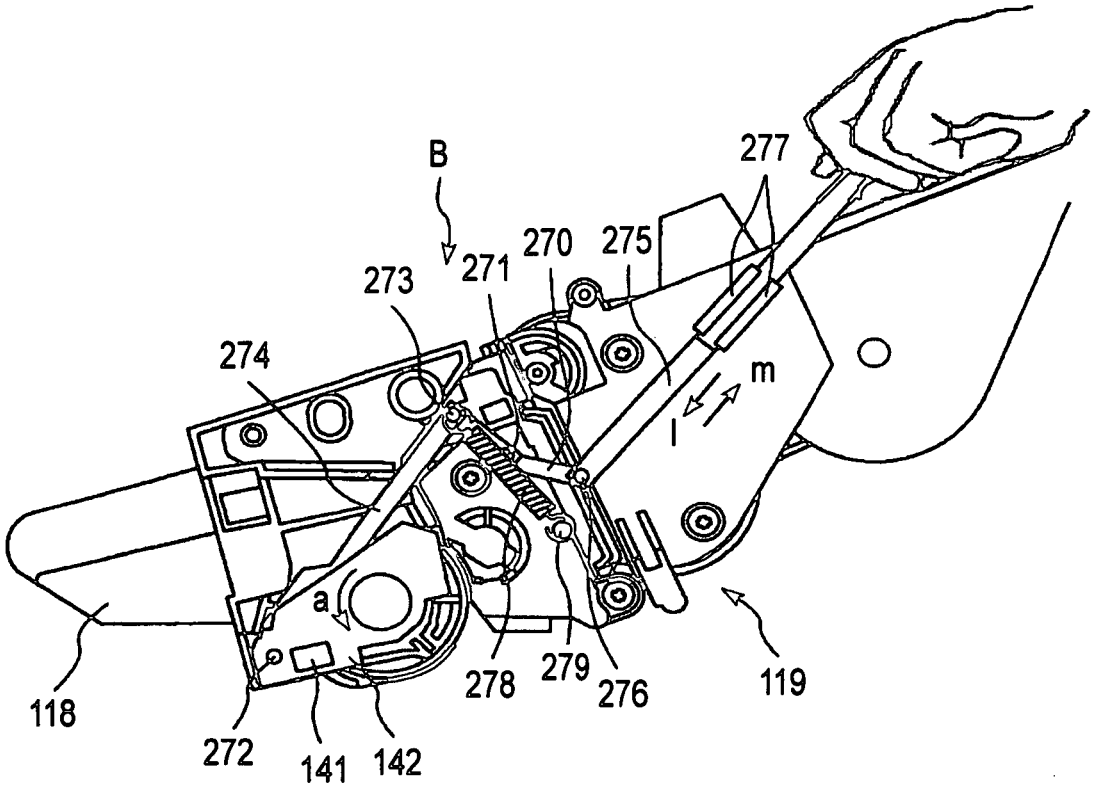
FIG. 22 illustrates a schematic side view of the structure of the movable operation member of the process cartridge according to the embodiment of the present invention.

Referring to FIG. 22, the structure of the operation member 142 will be described.

As shown in this figure, a side surface of the cartridge B is provided with the operation member 142 which is rotatably mounted to the drum frame 118.

To the developing unit 119, a cartridge arm 270 is rotatably provided for rotation about a cartridge shaft portion 271.

The operation member 142 is rotatably connected with one end of a first link 274 by a first cartridge connecting portion 272. The other end of the link 274 is rotatably connected with a second cartridge connecting portion 273. To the other end of the link 274, one end of the arm 270 is rotatably connected by a second cartridge connecting portion 273.

To the other end of the arm 270, a second link 275 (operating member) is rotatably mounted at a third cartridge connecting portion 276. The link 275 is slidably mounted on a mounting portion 277 at the side surface of the developing unit 119, for sliding motion in the directions of arrows 1 and m.

Between the link 274 and the connecting portion 273, an end of a tension spring 278 is hooked. The other end of the tension spring 278 is mounted on a shaft portion 279.

With the structure of this embodiment, the operation member 142 is rotatable by manual operation of the link 275 by the operator.

FIG. 22 shows a state in which the operator manually moves the link 275 in the direction of the arrow m (pulling toward the operator). When the second link 275 is moved in the direction of m, the arm 270 rotates in the couterclockwise direction in this figure. This rotates the operation member 142 in the direction of an arrow k.

Here, similarly to Embodiment 1, the operation member 142 is rotatable until the abutting portion 142*b* of the operation member 142 (FIG. 12) abuts to the operation member abutting portion 118*e*. The arrangement is such that when the operation member 142 abuts to the operation member abutting portion 118*e*, the second connecting portion 273 is disposed in a left side of a line connecting the center of rotation of the arm 270 (the center of the shaft 271) and the center of the shaft portion 279. One end of the tension spring 278 is mounted on the shaft portion 279. Therefore, the elastic force of the spring 278 tends to rotate the arm 270 in the couterclockwise direction. Therefore, the operation member 142 is placed of the position where it abuts to the abutting portion 118*e*.

Figure 23:
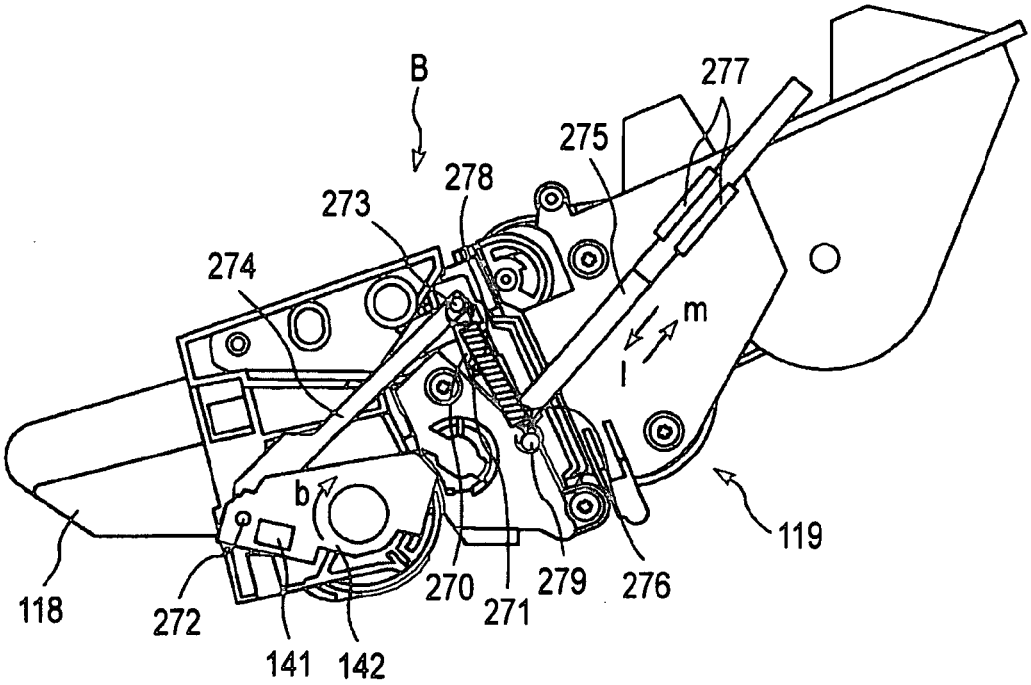
FIG. 23 illustrates a schematic side view of the structure of the movable operation member of the process cartridge according to the embodiment of the present invention.

FIG. 23 shows a state in which the operator manipulates the second link 275 in the direction of the arrow w (pushing direction). By the operation of the link 275, the arm 270 rotates in the clockwise direction. This rotates the operation member 142 in the direction of an arrow k.

At this time, the operation member 142 is rotatable until the operation member 142 abuts to the abutting portion 118*f* (FIG. 12), similarly to Embodiment 1. The arrangement is such that when the operation member 142 abuts to the operation member abutting portion 118*f*, the second connecting portion 273 is disposed in a right side of a line connecting the center of rotation of the arm 270 (the center of the shaft 271) and the center of the shaft portion 279. Therefore, the elastic force of the spring 278 tends to rotate the arm 270 in the clockwise direction. Therefore, the operation member 142 is placed of the position where it abuts to the abutting portion 118*f*.

When the operation member 142 is in such a state, the contact 141*a* is in the position of electrical connection with the contact 144*a*.

(2) Charging Contact Member of Main Assembly of Apparatus A:

A description will be provided as to the main assembly charging electrical contact member 144 (input electrical contact member) and an electrical contact (input electrical contact) 144*a*.

Figure 24:
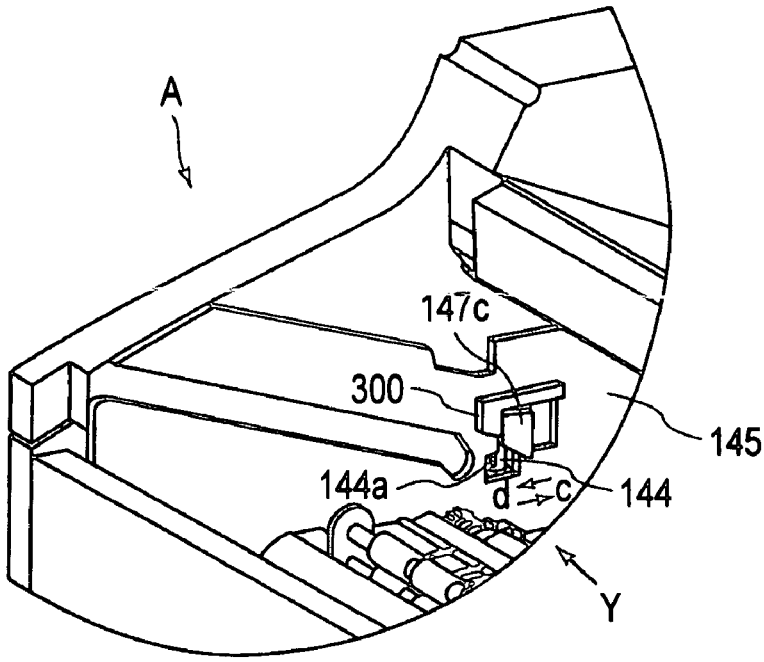
FIG. 24 is a perspective view of the structure of an electrical contact portion in the main assembly of the image forming apparatus according to the embodiment of the present invention.

As shown in FIG. 24, the main assembly charging contact member 144 is provided on an inside surface of the main assembly of the apparatus A. With no cartridge B mounted in the main assembly of the apparatus A, the electrical contact 144*a* of the electrical contact member 144 is at a retracted position where the electrical contact 144*a* is not projected beyond the inner side plate 145 of the main assembly of the apparatus A. The contact member 144 is effective to supply the charging bias voltage to the charging roller 108 when it is contacted to the cartridge movable charging contact member 141 of the cartridge B.

Into an inside the main assembly of the apparatus A, one end portion of the operation member displaceable member 147 (displaceable engaging portion) is projected. The displaceable member 147 is interrelated with the operation of the operation member 142 to operate the contact member 144.

A fixed member 300 is disposed upstream of the displaceable member 147 with respect to the mounting direction X of the cartridge B. The fixed member is fixed on the main assembly of the apparatus A.

Figure 25:
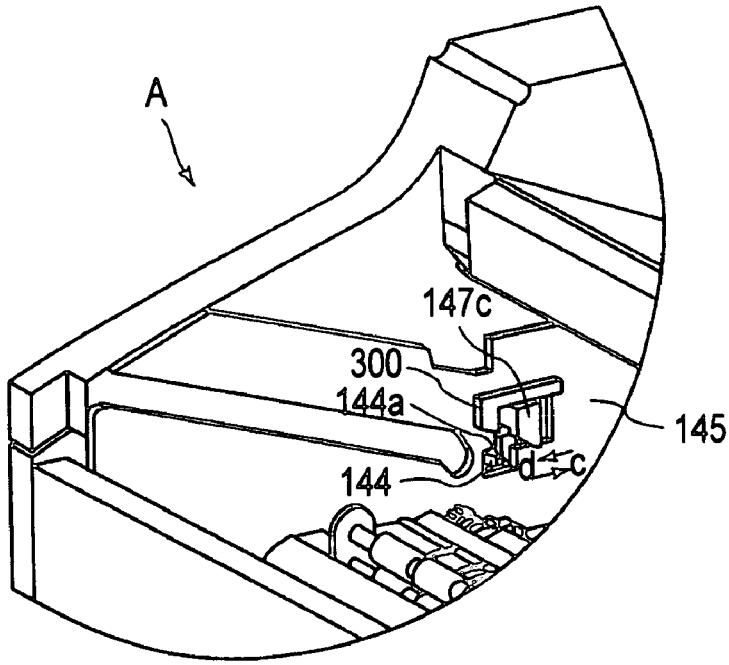
FIG. 25 is a perspective view of the structure of an electrical contact portion in the main assembly of the image forming apparatus according to the embodiment of the present invention.

The one end portion 147*c* moves in the directions of arrows c, d in interrelation with the operation member 142. After the cartridge B is mounted to the main assembly of the apparatus A (after the cartridge B is mounted to the mounting portion 130*a*), the operator manually operates the second link 275. As shown in FIG. 25, by such an operation, the displaceable member 147 is pushed by the operation member 142 (FIG. 23) in the direction of an arrow c. Then, the contact 144*a* is projected by rotational motion from the inner side plate 145 toward the mounting portion 130*a* side in interrelation with the operation of the displaceable member 147. By doing so, the contact 144*a* is contacted to the contact 141*a*. In other words, the contact 144*a* is moved relative to the contact 141*a* and is contacted to the contact 141*a*, which is stationary.

By this, supply of the charging bias voltage to the charging roller 108 from the main assembly of the apparatus A is enabled. When the operation member 142 rotates, the contact 144*a* also rotates in a different direction. These contacts are brought into contact with each other while moving. The contacts make slight relative motion even after they are contacted. In this manner, the contact 141*a* rubs the surface of the contact 144*a*. Therefore, the surface of the contact 141*a* and the surface of the contact 144*a* rub each other. By doing so, foreign matter, developer or the like deposited on the surfaces can be removed. Thus, the reliability of the electrical connection between the contact 141*a* and the contact 144*a* is improved.

Figure 26:
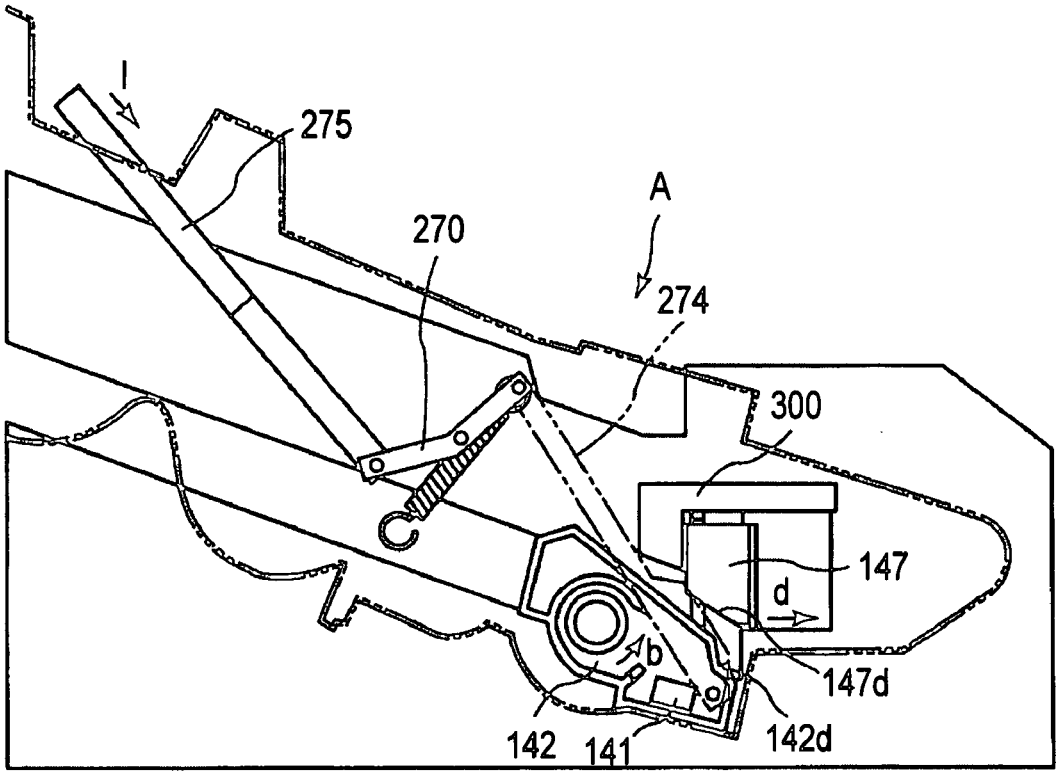
FIG. 26 illustrates a schematic side view of the structures of the movable operation member and the electrical contact of the image forming apparatus according to the embodiment of the present invention.

(3) Operations of Movable Member and Charging Contact Member:

A description will be provided as to the cartridge operation member 142 (movable operation member) provided on the cartridge B and the main assembly charging contact member 144 (output contact member) provided in the main assembly of the apparatus A. FIG. 26 is a schematic view illustrating an operation when the cartridge B is mounted to the main assembly of the apparatus A.

In this embodiment, the structure or the like of the displaceable member 147 and the supporting structure of the contact member 144 are the same as in Embodiment 1, and therefore, the detailed description thereof is omitted for simplicity.

FIG. 26 is a view of an inner side plate 145 provided in the main assembly of the apparatus A as seen from an inside of the main assembly of the apparatus (in the direction of arrow Y in FIG. 24).

FIG. 26 shows a position wherein the cartridge B is mounting is set in the main assembly of the apparatus A. In FIG. 26, the operation member 142 is disposed at a lower position. Namely, the cartridge B is in the state shown in FIG. 22.

Figure 27:
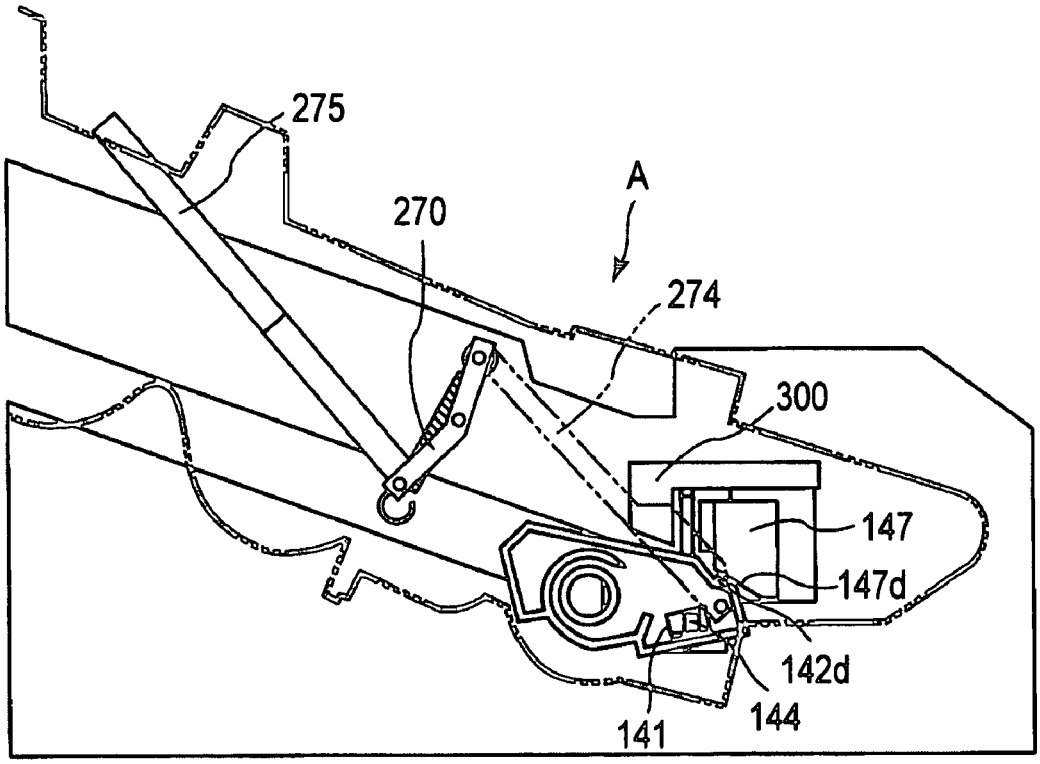
FIG. 27 illustrates a schematic side view of the structures of the movable operation member and the electrical contact of the image forming apparatus according to the embodiment of the present invention.

In the state of FIG. 26, the operator manually moves the second link 275 in the direction of arrow 1 (pushing direction). By this operation, as described hereinbefore, the operation member 142 rotates in the direction of an arrow b through the cartridge arm 270 and the first link 274. At this time, the second engaging portion 142*d* of the cartridge operation member 142 is contacted to an inclined surface 147*d* of the displaceable member 147. By doing so, the displaceable member 147 moves in the direction of an arrow d (FIG. 27). This causes the electrical contact 144*a* to project into the main assembly of the apparatus in interrelation with the displaceable member 147. Therefore, the contact 144*a* is contacted with the contact 141*a* to enable charging bias application to the charging roller 108.

In this embodiment, the advantageous effects (1)–(7) described above with respect to said Embodiment 1 are provided, except for (2) and (5).

Furthermore, according to this embodiment, the electrical connection is established between the cartridge B and the main assembly of the image forming apparatus B by the operation of the operator per se after the cartridge B is set in the main assembly of the image forming apparatus A. By this, the operator can confirm the connection between the electrical contacts 141*a*, 144*a* by himself.

Embodiment 3

Referring to FIG. 28–FIG. 31, the third embodiment will be described.

The structures of the cartridge B and the image forming apparatus 100 of this embodiment are similar to those of Embodiment 1 and Embodiment 2. The same reference numerals as those used to describe Embodiments 1 and 2 are assigned to elements having corresponding functions, and the detailed descriptions for such elements are omitted for simplicity.

In this embodiment, the operation of the second link 275 in Embodiment 1 and Embodiment 2, is interrelated with the operation of closing the cartridge door 109 (main assembly openable member) provided in the main assembly of the image forming apparatus 100. The same reference numerals as those used to describe Embodiment 2 are assigned to elements having corresponding functions, and the detailed descriptions for such elements are omitted for simplicity.

Figure 28:
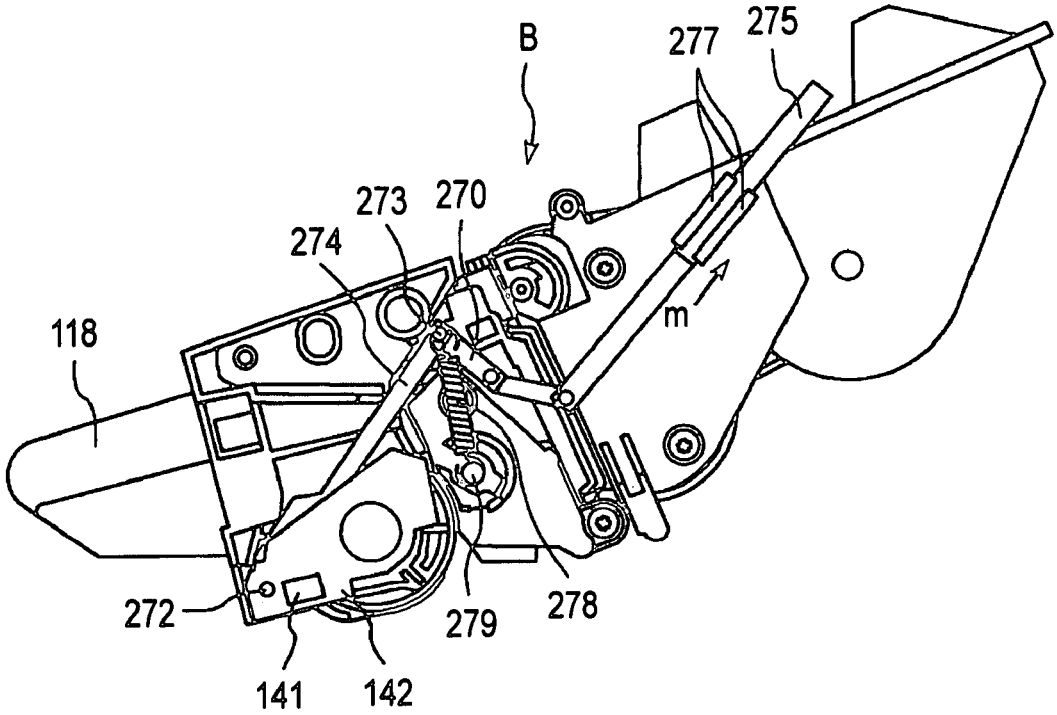
FIG. 28 illustrates a schematic side view of the structure of the movable operation member of the process cartridge according to the embodiment of the present invention.

Referring to FIG. 28, a description will be provided as to the structure of the operation member 142 mounted to the cartridge B of this embodiment.

As shown in this figure, a side surface of the cartridge B is provided with the operation member 142, which is rotatably mounted to the drum frame 118. The contact member 141 is provided on a side surface of the operation member 142 and is exposed to the outside. The operation member 142, similarly to Embodiment 2, is connected with the second link 275 through the first link 274 and the cartridge arm 270. The structure of the link and the arm are similar to those of Embodiment 2, and therefore, the detailed description thereof is omitted for simplicity.

In this embodiment, the tension spring 278 is stretched between the connecting portion 273 and the shaft portion 279, too. The shaft portion 279 is disposed at a position different from that in Embodiment 2.

Figure 29:
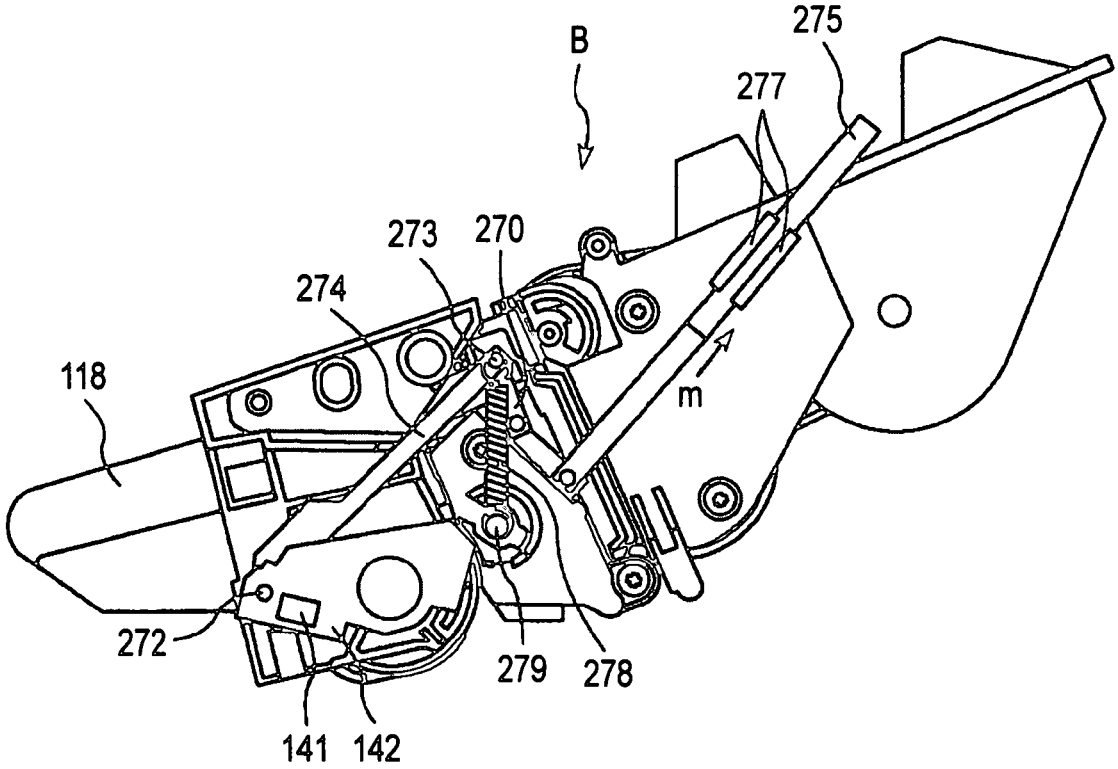
FIG. 29 illustrates a schematic side view of the structure of the movable operation member of the process cartridge according to the embodiment of the present invention.

More particularly, as shown in FIGS. 28 and 29, the tension spring 278 is disposed at such a position that the cartridge arm 270 normally receives a force in the counterclockwise direction in the figure. Therefore, the operation member 142 is always subjected to the rotational force in the counterclockwise direction. The second link 275 receives normally an elastic force in the direction of an arrow m.

FIG. 28 shows a state in which the operation member 142 is rotated in the couterclockwise direction and positioned there. FIG. 29 shows a state in which the operation member 142 is rotated in the clockwise direction and positioned there.

Figure 30:
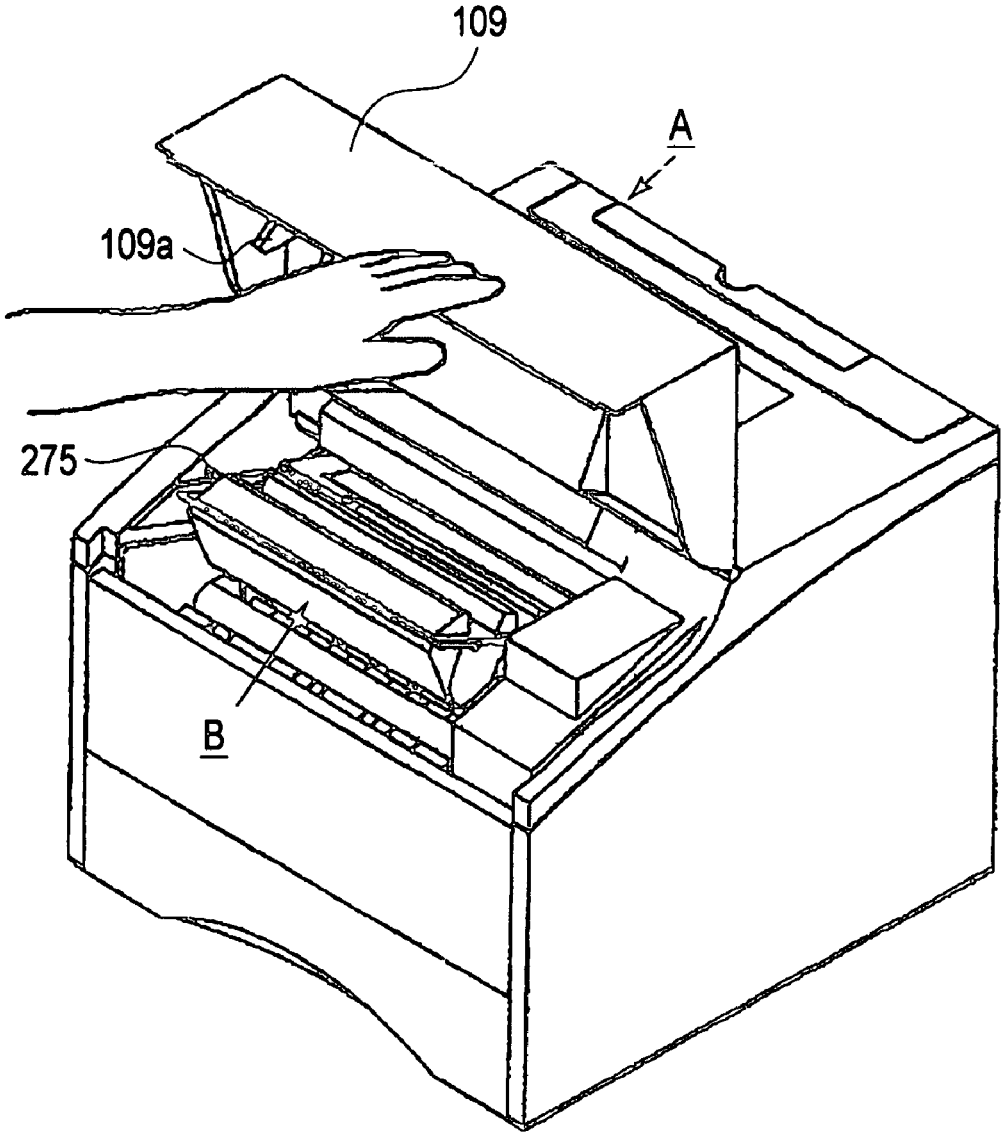
FIG. 30 is perspective views of an image forming apparatus and a process cartridge according to a further embodiment of the present invention.

FIG. 30 shows a state in which the cartridge B is set in the main assembly of the apparatus A. The structure of the contact member 144 and the displaceable member 142 for moving it are similar to those of Embodiment 2. Therefore, the detailed description thereof is omitted for simplicity.

An end of a second link 275 for rotating the movable member 142 is projected from the cartridge B. Inside the cartridge door 109, there is provided a rib 109*a* for pushing the second link 275. The door 109 can be opened or closed relative to the main assembly of the apparatus. The door 109 opens relative to the main assembly of the apparatus (FIG. 33), and enables mounting and demounting of the cartridge B relative to the main assembly of the apparatus.

Figure 31:
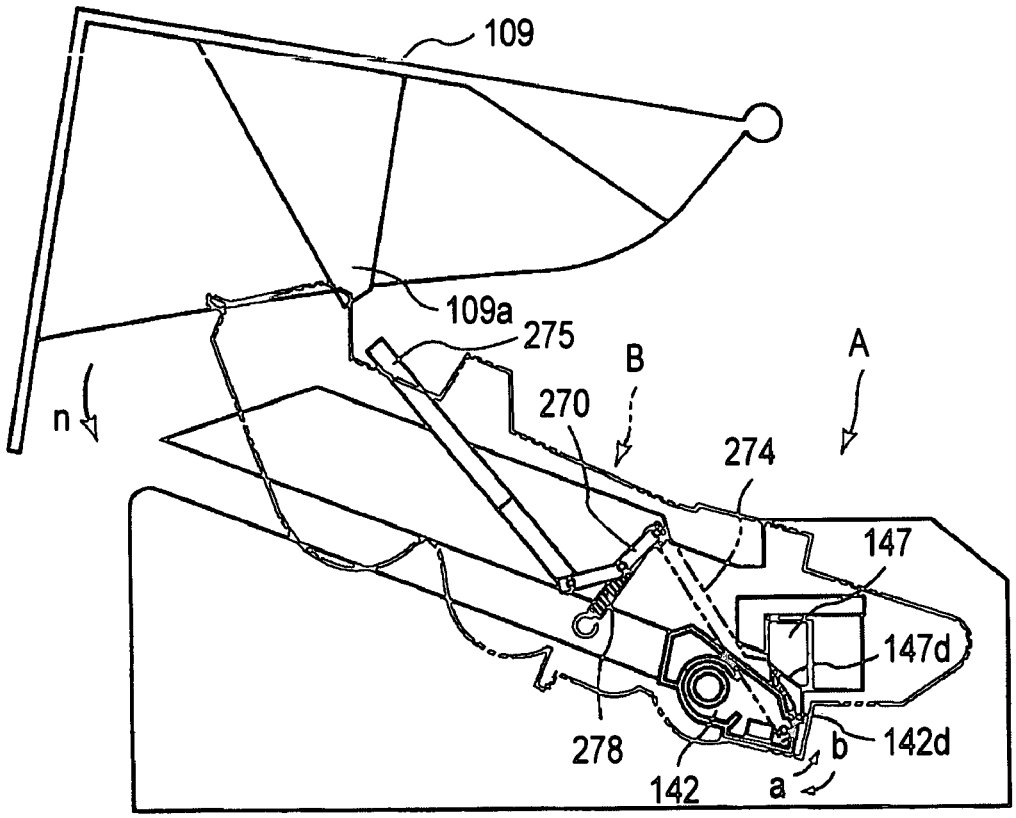
FIG. 31 is a schematic side view of structures of the movable operation member and the electrical contact of the image forming apparatus.

As shown in FIG. 31, after the cartridge B is mounted to the main assembly of the apparatus A, the operator manually closes the door 109 in the direction of an arrow f. Then, the rib 109*a* pushes the end of the second link 275 (operation member) in the direction of the arrow C. By doing so, similarly to Embodiment 2, the operation member 142 rotates in the direction of an arrow g through the cartridge arm 270 and the first link 274. This brings the second engaging portion 142*d* of the operation member 142 into contact to the inclined surface 147*d* of the displaceable member 147. Therefore, the displaceable member 147 is moved. The rib 109*a* is disposed inside the door 109.

In this manner, the electrical contact 144*a* (FIG. 24–FIG. 27) is contacted to the electrical contact 141*a* by interrelation with the displaceable member 147. By this, the charging roller 108 can receive the charging bias from the main assembly of the apparatus A.

By this, supply of the charging bias voltage to the charging roller 108 from the main assembly of the apparatus A is enabled. When the operation member 142 rotates, the contact 144*a* also rotates in a different direction. These contacts are brought into contact with each other while moving. The contacts make slight relative motion even after they are contacted. In this manner, the contact 141*a* rubs the surface of the contact 144*a*. Therefore, the surface of the contact 141*a* and the surface of the contact 144*a* rub each other. By doing so, foreign matter, developer or the like deposited on the surfaces can be removed. Thus, the reliability of the electrical connection between the contact 141*a* and the contact 144*a* is improved.

As described in the foregoing, the operation member 142 has an engaging portion 142*d* for engagement with the displaceable member 147. The operation member 142 operates the second link 275 (operating member) by the operator manually closing the door 109 after the cartridge B is mounted in the main assembly of the apparatus A. The operation member 142 is rotated by such an action, and the engaging portion 142*d* is engaged with the displaceable member 147. When the cartridge B is removed from the main assembly of the apparatus A, the operator opens the door 109. The operation member 142 is rotated in the direction of an arrow a by the elastic force of the tension spring 278, as described hereinbefore. By this, the operation member 142 returns to the initial state (retracted state), namely, the operation member 142 takes a lower position (FIG. 28).

This embodiment also provides the advantageous effects similar to Embodiment 2.

Moreover, according to this embodiment, the movement of the second link 275 is interrelated with the movement of the door 109. By doing so, the operator is not required to make an additional operation to bring the contact 144*a* and the contact 141*a* to contact to each other.

Embodiment 4

Referring to FIG. 32–FIG. 40, a fourth embodiment will be described.

The cartridge B and the image forming apparatus 100 have substantially the same structures as with Embodiment 1. A description will be provided as to the structures of the portions which are different from those of Embodiment 1, Embodiment 2 and Embodiment 3. The same reference numerals as those used to describe the earlier embodiments are assigned to elements having corresponding functions, and the detailed descriptions for such elements are omitted for simplicity.

Figure 32:
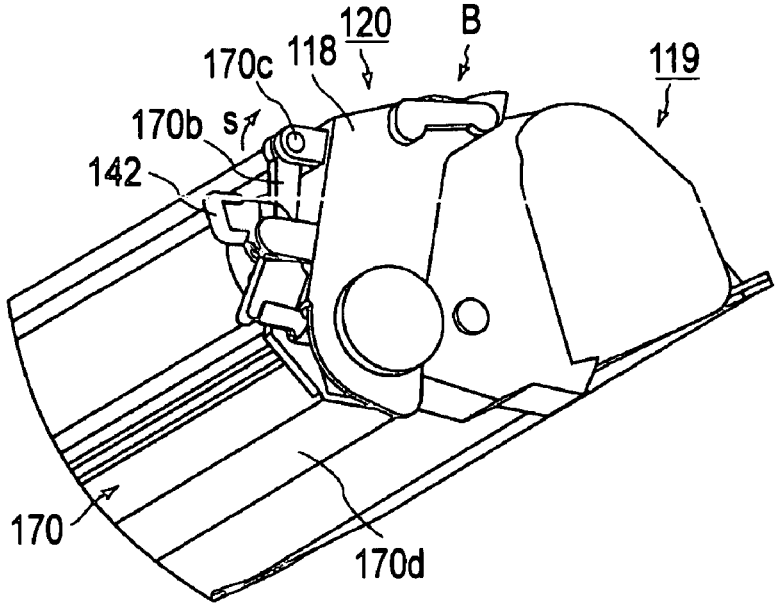
FIG. 32 is a perspective view of the structure of the movable operation member of the process cartridge according to the embodiment of the present invention.
Figure 33:
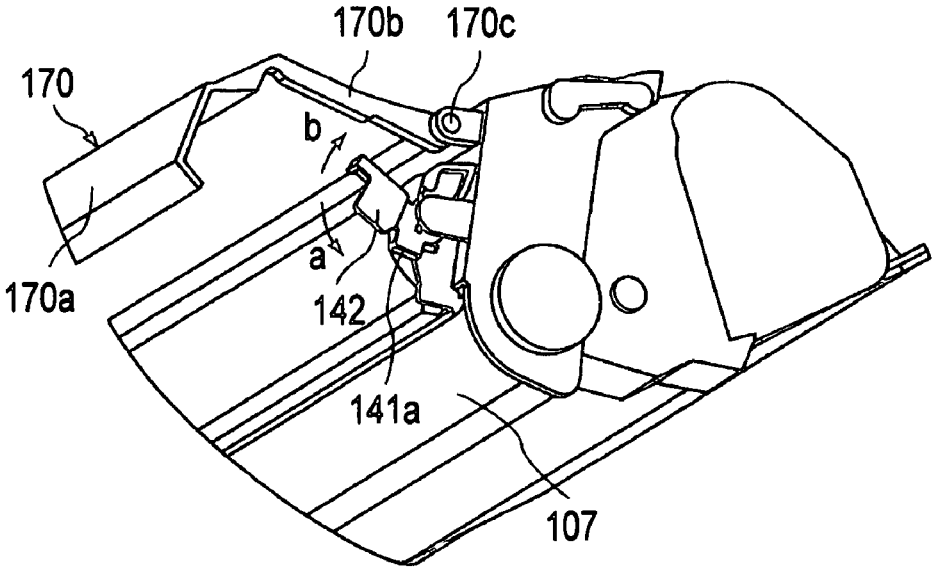
FIG. 33 is a perspective view of the structure of the movable operation member of the process cartridge according to the embodiment of the present invention.
Figure 34:
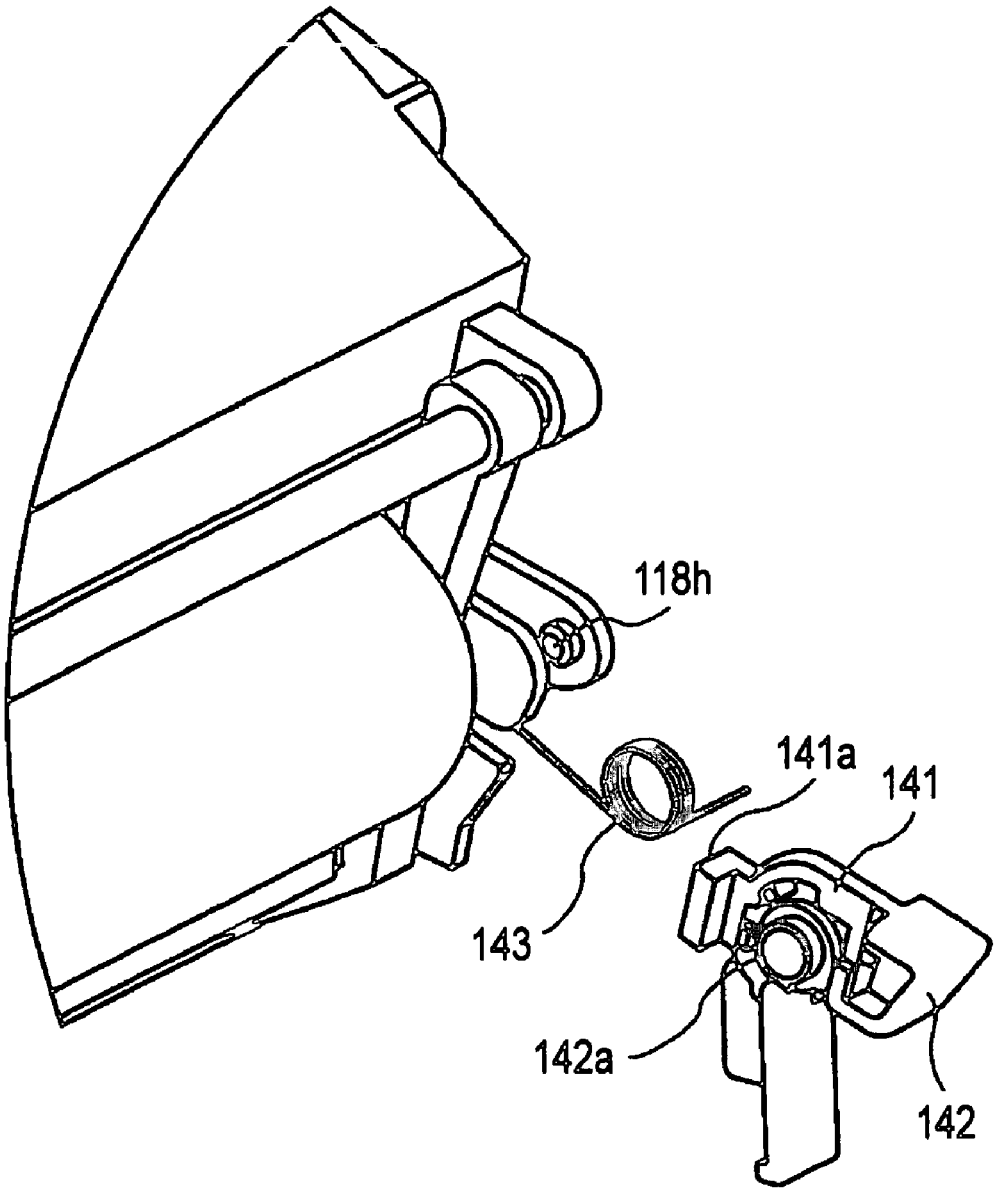
FIG. 34 is a perspective view of the structure of the movable operation member of the process cartridge according to the embodiment of the present invention.

(1) Operation Member and Charging Contact Member of Cartridge:

FIG. 32–FIG. 34 show the cartridge B of this embodiment. In this embodiment, the cartridge B comprises a drum unit 120 and a developing unit 119 which are rotatably coupled with each other.

The cartridge B is provided on the drum frame 118 with a drum shutter 170 for protecting the photosensitive drum 107. The shutter 170 has a shutter portion 170*a* for covering the photosensitive drum 107 and supporting arm 170*b* at each of the opposite ends (one end portion only is shown in the figure). The shutter 170 is rotatably mounted for rotation about the shaft portion 170*c*.

The shutter 170 rotates in the direction of the arrows in interrelation with the mounting operation of the cartridge B to the main assembly of the apparatus A. It moves from the position (FIG. 38) for protecting the photosensitive drum 107 to the position (FIG. 39) for exposing the photosensitive drum 107.

The operation member 142 is mounted on the drum frame 118 for rotation about the shaft 118*h* (FIG. 34). The operation member 142 is provided outside a passing path of the supporting arm 170*b* when it rotates.

The contact member 141 is fixed on the operation member 142 and is exposed there. The cartridge operation member 142 rotates in the direction of an arrow b in interrelation with an operation of mounting the cartridge B to the main assembly of the apparatus A, similarly to the shutter 170. By this, the electrical contact 141*a* is moved from a retracted position (FIG. 32) where it is out of contact from the electrical contact 144*a* to a contact position (FIG. 33) where it is contactable to the electrical contact 144*a*.

In FIG. 34, the operation member 142 is provided in the cylindrical portion 142*a* with a twisted coil spring 143. The elastic force of the spring 143 urges the operation member 142 to rotate in the direction of an arrow a. The abutting portion 142*b* of the operation member 142 urged by the elastic force of the spring 143 abuts the abutting portion 118*e*. By doing so, the operation member 142 is set at a position with respect to the rotational direction.

Figure 35:
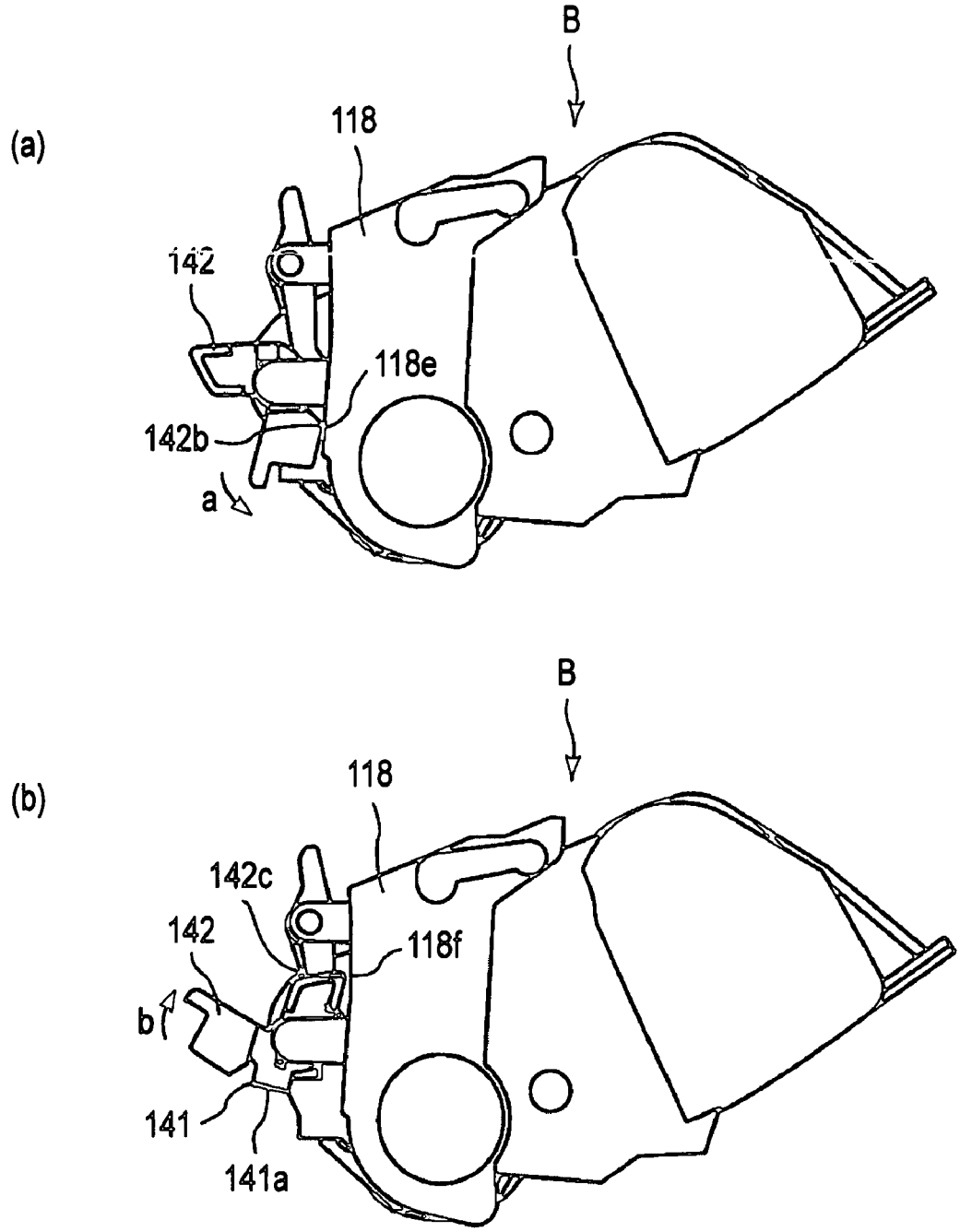
FIGS. 35(*a*) and 35(*b*) are side views of a structure of a movable operation member according to a further embodiment of the present invention.

When the operation member 142 rotates in the direction of an arrow b, it rotates until the abutting portion 142*c* abuts to the abutting portion 118*f* (FIG. 35(*b*)).

Figure 36:
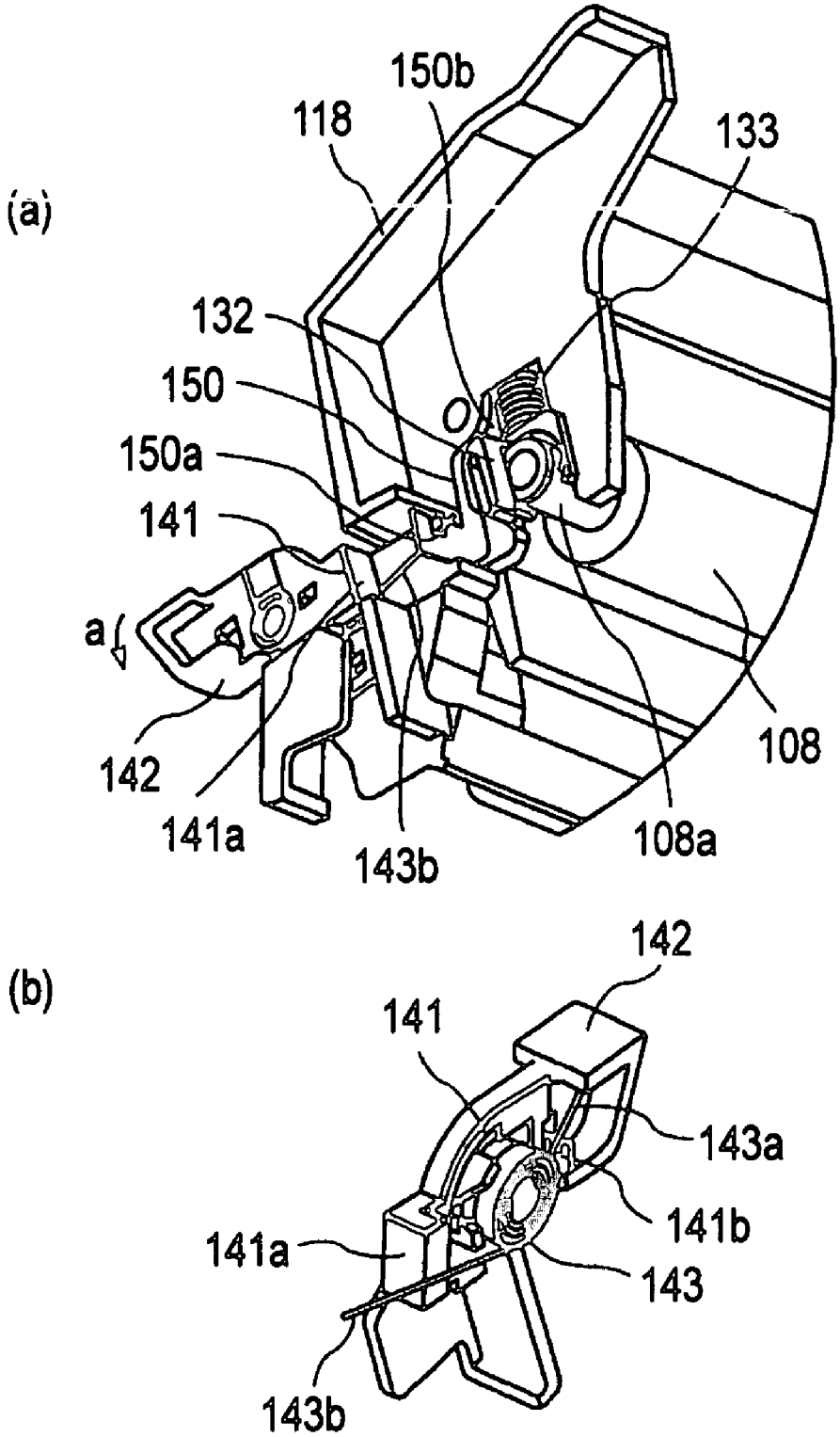
FIGS. 36(*a*) and 36(*b*) are perspective views of an electrical contact of a process cartridge according to a further embodiment of the present invention.

FIGS. 36(*a*) and 36(*b*) are perspective views wherein a side of the drum frame 118 has been removed so that inside of the drum frame 118 can be seen. The charging roller 108 is rotatably supported by a charging roller bearing 132 which is molded from an electroconductive resin material and which supports the metal shaft 108*a* of the charging roller 108. The charging roller 108 is mounted in the drum frame 118. The bearing 132 is provided with a pressing spring 133. The cartridge fixed charging contact member 150 includes an electrical contact 150*a* for contacting to an arm portion 143*b* of the twisted coil spring 143 and an electrical contact 150*b* for contacting to the spring 133.

The contact member 141 is mounted on the operation member 142 and is exposed there. The contact member 141 includes an electrical contact 141*a* for contacting to the electrical contact 144*a* and an electrical contact 141*b* for contacting to the arm portion 143*a* of the spring 143. In other words, one of the arm portions 143*b* of the spring 143 is hooked and locked by the contact 150*a*, and the other arm portion 143*a* is hooked on the contact 141*b*. By doing so, the spring 143 urges the operation member 142 to rotate in the direction of an arrow a, and effects establishment of the electrical connection between the associated contacts.

More particularly, an electrical path is established from the contact 141*a* of the contact member 141 to the contact 150*b* through the contact 141*b*, the arm portion 143*a*, the arm portion 143*b* and the contact 150*a*. Then, the electric connection is established from the contact 150*b* to the charging roller 108 through the spring 133, the bearing 132 and the metal shaft 108*a*.

(2) Charging Contact Member of Main Assembly of Apparatus A:

A description will be provided as to the main assembly A of the apparatus to which the cartridge B is mountable.

Figure 38:
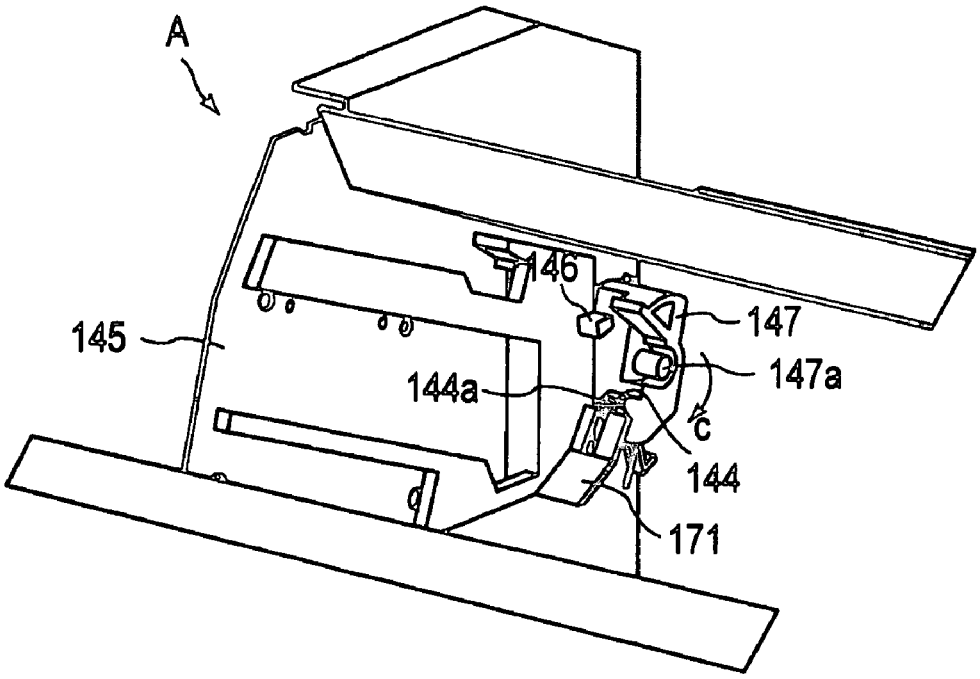
FIG. 38 is a perspective view of the structure of an electrical contact portion in the main assembly of the image forming apparatus according to the embodiment of the present invention.

As seen in FIG. 38, a contact member 144 is provided on an inner side surface of the main assembly of the apparatus A.

When the cartridge B is not yet mounted to the main assembly of the apparatus A, the contact member 144 is at a retracted position where it does not project beyond a cover 171, which is provided on an inner side surface of the main assembly of the apparatus A. The contact member 144 is electrically connected to a high voltage electric circuit (voltage source circuit E) disposed inside the main assembly of the apparatus A by lead lines or the like.

Inside the main assembly of the apparatus A, a fixed engageable member (fixed member) 146 for rotating the operation member 142 is provided projected from the inner side surface. The displaceable member 147 is disposed downstream of the fixed engageable member 146 with respect to the mounting direction X of the cartridge B.

The displaceable member 147 is mounted rotatably about the shaft portion 147*a*. The displaceable member 147 rotates in interrelation with mounting and demounting operation of the cartridge B. When the cartridge B is mounted to the main assembly of the apparatus A, the displaceable member 147 is pushed by the cartridge operation member 142 of the cartridge B in the direction of an arrow c, as shown in FIG. 38. By this, the contact 144*a* is uncovered and projected to contact to the electrical contact 141*a*.

Figure 39:
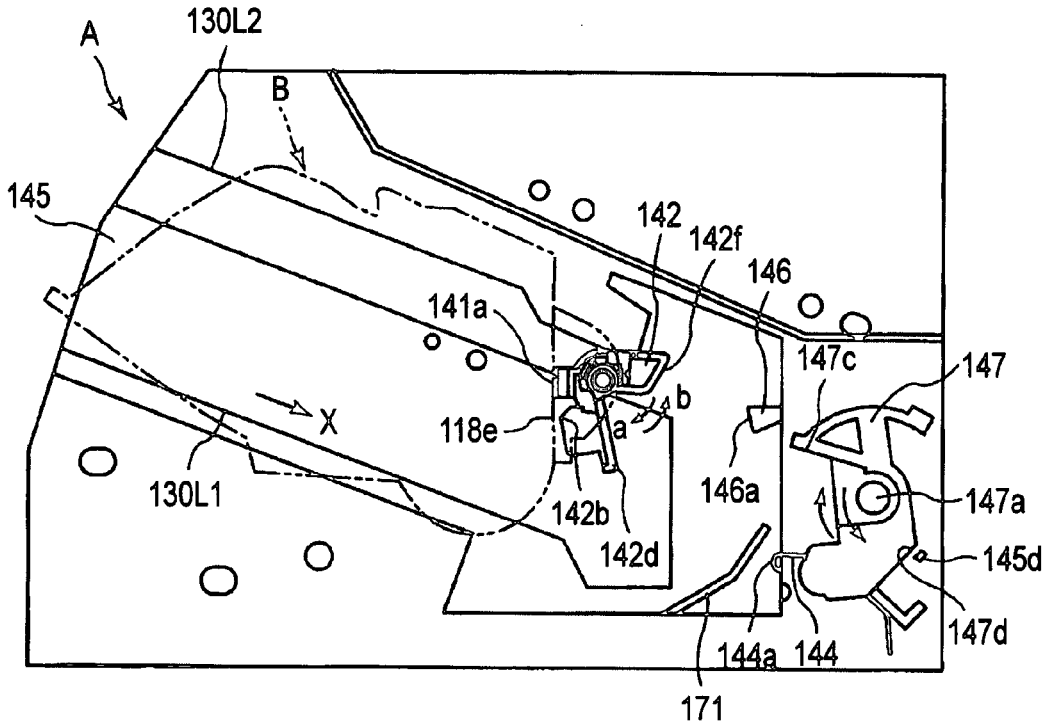
FIG. 39 is a schematic side view of the structures of the moveable operation member and the electrical contact of the image forming apparatus.
Figure 40:
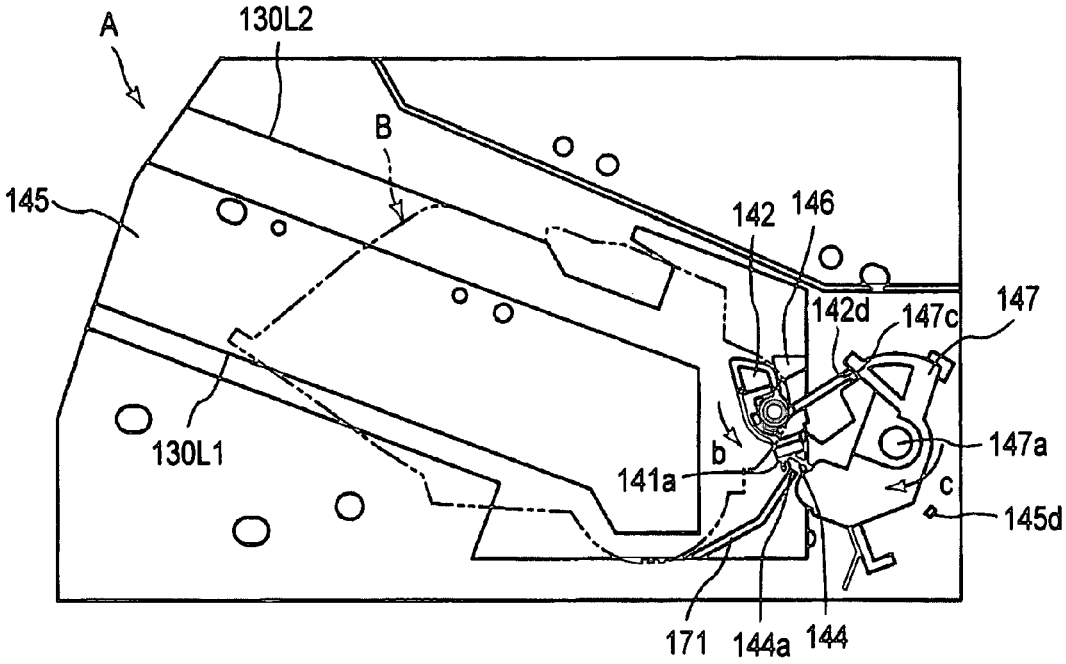
FIG. 40 is a schematic side view of the structures of the movable operation member and the electrical contact of the image forming apparatus.

(3) Operations of Movable Member and Charging Contact Member:

A description will be provided as to the operations of the operation member 142 and the contact member 144. FIGS. 39 and 40 are schematic view illustrating the operation of mounting the cartridge B into the main assembly of the apparatus A.

Figure 37:
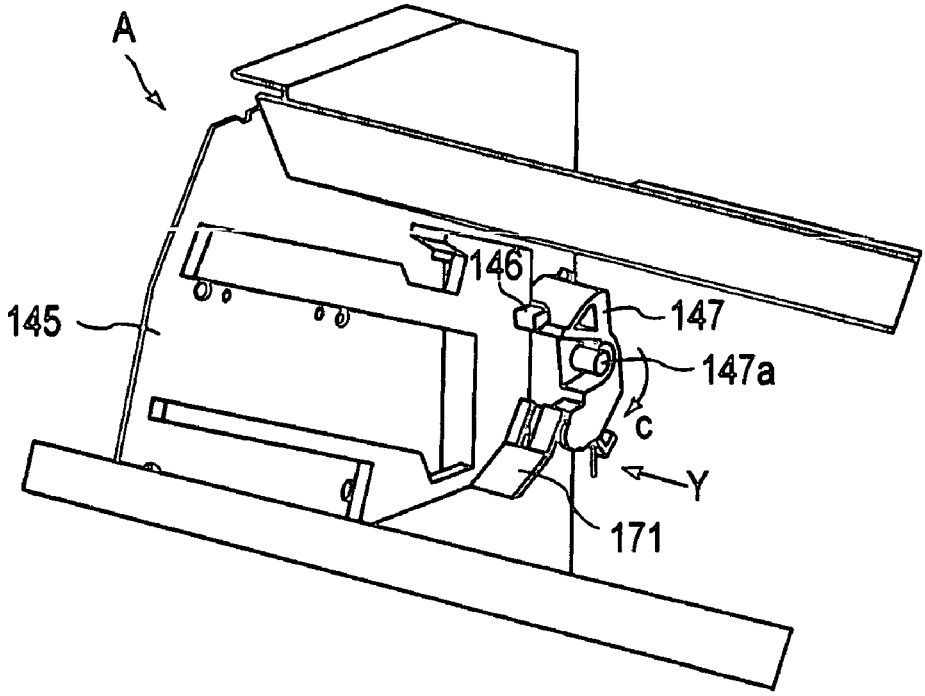
FIG. 37 is a perspective view of the structure of an electrical contact portion in the main assembly of the image forming apparatus according to the embodiment of the present invention.

FIGS. 39 and 40 are the views of the inner side plate 145 as seen from an inside of the main assembly of the apparatus A (as seen in the direction of arrow Y in FIG. 37). FIG. 39 shows a state in which the cartridge B is in the process of insertion into the main assembly of the apparatus A, and FIG. 40 shows a state in which the cartridge is set in the main assembly of the apparatus A.

As shown in FIG. 39, the displaceable member 147 is mounted on the inner side plate 145 rotatably about the shaft portion 147*a*. The contact member 144 is mounted on the displaceable member 147. The displaceable member 147 is urged by a compression spring (unshown) in the direction of an arrow d. The abutting portion 147*d* of the displaceable member 147 is abutted to the abutting portion 145*d* of the inner side plate 145 to be positioned. At this time, the contact 144*a* is at a position where it does not project into the main assembly of the apparatus A beyond the cover 171.

The cartridge B is inserted in the direction of arrow X along the guide portions 130L1, 130L2.

In the position shown in FIG. 39, as described hereinbefore, the operation member 142 is urged by the elastic force of the spring 143 in the direction of an arrow a. The operation member 142 is at rest at the position where the abutting portion 142*b* abuts to the abutting portion 118*e*. The contact member 144 is at the position not projecting beyond the cover 171. The contact 141*a* is also at the retracted position.

When the cartridge B is further inserted into the main assembly from the position of FIG. 39, the first engaging portion 142*f* of the operation member 142 abuts the contact portion 146*a* of the fixed engageable member 146. By this, it is rotated in the direction of an arrow b. By doing so, the second engaging portion 142*d* of the operation member 142 pushes one end portion 147*c* of the displaceable member 147 upwardly. Therefore, the displaceable member 147 rotates in the direction of an arrow g. And, the electrical contact 144*a* projects beyond the cover 171.

As shown in FIG. 40, when the cartridge B is completely mounted to the main assembly of the apparatus A, the contact 141*a* moves to the contact position. And, the contact member 144 projects beyond the cover 171. As a result, the contact 144*a* and the contact 141*a* are contacted to each other. This enables the supply of the charging bias to the charging roller 108 of the cartridge B from the main assembly A of the apparatus.

By this, supply of the charging bias voltage to the charging roller 108 from the main assembly of the apparatus A is enabled. When the operation member 142 rotates, the contact 144*a* also rotates in a different direction. These contacts are brought into contact with each other while moving. The contacts make slight relative motion even after they are contacted. In this manner, the contact 141*a* rubs the surface of the contact 144*a*. Therefore, the surface of the contact 141*a* and the surface of the contact 144*a* rub each other. By doing so, foreign matter, developer or the like deposited on the surfaces can be removed. Thus, the reliability of the electrical connection between the contact 141*a* and the contact 144*a* is improved.

This embodiment also provides the advantageous effects similar to Embodiment 2.

Furthermore, according to this embodiment, the cartridge operation member 142 is disposed outside the passing path of the supporting arm 170*b* with respect to the rotation axis of the drum shutter 170, so that there is no need to consider the effect of the opening and closing timing of the drum shutter 170 and the cartridge operation member 142 upon the mounting and demounting of the cartridge B, so that image forming apparatus can be downsized.

Embodiment 5

Referring to FIG. 41–FIG. 46, a fifth embodiment of the present invention will be described.

The structures of the cartridge B and the image forming apparatus 100 of this embodiment are similar to those of Embodiment 1–Embodiment 4. The same reference numerals as with the Embodiments 1–4 are assigned to the elements having the corresponding functions, and the detailed descriptions for such elements are omitted for simplicity.

(1) Cartridge Operation Member:

FIG. 41–FIG. 46 show a cartridge B of this embodiment of the present invention. In this embodiment, the cartridge B comprises a drum unit 120 and a developing unit 119 which are rotatably coupled with each other.

The drum frame 118 is provided with a drum shutter 170 and an operation member 142 which are rotatable relative thereto.

Figure 41:
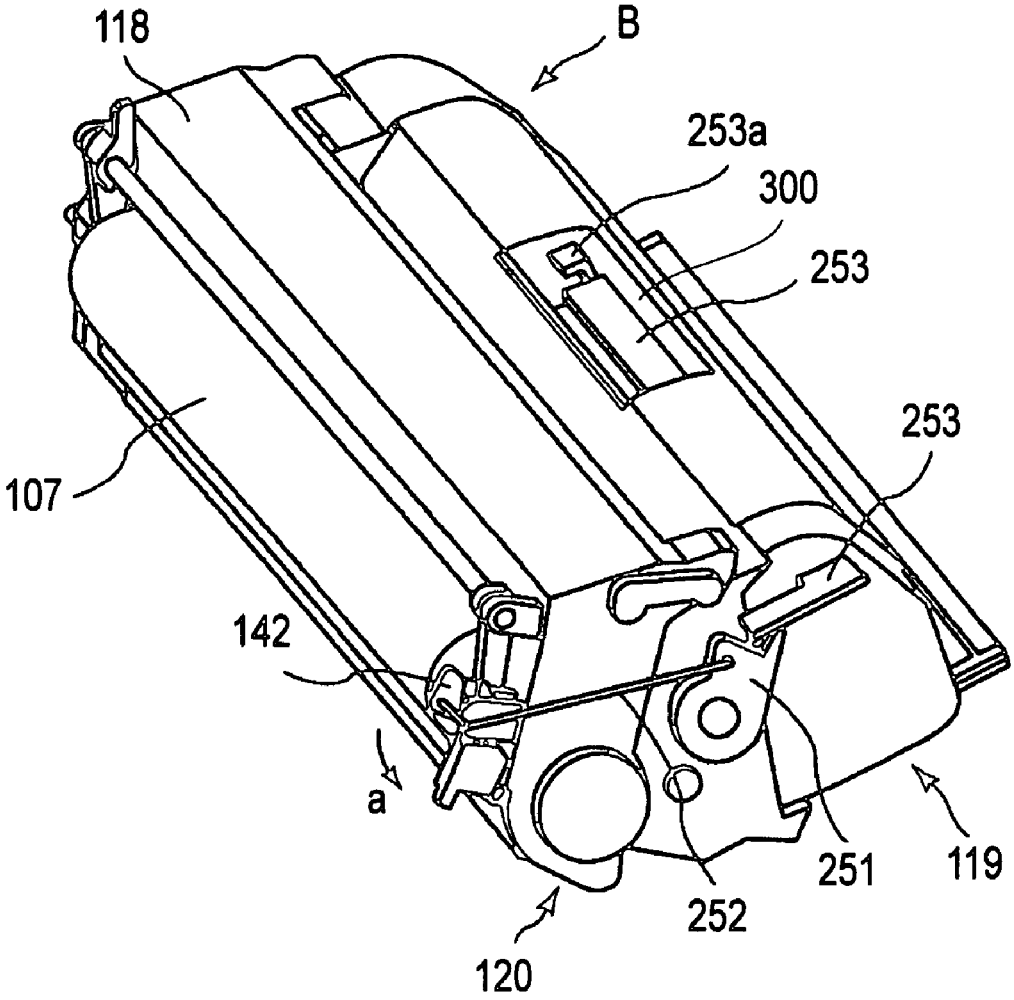
FIG. 41 is a perspective view showing a structure of a movable operation member of a process cartridge according to a further embodiment of the present invention.

As shown in FIG. 41, a cam member 251 and a link arm member 252 are provided between the cartridge operation member 142 and a grip portion 300 at the same side as the side having the cartridge operation member 142 with respect to the longitudinal direction of the cartridge B. The cam member 251 is connected so as to interrelate with the operation of the operation member 142 by a link arm member 252. The grip portion 300 functions to facilitate mounting and demounting of the cartridge B into and out of the main assembly of the apparatus.

The grip portion 300 is disposed on a top of the developing unit 119 of the cartridge B and is provided with an operation lever 253 (operation member) for operating the cam member 251. The operation lever 253 is provided with a notch or a projected portion 253*a* for returning the lever 253 (manually operating member) to a stand-by position. The projected portion 253*a* is disposed on the grip portion 300.

Figure 42:
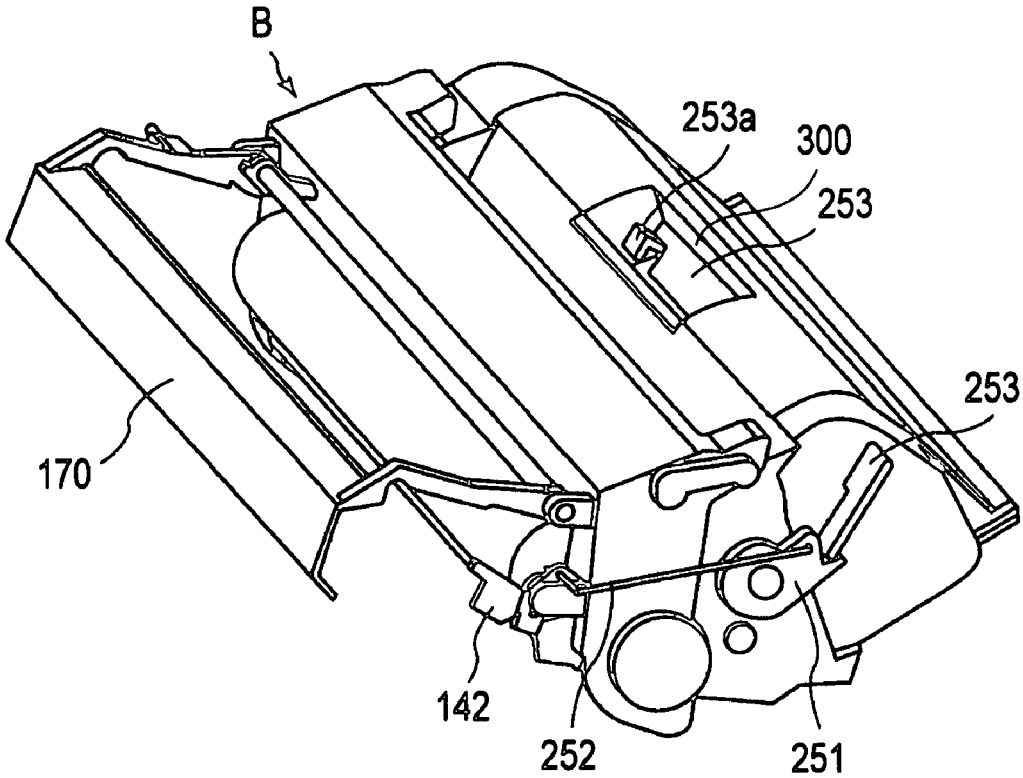
FIG. 42 is a perspective view showing a structure of a movable operation member of a process cartridge according to a further embodiment of the present invention.

In this embodiment, as shown in FIG. 42, after the cartridge B is mounted to the main assembly of the apparatus A, the operator manually operates the projected portion 253*a*, namely, the lever 253. By this, the operation member 142 is rotated in interrelation with the lever 253. The projected portion 253*a* is disposed on the grip portion 300. However, the projected portion 253*a* is disposed at a position not touched by the operator when the operator grips the grip portion 300.

(2) Charging Contact Member Provided in Main Assembly of Apparatus A:

A description will be provided as to the main assembly A of the apparatus to which the cartridge B is mountable.

Figure 44:
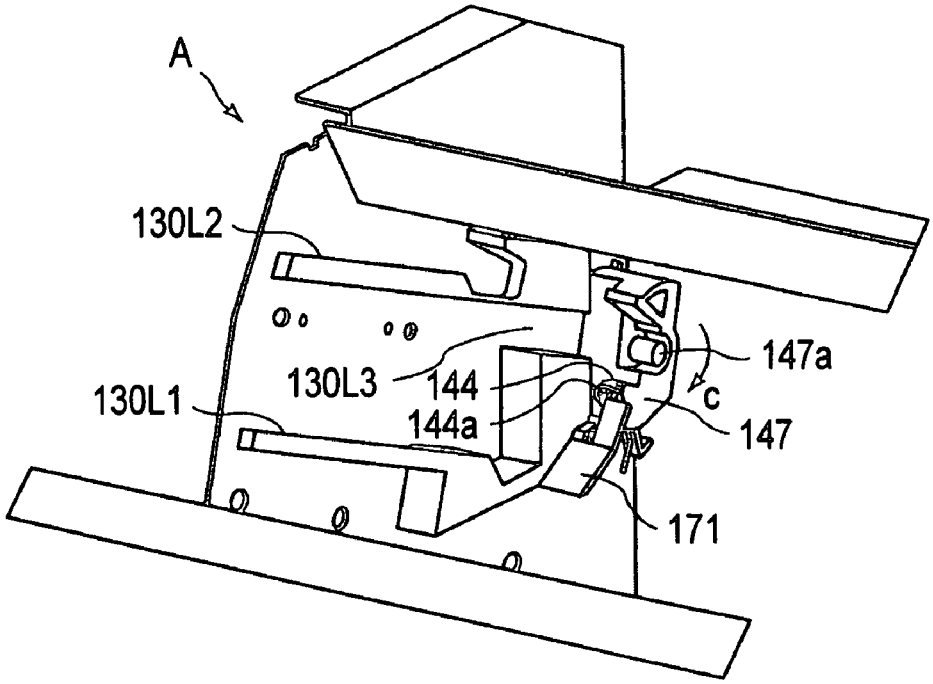
FIG. 44 is a perspective view of the structure of an electrical contact portion in the main assembly of the image forming apparatus according to the embodiment of the present invention.

As shown in FIG. 44, the inner side surface is provided with a main assembly charging contact member 144. When the cartridge is not yet mounted in the main assembly of the apparatus A, the electrical contact 144*a* of the contact member 144 is at a retracted position where it does not project beyond the cover 171.

The displaceable member 147 is mounted rotatably about the shaft portion 147*a*. As shown in FIG. 44, the displaceable member 147 is pushed by the operation member 142 when the operator operates the lever 253, and the displaceable member 147 rotates in the direction of an arrow c. Then, the contact 144*a* is uncovered. And, it is contacted to the contact 141*a* which is stationary.

Each of the mounting guide 130L1, 130L2 is provided with a cut-away portion 130L3. Because of the provision of the cut-away portion 130L3, the movement of the link arm member 152 is not interfered with.

Figure 45:
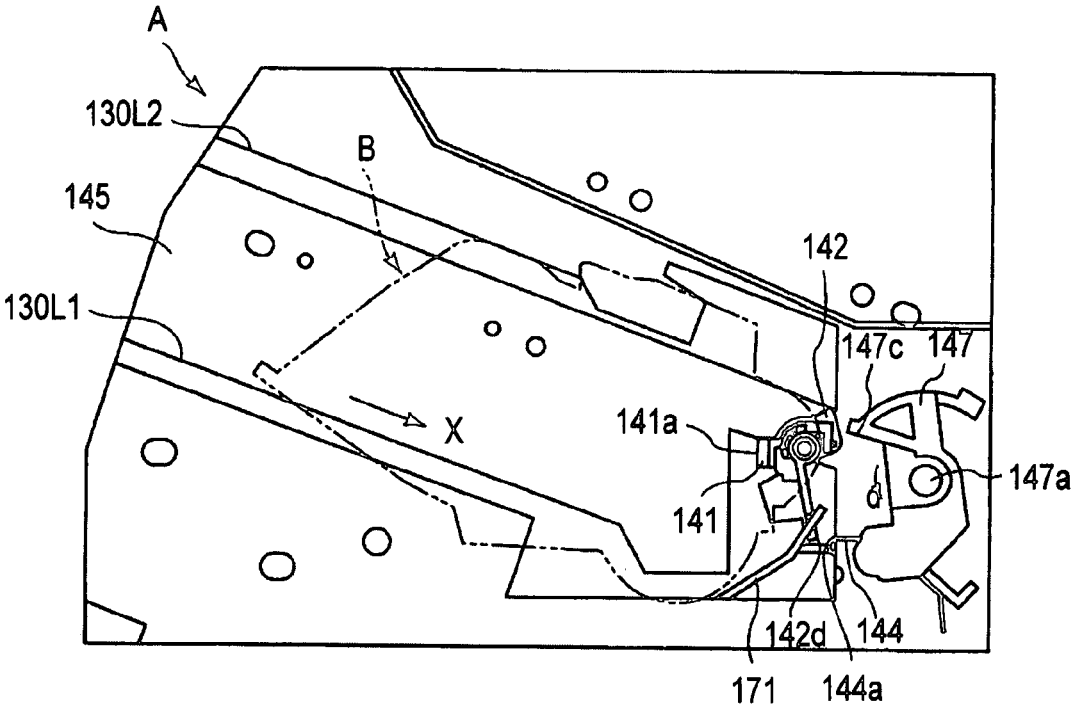
FIG. 45 is a schematic side view of the structures of the movable operation member and the electrical contact of the image forming apparatus.
Figure 46:
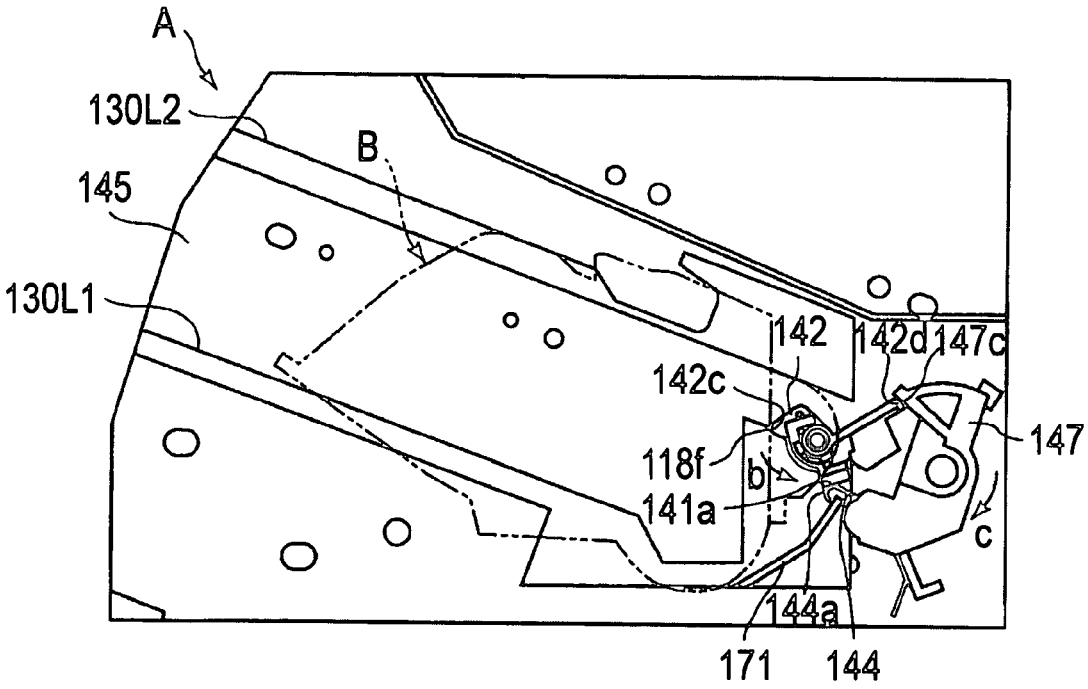
FIG. 46 is a schematic side view of the structures of the movable operation member and the electrical contact of the image forming apparatus.

(3) Operations of Operation Member and Charging Contact:

A description will be provided as to the cartridge operation member 142 of the cartridge B and the main assembly movable charging contact member 144 of the main assembly of the apparatus A. FIGS. 45 and 46 are schematic view illustrating the operation of mounting the cartridge B into the main assembly of the apparatus A.

Figure 43:
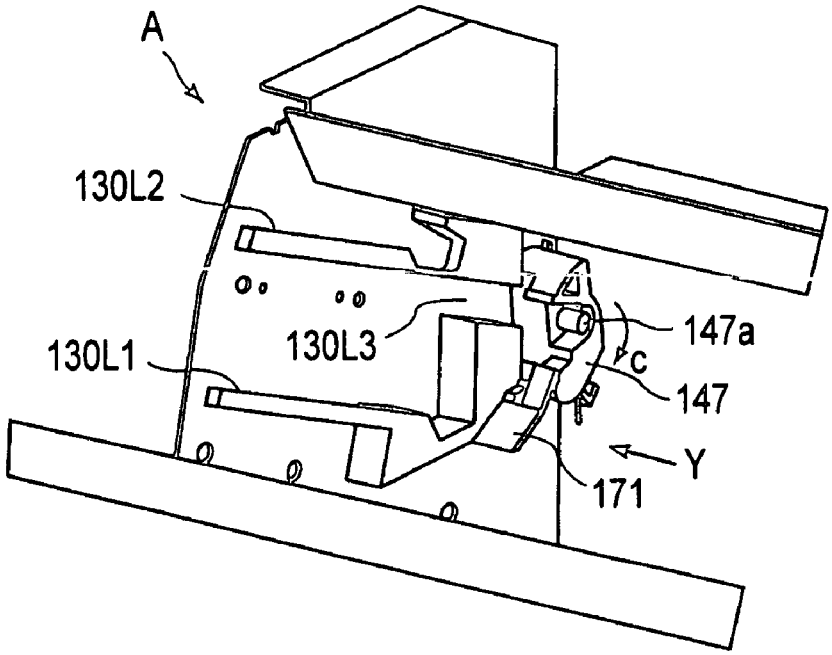
FIG. 43 is a perspective view of the structure of an electrical contact portion in the main assembly of the image forming apparatus according to the embodiment of the present invention.

FIGS. 45 and 46 are the views of the inner side plate 145 as seen from an inside of the main assembly of the apparatus A (as seen in the direction of arrow Y in FIG. 43). FIG. 45 shows a state in which the cartridge B is set in the main assembly of the apparatus A, and before the lever 253 (operating member) is manipulated. FIG. 46 shows a state in which the cartridge B is set in the main assembly of the apparatus A and the lever 253 has been operated.

As shown in FIG. 45, the displaceable member 147 is mounted on the inner side plate 145 rotatably about the shaft portion 147*a*. The contact member 144 is mounted on the displaceable member 147. The displaceable member 147 is urged in the direction of an arrow d by a compression spring (unshown). The contact 144*a* is at a position where it does not project into the main assembly of the apparatus (mounting portion 130*a* side) beyond the cover 171.

The cartridge B is inserted in the direction of arrow X along the guide portions 130L1, 130L2.

After the cartridge B is completely mounted in the main assembly of the apparatus A, the operation member 142 rotates in the direction of arrow b (FIG. 46) upon the operator operating the lever 253. By this, the engaging portion 142*d* pushes one end portion 147*c* of the displaceable member 147 (displaceable engaging portion). Therefore, the displaceable member 147 rotates in the direction of an arrow g. By this, the contact 141*a* moves to the contact position. The contact 144*a* is rotated and is projected into the inside of the apparatus beyond the cover 171. As a result, the contact 144*a* and the contact 141*a* are contacted to each other.

By this, the supply of the charging bias voltage to the charging roller 108 from the main assembly of the apparatus A is enabled. When the operation member 142 rotates, the contact 144*a* also rotates in a different direction. These contacts are brought into contact with each other while moving. The contacts make slight relative motion even after they are contacted. In this manner, the contact 141*a* rubs the surface of the contact 144*a*. Therefore, the surface of the contact 141*a* and the surface of the contact 144*a* rub each other. By doing so, foreign matter, developer or the like deposited on the surfaces can be removed. Thus, the reliability of the electrical connection between the contact 141*a* and the contact 144*a* is improved.

At this time, the operation member 142 is positioned by abutment between the abutting portion 142*c* and the abutting portion 1118*f*.

This enables the device to supply the charging bias to the charging roller 108 of the cartridge B from the main assembly A of the apparatus.

This embodiment also provides the advantageous effects similar to Embodiment 2.

Embodiment 6

Referring to FIG. 47–FIG. 50, the sixth embodiment will be described.

The structures of the cartridge B and the image forming apparatus 100 of this embodiment are similar to those of Embodiment 1–Embodiment 5. The same reference numerals used to describe foregoing embodiments are assigned to elements having corresponding functions, and the detailed descriptions for such elements are omitted for simplicity.

In this embodiment, the operation of the cam member in said Embodiment 5 is interrelation with a closing operation of the cartridge door of the main assembly of the apparatus A.

Figure 47:
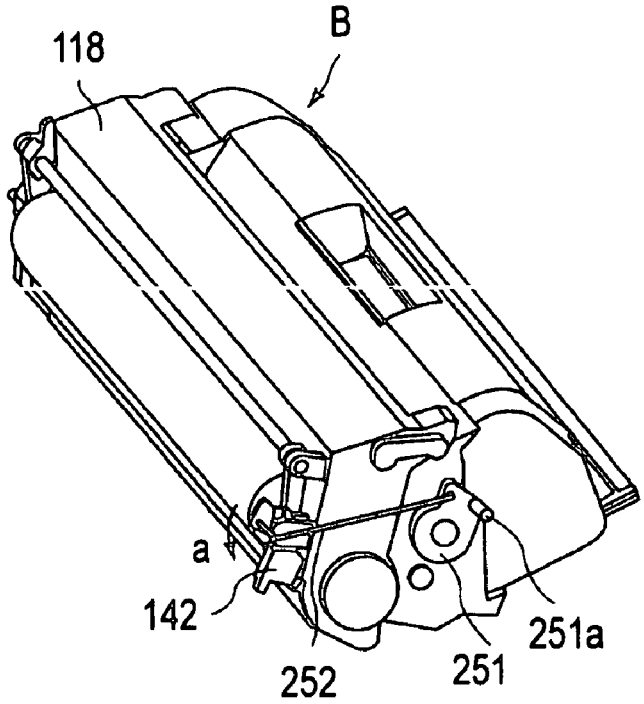
FIG. 47 is a perspective view showing a structure of a movable operation member of a process cartridge according to a further embodiment of the present invention.
Figure 48:
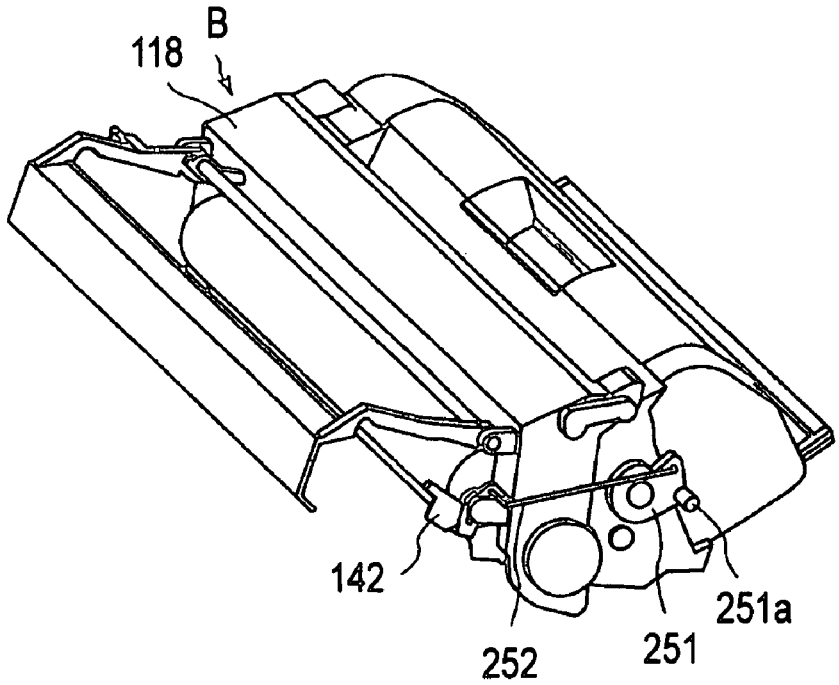
FIG. 48 is a perspective view showing a structure of a movable operation member of a process cartridge according to a further embodiment of the present invention.

Referring to FIG. 47, a description will be provided as to the structure of a cartridge operation member 142 mounted to the cartridge B in this embodiment.

Similarly to Embodiment 5, the operation member 142 is connected with the cam member 251 through the arm member 252. Cam member 251 is provided with a projection 251*a* for rotating the cam member 251. The operation member 142 is urged so as to rotate in the direction of the arrow a by a twisted coil spring. The structures of the arm member 252 and the cam member 251 are the same as with Embodiment 5, and therefore, the detailed description thereof is omitted for simplicity.

Figure 49:
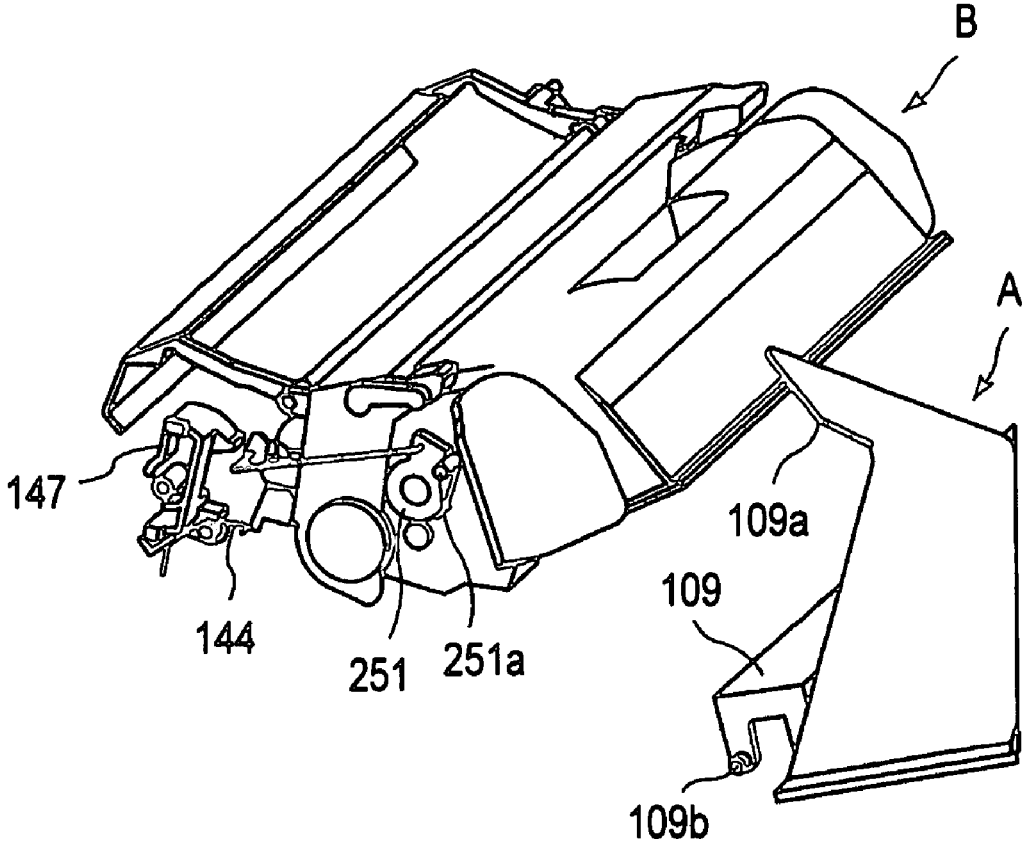
FIG. 49 illustrates a perspective view of the structure of an electrical contact portion in the main assembly of the image forming apparatus according to the embodiment of the present invention.

FIG. 49 shows a state in which the cartridge B is inserted into the main assembly of the apparatus A, and the cartridge door (openable member of the main assembly) 109 is not yet closed. The structures of the main assembly charging contact member 144 of the main assembly of the apparatus A and the displaceable member 147 are similar to those of said Embodiment 5, and therefore, the detailed description thereof is omitted for simplicity.

The door 109 is rotatable about the shaft 109*b*. FIG. 49 shows a state in which the door 109 is opened. An inside of the door 109 is provided with a rib 109*a* for pushing the projection 251*a* of the cam member 251 provided in the cartridge B.

Figure 50:
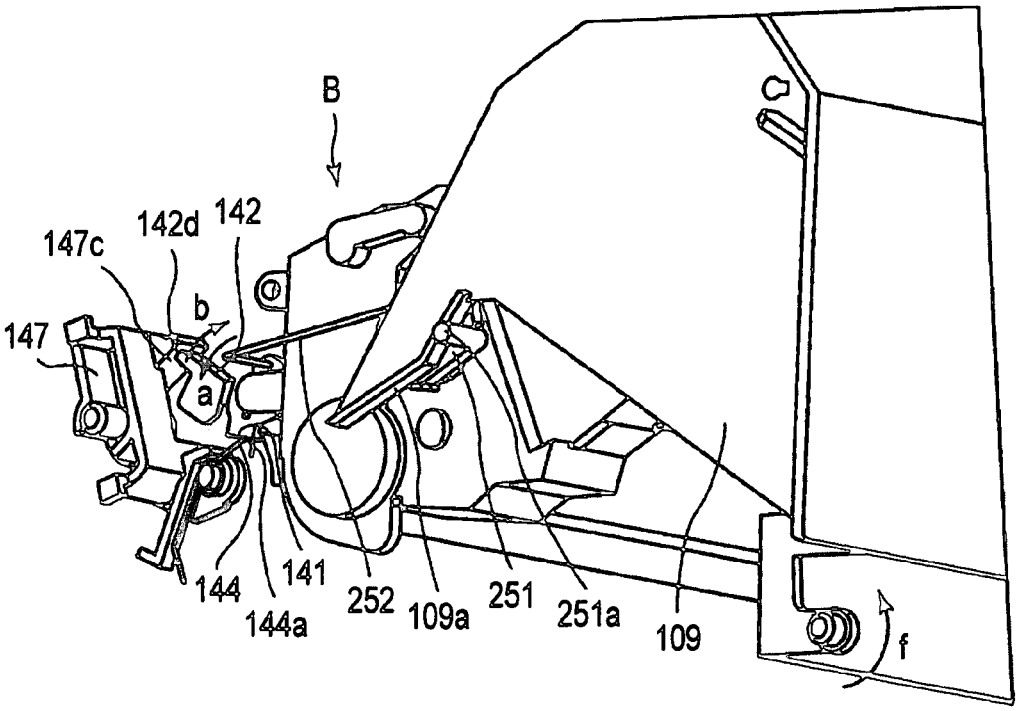
FIG. 50 illustrates a perspective view of the structure of an electrical contact portion in the main assembly of the image forming apparatus according to the embodiment of the present invention.

FIG. 50 shows a state in which the cartridge B is set in the main assembly of the apparatus A, and the door 109 is closed. When the door 109 is closed in the direction of an arrow f, the rib 109*a* pushes the projection 251*a* of the cam member 251. By doing so, similarly to Embodiment 5, the operation member 142 is rotated in the direction of an arrow b through the arm member 252. And, the free end portion 142*d* is contacted to an inclined surface 147*c* of the displaceable member 147. By this, the displaceable member 147 is moved. Then, the contact 144*a* is rotated and projected into the main assembly of the apparatus in interrelation with the displaceable member 147. By this, the contact 144*a* is contacted to the contact 141*a*. And, the application of the charging bias voltage to the charging roller 108 is enabled.

By this, the supply of the charging bias voltage to the charging roller 108 from the main assembly of the apparatus A is enabled. When the operation member 142 rotates, the contact 144*a* also rotates in a different direction. These contacts are brought into contact with each other while moving. The contacts make slight relative motion even after they are contacted. In this manner, the contact 141*a* rubs the surface of the contact 144*a*. Therefore, the surface of the contact 141*a* and the surface of the contact 144*a* rub each other. By doing so, foreign matter, developer or the like deposited on the surfaces can be removed. Thus, the reliability of the electrical connection between the contact 141*a* and the contact 144*a* is improved.

When the cartridge B is removed from the main assembly of the apparatus A, the operator opens the door 109. Then, as described hereinbefore, the elastic force of the twisted coil spring provided on the operation member 142 rotates the operation member 142 in the direction of an arrow a. By this, the operation member 142 returns to the initial state.

This embodiment also provides the advantageous effects similar to Embodiment 2.

The process cartridge B to which the present invention is applicable is not limited to a process cartridge for formation of the monochromatic image. But it may be a color cartridge for formation of a multicolor image (two-color images, three-color images, full-color images or the like) using a plurality of developing means.

The photosensitive member may be a photoconductor which may be an amorphous silicon, amorphous selenium, zinc oxide, titanium oxide, organic photoconductor (OPC)

or the like. The photosensitive member may be in the form of a drum, a belt or another rotatable member, or a sheet, or the like. The photosensitive member may be in the form of a drum or a belt. In the case of a drum type photosensitive member, a cylinder of aluminum alloy or the like is coated with a photoconductor by evaporation or application or the like.

The present invention is preferably usable with various known developing methods, such as the magnetic brush developing method using two component toner, the cascade developing method, the touch-down developing method, and the cloud developing method.

The structure of the charging means described in the foregoing is of a so-called contact type charging method, but a known charging means comprising a tungsten wire, which is enclosed width metal shield of aluminum or the like at three sides. The positive or negative ions generated by the application of a high voltage to the tungsten wire are directed to the surface of the photosensitive drum to uniformly charged the surface, is usable.

The charging means may be a roller type as described in the foregoing, a blade type (charging blade), a pad type, a block type, a rod type, a wire type or the like.

As for a cleaning method for removing toner remaining on the photosensitive drum, a blade, a fur brush, a magnetic brush or the like is usable.

As described in the foregoing, according to the present invention, the reliability of the establishment of electrical connection is carried out between the output electrical contact of the main assembly of the electrophotographic image forming apparatus and the input electrical contact of the process cartridge when the process cartridge is mounted to the main assembly of the apparatus, is improved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 411034/2003 and 352533/2004 filed Dec. 9, 2003 and Dec. 6, 2004, which are hereby incorporated by reference.

What is claimed is:

1. A process cartridge detachably mountable to a main assembly of an electrophotographic image forming apparatus, the main assembly including an output contact movable between an electrical connecting position and a retracted position retracted from the electrical connecting position, a displaceable member configured and positioned to move the output contact, and a main assembly elastic function member configured and positioned to elastically urge the displaceable member to urge the output contact toward the retracted position away from the electrical connecting position, said process cartridge comprising:

an electrophotographic photosensitive drum;

process means for acting on said electrophotographic photosensitive drum;

an actuating member;

a movable operation member movable relative to a cartridge frame and caused to move by said actuating member, after said process cartridge is mounted to the main assembly of the apparatus, to be engaged with a displaceable engaging portion of the displaceable member to move the displaceable member, in interrelation with which the output contact is moved from the retracted position to the electrical connection position against an elastic force of the main assembly elastic function member; and an input electrical contact configured and positioned to receive a voltage for enabling said process means by engagement with the output contact moved to the electrical connecting position, said input electrical contact being provided to be exposed on said movable operation member and being movable between an electrical connecting position for electrically connecting to the output contact and a retracted position which is retracted from the electrical connection position.

2. A process cartridge according to claim 1, further comprising a driving force receiving portion configured and positioned to receive a driving force from the main assembly of the image forming apparatus when said process cartridge is mounted to the main assembly of the image forming apparatus, said driving force receiving portion being disposed at a first end of said process cartridge with respect to a longitudinal direction of said electrophotographic photosensitive drum, and said movable operation member being disposed at a second end of said process cartridge with respect to the longitudinal direction.

3. A process cartridge according to claim 1 or 2, wherein said movable operation member has an engaging portion engageable with the displaceable member, and by a user of said process cartridge moving said actuating member after said process cartridge is mounted to the main assembly of the apparatus, said movable operation member is rotated in a clockwise direction, as seen in a longitudinal direction of said electrophotographic photosensitive drum from an outside of a side of said process cartridge where the movable operation member is provided, to engage said engaging portion with the displaceable member.

4. A process cartridge according to claim 3, wherein a shaft of said movable operation member is extended coaxially with the electrophotographic photosensitive drum, and the movable operation member is disposed at a longitudinal end of said cartridge frame.

5. A process cartridge according to claim 1 or 2, wherein said movable operation member has an engaging portion configured and positioned to engage the displaceable member, and said movable operation member is rotated through said actuating member by a user of the apparatus manually closing a main assembly openable and closeable member of the apparatus, so that said engaging portion is engaged with said displaceable member.

6. A process cartridge according to claim 1 or 2, wherein said movable operation member is rotated by a user of said process cartridge manually operating said actuating member, and said movable operation member is contacted to the displaceable member to move the output contact to the electrical connecting position thereof by the rotation of said movable operation member, so that the output contact is contacted to the input electrical contact.

7. A process cartridge according to claim 1 or 2, wherein the main assembly of the apparatus further comprises an openable and closable member for opening and closing the main assembly of the apparatus, and wherein said movable operation member is rotated by a user of said process cartridge manually closing said openable and closable member, and said movable operation member is contacted to the displaceable member to move the output contact to the electrical connecting position thereof by the rotation of said movable operation member, so that the output contact is contacted to the input electrical contact.

8. A process cartridge detachably mountable to a main assembly of an electrophotographic image forming apparatus, the main assembly of the electrophotographic image forming apparatus including:

a voltage source;

a voltage source circuit electrically connected with said voltage source;

a cartridge mounting portion configured and positioned to detachably mount said process cartridge;

a fixed engageable member;

an output contact movable between an electrical connecting position and a retracted position which is retracted from the electrical connecting position and which is outside said cartridge mounting portion, said output contact electrically connected with said voltage source through said voltage source circuit;

a displaceable member having a displaceable engaging portion configured and positioned to move the output contact, wherein the displaceable engaging portion is disposed downstream of the fixed engageable member, and at least a part of the displaceable engaging portion is overlapped with the fixed engageable member with respect to a direction in which said process cartridge is inserted; and a main assembly elastic function member configured and positioned to elastically urge the displaceable member to urge the output contact toward the retracted position away from the electrical connecting position;

said process cartridge including:

an electrophotographic photosensitive drum;

process means for acting on said electrophotographic photosensitive drum;

an actuating member;

a movable operation member movable relative to a cartridge frame and caused to move by said actuating member, after said process cartridge is passed by the fixed member and mounted to the cartridge mounting portion, to be engaged with the displaceable member to move the displaceable member, in interrelation with which the output contact is moved from the retracted position to the electrical connection position against an elastic force of the main assembly elastic function member; and an input electrical contact configured and positioned to receive a voltage for enabling said process means by engagement with the output contact moved to the electrical connecting position, said input electrical contact being provided to be exposed on said movable operation member and being movable between an electrical connecting portion for electrically connecting to the output contact and a retracted position which is retracted from the electrical connection position.

9. A process cartridge according to claim 8, further comprising a driving force receiving portion configured and positioned to receive a driving force from the main assembly of the image forming apparatus when said process cartridge is mounted to the main assembly of the image forming apparatus, said driving force receiving portion being disposed at a first end of said process cartridge with respect to a longitudinal direction of said electrophotographic photosensitive drum, and said movable operation member being disposed at a second end of said process cartridge with respect to the longitudinal direction.

10. A process cartridge according to claim 8 or 9, wherein said movable operation member has an engaging portion configured and positioned to engage the displaceable member, and wherein said movable operation member is rotated through said the actuating member by a user of the apparatus manually closing a main assembly openable and closeable member of the apparatus, so that said engaging portion is moved to a position for engagement with the displaceable member and is engaged with the displaceable member.

11. A process cartridge according to claim 8 or 9, wherein said movable operation member is rotated by a user of said process cartridge manually operating said actuating member, and said movable operation member is contacted to the displaceable member to move the output contact to the electrical connecting position thereof by the rotation of said movable operation member, so that the output contact is contacted to the input electrical contact.

12. A process cartridge according to claim 8 or 9, wherein the main assembly of the apparatus further comprises an openable and closable member for opening and closing the main assembly of the apparatus, and wherein said movable operation member is rotated by a user of said process cartridge manually closing said openable and closable member, and said movable operation member is contacted to the displaceable member to move the output contact to the electrical connecting position thereof by the rotation of said movable operation member, so that the output contact is contacted to the input electrical contact.

13. An electrophotographic image forming apparatus for forming an image on a recording material, to which a process cartridge is detachably mountable, said apparatus comprising:

(i) an output contact movable between an electrical connecting position and a retracted position retracted from the electrical connecting position;

(ii) a main assembly displaceable member configured and positioned to move said output contact;

(iv) a mounting portion configured and positioned to detachably mount the process cartridge, the process cartridge including:

an electrophotographic photosensitive drum;

process means for applying a voltage relative to the electrophotographic photosensitive drum;

an actuating member;

a movable cartridge operation member movable relative to a cartridge frame and caused to move by a user operating said actuating member, after the process cartridge is mounted to the main assembly of said apparatus, to be engaged with a displaceable engaging portion of said displaceable member provided in the main assembly of said electrophotographic image forming apparatus to move said displaceable member, in interrelation with which said output contact is moved from the retracted position to the electrical connection position against an elastic force of an elastic function member; and an input electrical contact configured and positioned to receive a voltage for enabling the process means by engagement with said output contact moved to the electrical connecting position, the input electrical contact being provided integrally with the movable operation member and being movable between an electrical connecting position for electrically connecting to the output contact and a retracted position which is retracted from the electrical connection position.

14. An apparatus according to claim 13, wherein the process cartridge further comprises a driving force receiving portion configured and positioned to receive a driving force from the main assembly of said image forming apparatus when the process cartridge is mounted to the main assembly of said image forming apparatus, the driving force receiving portion being disposed at a first end of the process cartridge with respect to a longitudinal direction of the electrophotographic photosensitive drum, and the movable operation member being disposed at a second end of the process cartridge with respect to the longitudinal direction.

15. An apparatus according to claim 13 or 14, wherein after said process cartridge is mounted to said mounting portion, an engaging portion of the movable cartridge operation member is rotated as a result of the user operating the actuating member to engage with the displaceable member.

16. An apparatus according to claim 13 or 14, wherein said main assembly displaceable member has a displaceable engaging portion, wherein said displaceable engaging portion is disposed downstream of said fixed member with respect to an inserting direction in which the process cartridge is inserted into the main assembly of said electrophotographic image forming apparatus, and wherein at least a part of said displaceable engaging portion is overlapped with said fixed member with respect to the inserting direction.

17. An apparatus according to claim 13 or 14, wherein said main assembly displaceable member has a displaceable engaging portion and the main assembly of said apparatus has a fixing member, wherein said displaceable engaging portion is disposed downstream of said fixed member with respect to an inserting direction in which the process cartridge is inserted into the main assembly and wherein at least a part of said displaceable engaging portion is overlapped with said fixed member with respect to the inserting direction.

18. An apparatus according to claim 13 or 14, wherein said movable operation member is rotated by a user of said process cartridge manually operating said actuating member, and said movable operation member is contacted to said displaceable member to move said output contact to the electrical connecting position thereof by the rotation of said movable operation member, so that said output contact is contacted to said input electrical contact.

19. An apparatus according to claim 13 or 14, wherein said main assembly of said apparatus further comprises an openable and closable member for opening and closing said main assembly of said apparatus, and wherein said movable operation member is rotated by a user of said process cartridge manually closing said openable and closable member, and said movable operation member is contacted to said displaceable member to move said output contact to the electrical connecting position thereof by the rotation of said movable operation member, so that said output contact is contacted to said input electrical contact.

20. An apparatus according to claim 15, wherein said main assembly displaceable member has a displaceable engaging portion, wherein said displaceable engaging portion is disposed downstream of said fixed member with respect to an inserting direction in which the process cartridge is inserted into the main assembly of said electrophotographic image forming apparatus, and wherein at least a part of said displaceable engaging portion is overlapped with said fixed member with respect to the inserting direction.

* * * * *

UNITED STATES PATENT AND TRADEMARK OFFICE

CERTIFICATE OF CORRECTION

PATENT NO. : 7,130,557 B2
APPLICATION NO. : 11/007214
DATED : October 31, 2006
INVENTOR(S) : Daisuke Abe et al.

It is certified that error appears in the above-identified patent and that said Letters Patent is hereby corrected as shown below:

ON THE COVER PAGE
In the "(54) TITLE", line 2, "ELECTROGRAPHIC" should read --ELECTROPHOTOGRAPHIC--.

COLUMN 1
Line 2, "ELECTROGRAPHIC" should read --ELECTROPHOTOGRAPHIC,--.
Line 28, "remarkably-improved." should read --remarkably improved.--.

COLUMN 2
Line 23, "contact portion" should read --contact member--.
Line 25, "improvements" should read --improvement--.

COLUMN 4
Line 15, "perspective views" should read --slit a perspective view--.

COLUMN 6
Line 20, "developed." should read --is developed.--.

COLUMN 7
Line 24, "to" should be deleted.

COLUMN 9
Line 30, "rotatably" should read --is rotatably--.

COLUMN 10
Line 51, "functioning" should read --functioning as--.

COLUMN 13
Line 12, "abuted" should read --abutted--.
Line 38, "electrical" should read --electrical contact--.

COLUMN 14
Line 24, "which" should be deleted.

COLUMN 15
Line 62, "development output" should read --output electrical--.

UNITED STATES PATENT AND TRADEMARK OFFICE

CERTIFICATE OF CORRECTION

PATENT NO. : 7,130,557 B2
APPLICATION NO. : 11/007214
DATED : October 31, 2006
INVENTOR(S) : Daisuke Abe et al.

It is certified that error appears in the above-identified patent and that said Letters Patent is hereby corrected as shown below:

COLUMN 17
Line 7, “couterclock” should read --counterclock--.
Line 21, “couterclockwise” should read --counterclockwise--.
Line 22, “of” should read --in--.
Line 39, “of” should read --in--.
Line 62, “an inside” should be deleted.
Line 63, “operation member” should read --operation member 142--.

COLUMN 18
Line 52, “is” should be deleted.

COLUMN 19
Line 28, “openable” should read --operable--.
Line 59, “couterclockwise” should read --counterclockwise--.

COLUMN 22
Line 52, “view” should read --views--.

COLUMN 24
Line 62, “view” should read --views--.

UNITED STATES PATENT AND TRADEMARK OFFICE

CERTIFICATE OF CORRECTION

PATENT NO. : 7,130,557 B2
APPLICATION NO. : 11/007214
DATED : October 31, 2006
INVENTOR(S) : Daisuke Abe et al.

It is certified that error appears in the above-identified patent and that said Letters Patent is hereby corrected as shown below:

COLUMN 27

Line 3 and ending in Line 4, "The photosensitive member may be in the form of a drum or a belt" should be deleted.

Line 16, "width" should read --with a--.

Line 20, "charged the surface, is usable." should read --charge the surface, is one usable approach.--.

Signed and Sealed this

Tenth Day of February, 2009

JOHN DOLL
*Acting Director of the United States Patent and Trademark Office*